US010135161B2

(12) United States Patent
Sunada

(10) Patent No.: US 10,135,161 B2
(45) Date of Patent: Nov. 20, 2018

(54) CONNECTOR AND ELECTRICAL CONNECTION DEVICE

(71) Applicant: J.S.T. Mfg. Co., Ltd., Osaka-shi (JP)

(72) Inventor: Satoshi Sunada, Osaka (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 15/605,013

(22) Filed: May 25, 2017

(65) Prior Publication Data

US 2017/0373414 A1 Dec. 28, 2017

(30) Foreign Application Priority Data

Jun. 22, 2016 (JP) ..... 2016-123583

(51) Int. Cl.
*H01R 3/00* (2006.01)
*H01R 12/70* (2011.01)
(Continued)

(52) U.S. Cl.
CPC ..... *H01R 12/7005* (2013.01); *H01R 12/712* (2013.01); *H01R 12/721* (2013.01)

(58) Field of Classification Search
CPC ..... H01R 12/79; H01R 12/88; H01R 12/592; H01R 23/668; H01R 23/684; H01R 13/658
(Continued)

(56) References Cited

U.S. PATENT DOCUMENTS 4,695,112 A * 9/1987 Maston ..... H01R 12/79 439/328
6,482,027 B2 * 11/2002 Ishii ..... H01R 12/79 439/354
(Continued)

FOREIGN PATENT DOCUMENTS

JP 2003-31316 A1 1/2003
JP 2005-4993 A1 1/2005
(Continued)

OTHER PUBLICATIONS

Notification of Reasons for Refusal for Patent Application No. 2016-123583 (3 Sheets, 3 Sheets translation, 6 Sheets total) dated Aug. 18, 2016.

*Primary Examiner* — Hien Vu
(74) *Attorney, Agent, or Firm* — Kratz, Quintos & Hanson, LLP

(57) ABSTRACT

A connector has a conductive member attaching portion to which an end portion of a conductive member is to be attached, and a holder portion provided with an insertion hole into which the conductive member is inserted, and a fitting hole into which the conductive member attaching portion is fitted, the fitting hole being in communication with the insertion hole, the holder portion being configured to hold the conductive member attaching portion. The holder portion is provided with engaged portions with which engaging portions, which are provided at respective ends of the conductive member in the width direction, engage. The conductive member attaching portion is provided with a closing portion configured to close a part of the insertion hole. When the conductive member attaching portion has been fitted into the holder portion, the closing portion closes a part of the insertion hole with the engaging portions engaged with the engaged portions.

8 Claims, 79 Drawing Sheets

(51) Int. Cl.
*H01R 12/71* (2011.01)
*H01R 12/72* (2011.01)

(58) Field of Classification Search
USPC ..... 439/495, 498, 499, 260
See application file for complete search history.

(56) References Cited

U.S. PATENT DOCUMENTS

| | | | | |
|---|---|---|---|---|
| 6,520,797 | B2 * | 2/2003 | Okamura | H01R 23/667 439/495 |
| 6,733,343 | B2 | 5/2004 | Morita | |
| 7,048,573 | B2 | 5/2006 | Masaki | |
| 7,189,105 | B2 * | 3/2007 | Takaku | H01R 12/775 439/497 |
| 7,625,231 | B2 * | 12/2009 | Takahira | H01R 12/79 439/260 |
| 8,435,059 | B2 * | 5/2013 | Honda | H01R 12/88 439/260 |
| 2003/0017748 | A1 | 1/2003 | Morita | |
| 2004/0248460 | A1 | 12/2004 | Masaki | |
| 2016/0226168 | A1 | 8/2016 | Okura | |

FOREIGN PATENT DOCUMENTS

| | | | |
|---|---|---|---|
| JP | 2012-164430 | A1 | 8/2012 |
| JP | 2015-56233 | A1 | 3/2015 |
| JP | 2015-60662 | A1 | 3/2015 |

* cited by examiner

CONNECTOR AND ELECTRICAL CONNECTION DEVICE

CROSS-REFERENCE TO RELATED APPLICATION

This application claims priority to Japanese Patent Application No. 2016-123583. The entire disclosure of Japanese Patent Application No. 2016-123583 is hereby incorporated herein by reference.

BACKGROUND OF THE INVENTION

1. Field of the Present Invention

The present invention relates to a connector to which a conductive member is connected, the conductive member being configured as a flexible cable or a flexible board having a plurality of conductors, and an electrical connection device that includes this connector.

2. Description of Related Art

JP 2005-4993A discloses a known example of a connector to which a conductive member is connected, the conductive member being configured as a flexible cable or a flexible board having a plurality of conductors. A connector (2) disclosed in JP 2005-4993A is configured to include a holder (22) and a fixing member (23).

The holder (22) includes a placing plate (25) having a placing face (24) on which a conductive member (FFC1) is placed. The holder (22) is provided with positioning projections (30, 31) capable of being engaged with concaved grooves (6c, 6d), which are provided at respective ends of the conductive member in the width direction in left and right side portions of the placing face (24) of the placing plate (25). The fixing member (23) includes an annular portion (37) that demarcates an insertion hole (38) into which the placing plate (25), on which the conductive member is placed, is inserted together with the conductive member.

In the connector (2) in JP 2005-4993A, the conductive member is placed on the holder (22) with the concaved grooves (6c, 6d) at respective ends in the width direction engaged with the projections (30, 31) on the placing plate (25) of the holder (22).

As a result of the placing plate (25), on which the conductive member is placed, being inserted into the insertion hole (38) in the fixing member (23), and a pair of engagement portions (43) of the fixing member (23) being engaged with a pair of engaged portions (34) of the holder (22), connection of the conductive member to the connector (2) is complete.

In the connector (2) in JP 2005-4993A, the conductive member is held as a result of the projections (30, 31) on the placing plate (25) of the holder (22) being engaged with the concaved grooves (6c, 6d) at respective ends of the conductive member in the width direction. For this reason, if the concaved grooves (6c, 6d) come off the projections (30, 31), the conductive member comes off the connector (2). Thus, with the connector (2) in JP 2005-4993A, it is difficult to firmly hold the conductive member. Accordingly, it is desirable to realize a connector structure capable of preventing the conductive member from coming off the connector and firmly holding the conductive member.

SUMMARY OF THE INVENTION

In view of the foregoing situation, the present invention aims to provide a connector capable of preventing a conductive member from coming off, the conductive member being configured as a flexible cable or a flexible board having a plurality of conductors, and capable of firmly holding the conductive member. Furthermore, the present invention aims to provide an electrical connection device that includes this connector.

(1) A connector according to an aspect of the present invention for achieving the above-stated object is a connector to which a conductive member configured as a flexible cable or a flexible board having a plurality of conductors is to be connected, including: a conductive member attaching portion configured such that an end portion of the conductive member is to be attached to the conductive member attaching portion; and a holder portion configured to hold the conductive member attaching portion, the holder portion being provided with an insertion hole into which the conductive member is to be inserted, and a fitting hole configured such that the conductive member attaching portion, to which the end portion of the conductive member inserted in the insertion hole has been attached, is fitted into the fitting hole, the fitting hole being in communication with the insertion hole. The holder portion is provided with an engaged portion configured such that an engaging portion, which is provided in a part of each end of the end portion of the conductive member in a width direction is to be engaged with the engaged portion, the conductive member attaching portion is provided with a closing portion configured to close a part of the insertion hole, and when the conductive member attaching portion, to which the end portion of the conductive member inserted in the insertion hole has been attached, has been fitted into the holder portion, the closing portion closes a part of the insertion hole with the engaging portion engaged with the engaged portion.

With this configuration, the end portion of the conductive member inserted in the insertion hole is attached to the conductive member attaching portion. Then, in this state, the conductive member attaching portion is fitted into the holder portion, and a part of the insertion hole in the holder portion is closed by the closing portion of the conductive member attaching portion with the engaging portion of the conductive member engaged with the engaged portion of the holder portion. For this reason, the conductive member connected to the connector is held in a state of being engaged with the holder portion of the connector. Moreover, a part of the insertion hole in the holder portion is closed by the conductive member attaching portion. Thus, the conductive member is prevented from falling out of the insertion hole and coming off the connector. As a result, the connector can firmly hold the connected conductive member.

Accordingly, with this configuration, it is possible to provide a connector capable of preventing a conductive member from coming off, the conductive member being configured as a flexible cable or a flexible board having a plurality of conductors, and capable of firmly holding the conductive member.

Note that the modes of connectors to which a plurality of conductor elements are connected include a mode of a connector to which a conductive member is connected, the conductive member being configured as a flexible cable or a flexible board having a plurality of conductors, as well as a mode of a connector to which a plurality of terminals are connected, electric wires having been connected to the terminals in one-to-one correspondence. In the mode of a connector to which a plurality of terminals are connected, electric wires having been connected to the terminals in one-to-one correspondence, each of the plurality of terminals is fitted into the housing of the connector. Accordingly, the plurality of terminals can be firmly held. For this reason, when used in a harsh environment in which a load, such as vibrations, is likely to be applied to a connector, the mode of a connector to which a plurality of terminals are connected is used.

However, in the case of the mode of a connector to which a plurality of terminals are connected, the connector has a configuration in which each of the plurality of terminals is fitted into the housing of the connector. Accordingly, the structure is likely to be larger and more complex. In contrast, in the case of the mode of a connector to which a conductive member is connected, the conductive member, on which a plurality of conductors are densely arranged, is connected to the connector. Accordingly, it is easy to make the structure compact and simple. However, in the case of the connector (2) disclosed in JP 2005-4993A the mode of which is the one where the conductive member is connected to the connector (2), if the concaved grooves (6c, 6d) of the conductive member come off the projections (30, 31), the conductive member comes off the connector (2). Accordingly, it is difficult to firmly hold the conductive member.

Regarding the situation of the above-described conventional technique, a configuration of a connector according to an aspect of the present invention can prevent a conductive member from coming off, and can firmly hold the conductive member. Since the conductive member, on which a plurality of conductors are densely arranged, is connected to the connector, a compact and simple structure can be realized. Thus, with the configuration of the connector according to an aspect of the present invention, a compact and simple structure can be realized. The conductive member can be prevented from coming off. The conductive member can be firmly held. The connector can be stably used even in a harsh environment in which a load, such as vibrations, is likely to be applied to the connector.

(2) The conductive member attaching portion may be provided with a casing-like portion that demarcates an insertion slot into which the end portion of the conductive member is inserted, and the end portion of the conductive member may be attached to the conductive member attaching portion by being inserted into the insertion slot.

With this configuration, the end portion of the conductive member is attached to the conductive member attaching portion as a result of the end portion of the conductive member being inserted into the insertion slot, which is demarcated by the casing-like portion of the conductive member attaching portion. For this reason, when in a state where the end portion of the conductive member has been attached to the conductive member attaching portion, a given region of the end portion of the conductive member in the longitudinal direction of the conductive member is circumferentially covered and enclosed by the casing-like portion of the conductive member attaching portion. As a result, the conductive member is prevented from bending in the width direction. As a result of the bending of the conductive member in the width direction being prevented, an operation to connect the conductive member to the connector is facilitated, and the operability can be improved. Furthermore, when the connector, to which the conductive member has been connected, is fitted and thus connected to the counterpart connector, the bending of the conductive member in the width direction is prevented. As a result, it is possible to prevent a fitting failure that causes electrical contact failure between the conductors in the conductive member and the terminals in the counterpart connector.

(3) The closing portion may be configured to close a part of the insertion hole in a state of being fitted into the insertion hole.

With this configuration, the closing portion is fitted into the insertion hole to more firmly close a part of the insertion hole. Accordingly, the conductive member can be more reliably prevented from coming off, and the conductive member can be held more firmly.

(4) The insertion hole in the holder portion may include an engaging portion passage region that is a region at each end of the insertion hole in a width direction of the insertion hole, the engaging portion passage region through which the engaging portion passes when the conductive member is inserted into the insertion hole and passes through the insertion hole, and when the conductive member attaching portion, to which the end portion of the conductive member inserted in the insertion hole has been attached, has been fitted into the holder portion, the closing portion may be configured to close at least the engaging portion passage region in the insertion hole with the engaging portion engaged with the engaged portion.

With this configuration, the closing portion closes a part of the insertion hole so as to close at least the engaging portion passage region. Accordingly, the engaging portion of the conductive member is more reliably prevented from coming off the engaged portion of the holder portion and passing through the insertion hole. As a result, the conductive member can be held more firmly.

(5) The insertion hole of the holder portion may include a conductive member passage region through which the conductive member passes when being inserted into the insertion hole, and a conductive member arrangement region in which the conductive member is arranged in a state of being disposed so as to be shifted from the conductive member passage region after the conductive member has been inserted in the insertion hole, the conductive member passage region may include the engaging portion passage region, and when the conductive member attaching portion, to which the end portion of the conductive member inserted in the insertion hole has been attached, has been fitted into the holder portion, the closing portion may be configured to close the conductive member passage region in the insertion hole with the engaging portion engaged with the engaged portion.

With this configuration, the closing portion closes a part of the insertion hole so as to close the conductive member passage region. Accordingly, the conductive member can be more reliably prevented from coming off, and the conductive member can be held more firmly.

(6) The conductive member attaching portion may be provided with a bending restriction portion configured to hold the end portion of the conductive member attached to the conductive member attaching portion in a front-back face direction of the conductive member in a center part in the width direction of the conductive member attaching portion, the bending restriction portion restricting bending deformation of the conductive member.

With this configuration, the end portion of the conductive member is sandwiched in the front-back face direction by the bending restriction portion in a center part of the conductive member attaching portion in the width direction, and bending deformation of the end portion of the conductive member is restricted. For this reason, the conductive member is prevented from bending in the width direction. As a result of the bending of the conductive member in the width direction being prevented, an operation to connect the conductive member to the connector is facilitated, and the operability can be improved. Furthermore, when the connector, to which the conductive member has been connected, is fitted and thus connected to the counterpart connector, the bending of the conductive member in the width direction is prevented. As a result, it is possible to prevent a fitting failure that causes electrical contact failure between the conductors in the conductive member and the terminals in the counterpart connector.

(7) The conductive member attaching portion may be provided with a holding mechanism for holding the end portion of the conductive member attached to the conductive member attaching portion.

With this configuration, the end portion of the conductive member is held by the holding mechanism in the conductive member attaching portion. Accordingly, an operation to fit the conductive member attaching portion, to which the conductive member has been attached, into the holder portion is facilitated. For this reason, an operation to connect the conductive member to the connector is facilitated, and the operability can be improved.

(8) An electrical connection device according to an aspect of the present invention for achieving the above-stated object is an electrical connection device including the connector according to any one of the above-described aspects of the present invention, including: a first connector configured as the connector; and a second connector to which the first connector is connected, wherein the second connector includes: a plurality of terminals configured to be electrically connected to the plurality of conductors in the conductive member attached to the conductive member attaching portion; and a housing configured to hold the plurality of terminals, the housing to which the conductive member attaching portion is fitted and with which the holder portion is engaged.

This configuration can achieve the like effects as those achieved by the connector according to the above-described aspects of the present invention. That is to say, this configuration can provide an electrical connection device including a connector capable of preventing a conductive member, which is configured as a flexible cable or a flexible board having a plurality of conductors, from coming off, and capable of firmly holding the conductive member.

(9) The housing may be provided with a leading end exposing portion configured as a window-like part or a cutout part so as to expose a part of a leading end portion of the conductive member attaching portion to the outside, with the conductive member attaching portion fitted to the housing, and with the plurality of terminals electrically connected to the plurality of conductors in the conductive member.

With this configuration, an operator who performed an operation to connect the first connector to the second connector can visually check whether a part of the leading end portion of the conductive member attaching portion is exposed from the leading end exposing portion of the housing. As a result, the operator can readily check whether the first connector and the second connector are appropriately connected to each other with the plurality of terminals and the plurality of conductors being electrically connected. Further, with this configuration, the structure that enables the operator to readily check whether the first connector and the second connector are appropriately connected can be realized as a simple structure in which a window-like portion or a cutout portion is provided in the housing.

(10) The conductive member attaching portion may be provided with a projecting portion provided so as to project to a leading end side of the conductive member attaching portion at each end of the conductive member attaching portion in the width direction, the projecting portion being guided along and fitted into a guide groove provided in the housing, when the conductive member attaching portion is fitted to the housing; and an upper face portion and a lower face portion configured to sandwich the end portion of the conductive member attached to the conductive member attaching portion in a front-back face direction of the conductive member, and a projecting length of the projecting portion relative to one of the upper face portion and the lower face portion is set to be longer than a projecting length of the projecting portion relative to the other one of the upper face portion and the lower face portion.

With this configuration, when an operation is performed to fit the conductive member attaching portion to the housing to connect the first connector to the second connector, the projecting portion that projects on the leading end side at each end of the conductive member attaching portion in the width direction is guided by the guide groove in the housing. For this reason, the conductive member attaching portion can be readily fitted into the housing so as to guide the conductive member attaching portion into the housing. Furthermore, failure during the fitting can be prevented from occurring between the conductive member attaching portion and the housing. Note that, here, a state where "failure during the fitting" has occurred refers to a state where, when the operator tries to insert the conductive member attaching portion to the housing up to a given insertion position to fit the conductive member attaching portion to the housing, a part of the conductive member attaching portion catches on the housing during the insertion, and it is then difficult for the conductive member attaching portion to move, as if the conductive member attaching portion is stuck to the housing.

Also, with this configuration, the projecting length of the projecting portion relative to one of the upper face portion and the lower face portion is set to be longer than a projecting length of the projecting portion relative to the other one of the upper face portion and the lower face portion. That is to say, the electrical connection device having the above-described configuration is configured such that the length of the projecting portion by which it projects from one of the upper face portion and the lower face portion is longer than the length by which the projecting portion projects from the other one of the upper face portion and the lower face portion. For this reason, the positions of the projecting portion relative to the upper face portion and the lower face portion are set asymmetrically in the projecting direction of the projecting portion. The housing is provided with the guide groove that corresponds to the projecting portion, whose positions relative to the upper face portion and the lower face portion of the conductive member attaching portion are set asymmetrically. For this reason, if an operator tries to insert the conductive member attaching portion to the housing upside down, the operator cannot insert the conductive member attaching portion into the housing, and the conductive member attaching portion cannot be fitted into the housing. As a result, with this configuration, the first connector can be prevented from being connected, upside down, to the second connector.

Note that the above and other objects, features, and advantages of the present invention will become apparent by reading the following description with the accompanying drawings.

BRIEF DESCRIPTION OF THE DRAWINGS

FIG. 32A is a perspective view of the second connector.

FIG. 32B is a perspective view showing the first connector, together with a part of a conductive member.

DETAILED DESCRIPTION OF THE INVENTION

Hereinafter, modes for carrying out the present invention will be described with reference to the drawings. Note that the present invention is widely applicable to a connector to which a conductive member is connected, the conductive member being configured as a flexible cable or a flexible board having a plurality of conductors, and electrical connection devices including such a connector.

Electrical Connection Device

Figure 1:
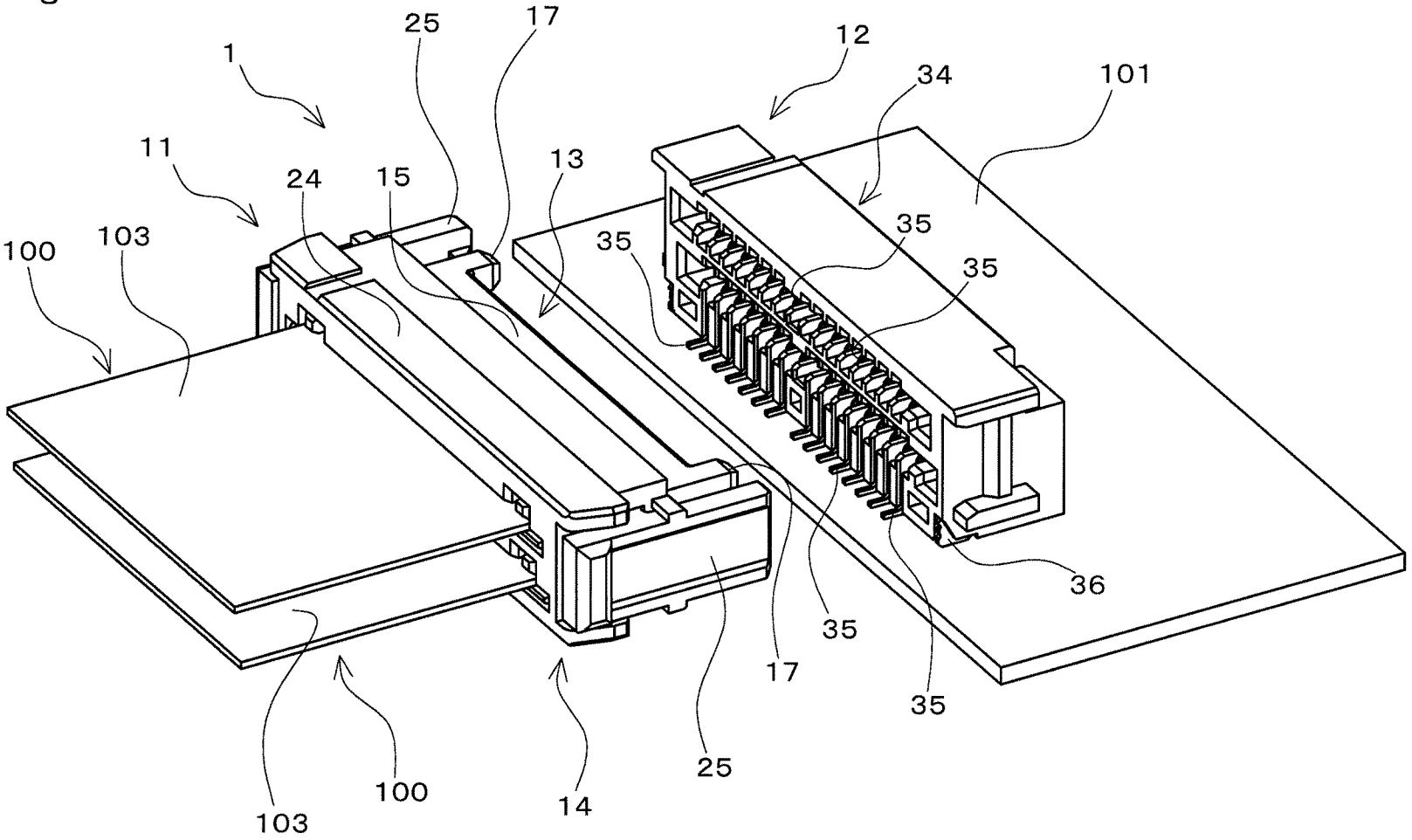
FIG. 1 is a perspective view showing an electrical connection device according to an embodiment of the present invention, together with conductive members and a part of a substrate.
Figure 2:
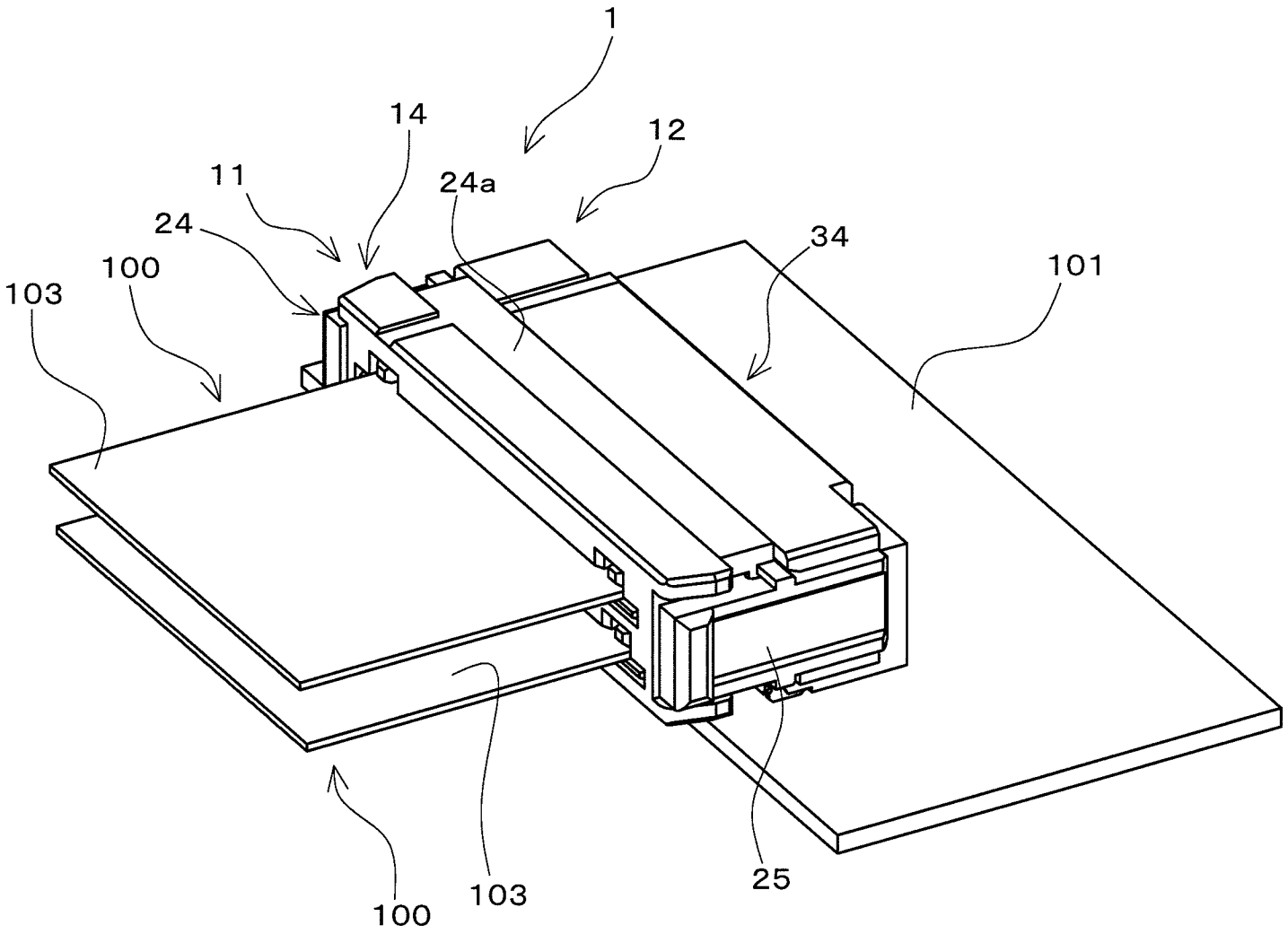
FIG. 2 is a perspective view showing the electrical connection device, together with conductive members and a part of a substrate.

FIG. 1 is a perspective view showing an electrical connection device 1 according to an embodiment of the present invention, together with conductive members 100 and a part of a substrate 101. FIG. 2 is a perspective view showing the electrical connection device 1, together with conductive members 100 and a part of a substrate 101.

The electrical connection device 1 shown in FIGS. 1 and 2 is configured as a device that electrically connects the conductive members 100 and the substrate 101 to each other. The electrical connection device 1 is configured to include a first connector 11, which is configured as a connector according to an embodiment of the present invention, and a second connector 12, which is a counterpart connector to which the first connector 11 is connected. Note that FIGS. 1 and 2 show a part of each conductive member 100 in a cut-out state. Also, FIGS. 1 and 2 show a part of the substrate 101 in a cut-out state.

The first connector 11 in the electrical connection device 1 is configured to be electrically connected to the conductive members 100 and electrically connected to the second connector 12 in the electrical connection device 1. This embodiment describes an exemplary first connector 11 that is configured to be electrically connectable to a plurality of conductive members 100. More specifically, this embodiment describes an exemplary first connector 11 that is configured to be electrically connectable to two conductive members 100. Note that the first connector 11 may be used with two conductive members 100 connected to the first connector 11, or may be used with one conductive member 100 connected to the first connector 11.

The second connector 12 in the electrical connection device 1 is configured to be electrically connected to the substrate 101 and electrically connected to the first connector 11. As a result of the first connector 11, which has been electrically connected to the conductive members 100, being fitted and connected to the second connector 12, which has been electrically connected to the substrate 101, the first connector 11 and the second connector 12 are mechanically and electrically connected to each other. As a result of the first connector 11 and the second connector 12 being electrically connected, the conductive members 100 and the substrate 101 are electrically connected to each other.

Note that the substrate 101, a part of which is schematically shown in a cut-out state in FIGS. 1 and 2, is configured as a substrate in which a conductive circuit pattern is provided on at least one of the front and back faces of the front and back faces. FIGS. 1 and 2 omit the conductive circuit pattern in the substrate 101.

Conductive Member

Figure 3:
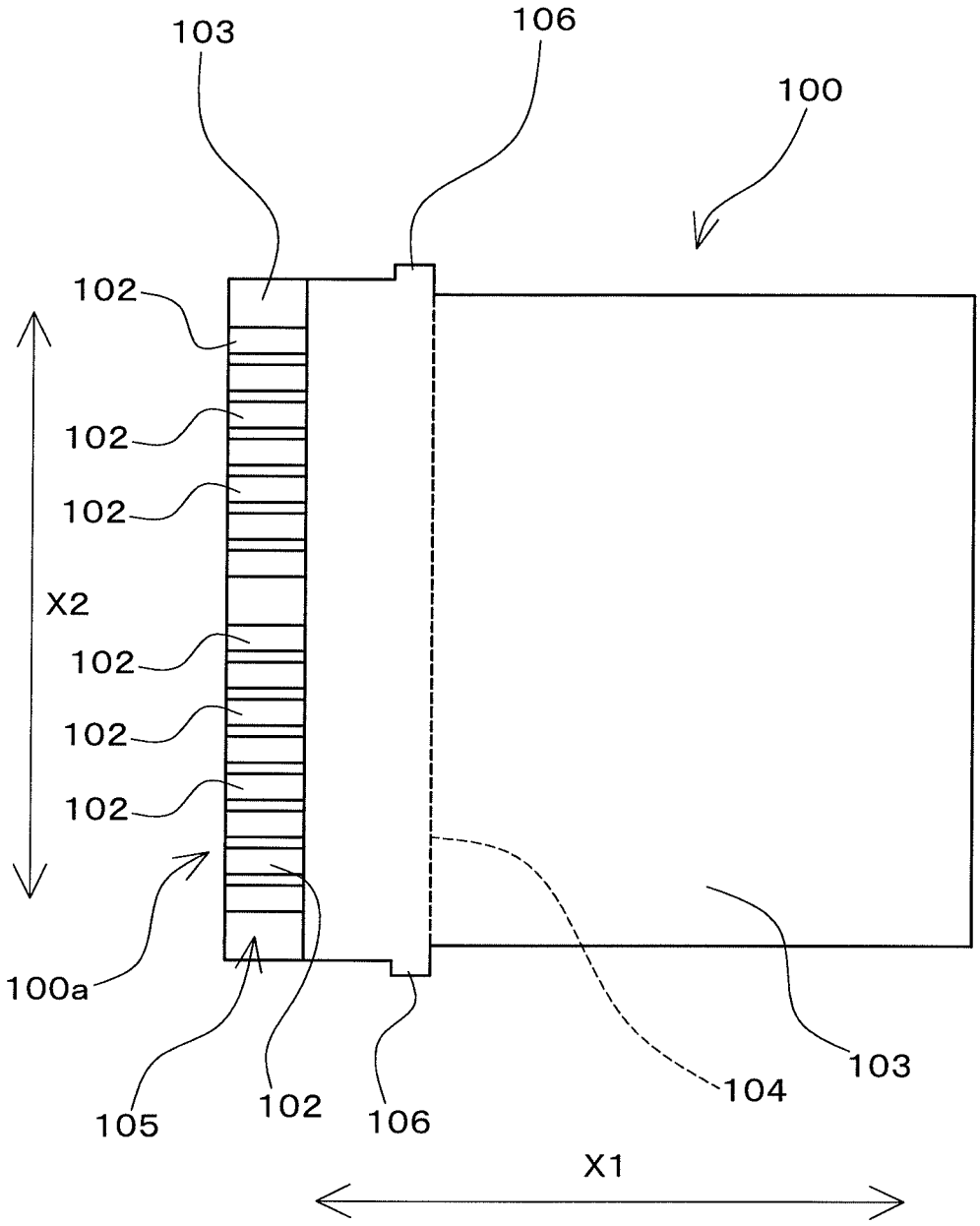
FIG. 3 is a plan view of a conductive member.

The conductive member 100 to be connected to the first connector 11 will now be further described. FIG. 3 is a plan view of the conductive member 100. FIG. 3 schematically shows a part of the conductive member 100, which includes an end portion 100*a*. In this embodiment, the conductive member 100 shown in FIGS. 1 to 3 is configured as a flexible cable having a plurality of insulation-covered conductors. More specifically, the conductive member 100 is configured as a flexible flat cable (FFC). The conductive member 100 is provided with a plurality of conductors 102, a covering portion 103, a reinforcing plate 104, and the like.

The conductive member 100 has an entirely flat, elongated shape. However, FIGS. 1 to 3 show the end portion 100*a* of the conductive member 100 and the vicinity in a cut-out state. That is to say, FIGS. 1 to 3 show a part of the conductive member 100 in a longitudinal direction of the conductive member 100, including the end portion 100*a*.

The plurality of conductors 102 are formed in a shape extending in an elongated manner, and are arranged at equal intervals on the conductive member 100. The plurality of conductors 102 are provided so as to extend parallel to one another on the conductive member 100. The direction in which the plurality of conductors 102 are arranged is the width direction of the conductive member 100. Each conductor 102 is configured as one elongated, flat foil-like metal wire, or a set of bundled thin metal wires, for example. This embodiment describes an exemplary mode in which each conductor 102 is configured as one flat, foil-like metal wire.

The covering portion 103 is made of an insulating material, and is provided so as to cover the plurality of conductors 102. That is to say, the plurality of conductors 102 are insulated and covered by the covering portion 103. This embodiment describes an exemplary mode in which a pair of insulating sheets or insulating films provided on the front face side and the back face side of the conductive member 100 are provided as the covering portion 103. In this example, the pair of insulating sheets or the pair of insulating films are integrated with each other, with the plurality of conductors 102, which are arranged parallel to one another, held therebetween. The covering portion 103 for covering the plurality of conductors 102 with an insulating material is thus configured.

The reinforcing plate 104 is made of a resin material, for example, and is provided in an end portion 100*a* of the conductive member 100. The reinforcing plate 104 is provided as an elongated flat-plate member for increasing the rigidity at the leading end of the end portion 100*a* of the conductive member 100 to reinforce the end portion 100*a*. The reinforcing plate 104 is provided in the end portion 100*a* of the conductive member 100 such that, when the end portion 100*a* of the conductive member 100 is connected to the first connector 11, this connecting process is performed smoothly.

The reinforcing plate 104 is fixed by being stuck to one of the front and back faces at the leading end of the end portion 100*a* of the conductive member 100. Note that FIG. 3 shows a face of the conductive member 100 on the side opposite to the side where the reinforcing plate 104 is fixed. The reinforcing plate 104 is attached to the end portion 100*a* of the conductive member 100 so as to extend along an edge part of the end portion 100*a* in a width direction, which is perpendicular to the longitudinal direction of the conductive member 100. Note that, in FIG. 3, the longitudinal direction of the conductive member 100 is indicated by a double headed arrow X1, and the width direction of the conductive member 100 is indicated by a double headed arrow X2.

In the conductive member 100, a conductor-exposing portion 105, in which ends of the plurality of conductors 102 are exposed, is provided in the end portion 100*a*. The conductor-exposing portion 105 is provided in the end portion 100*a* of the conductive member 100 as a portion for exposing the ends of the plurality of conductors 102 in one of the flatly-expanding front and back faces on the side opposite to the side where the reinforcing plate 104 is attached.

Note that FIG. 3 shows a state of the conductive member 100 when viewed from the side of the face in which the conductor-exposing portion 105, from which the plurality of conductors 102 are exposed, is formed. On the other hand, FIGS. 1 and 2 show a state of the conductive member 100 when viewed from the side of the face in which the ends of the plurality of conductors 102 are not exposed. Note that, in FIGS. 1 and 2, the reinforcing plate 104 is in a state of being arranged within the first connector 11, and accordingly is not illustrated. In the conductive member 100, of the face in which the conductor-exposing portion 105 is formed and the face to which the reinforcing plate 104 is attached, one face serves as a front face, and the other face serves as a back face. Note that the face in which the conductor-exposing portion 105 is formed may be defined as a front face, and the face in which the reinforcing plate 104 is attached may be defined as a back face. Conversely, the face in which the conductor-exposing portion 105 is formed may be defined as a back face, and the face in which the reinforcing plate 104 is attached may be defined as a front face.

In the conductive member 100, engaging portions 106 are provided in a part of respective ends in the width direction. A pair of engaging portions 106 are provided in the end portion 100*a* of the conductive member 100. The engaging portions 106 are provided in the end portion 100*a* of the conductive member 100 as substantially rectangular portions that protrude outward in the width direction at respective ends in the width direction. The engaging portions 106 are provided as portions to engage with later-described engaged portions 30 of the first connector 11 when the conductive member 100 has been connected to the first connector 11.

This embodiment will describe an exemplary mode in which the conductive member 100, which is configured as a flexible cable, is connected to the first connector 11. However, this need not be the case. The conductive member to be connected to the first connector 11 is not limited to the flexible cable in the above-described mode, and may be a conductive member having a plurality of conductors. For example, the conductive member may be a flexible cable having a layered structure or a conductor arrangement structure that is different from the above-described mode. The conductive member may be a flexible cable that is configured in a mode other than a flexible flat cable. The conductive member may be a flexible board, such as a flexible printed circuit board (FPC).

Overview of First Connector

Figure 4:
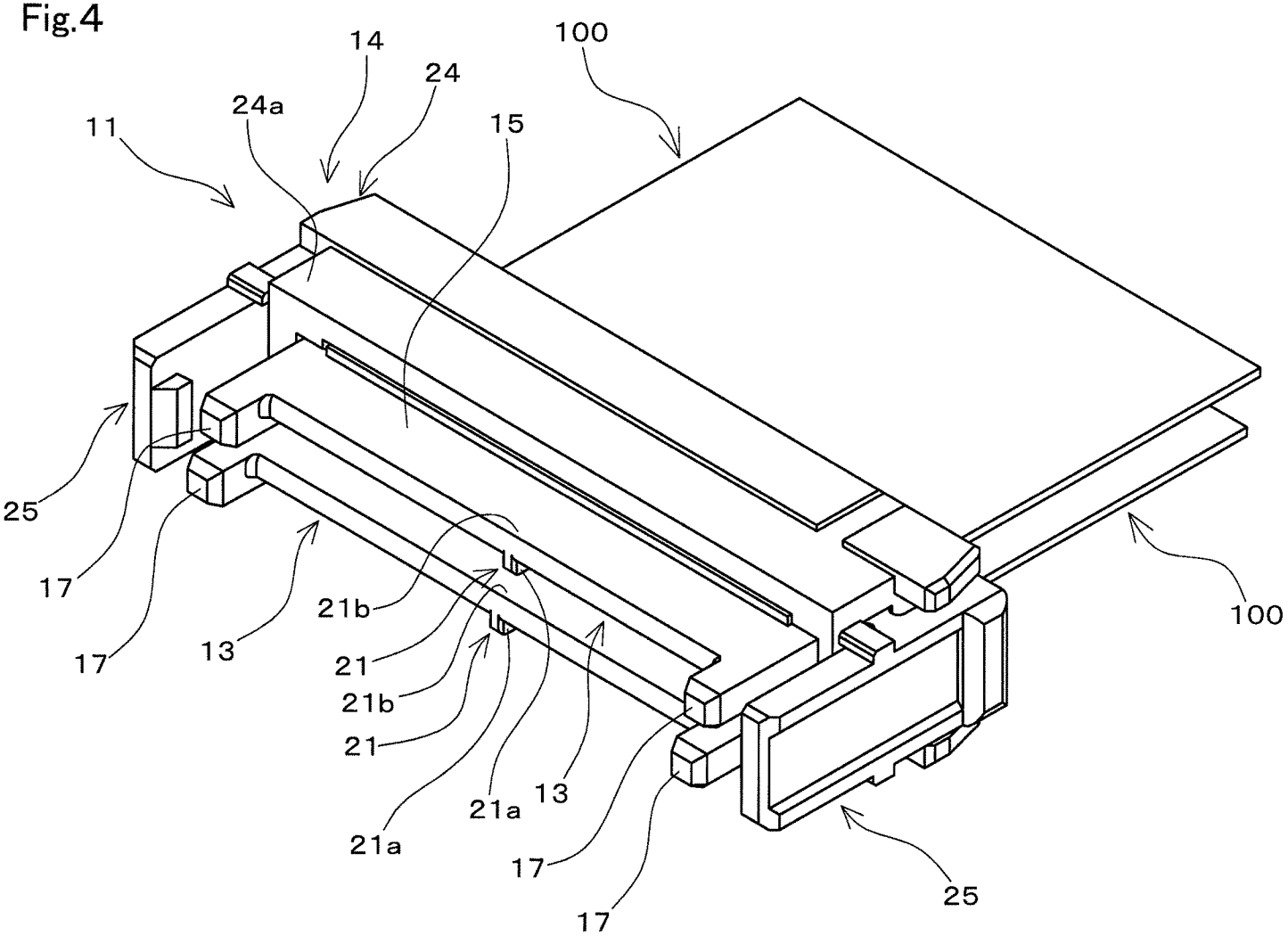
FIG. 4 is a perspective view showing a first connector (a connector according to an embodiment of the present invention) in the electrical connection device, together with a part of each conductive member.
Figure 5A:
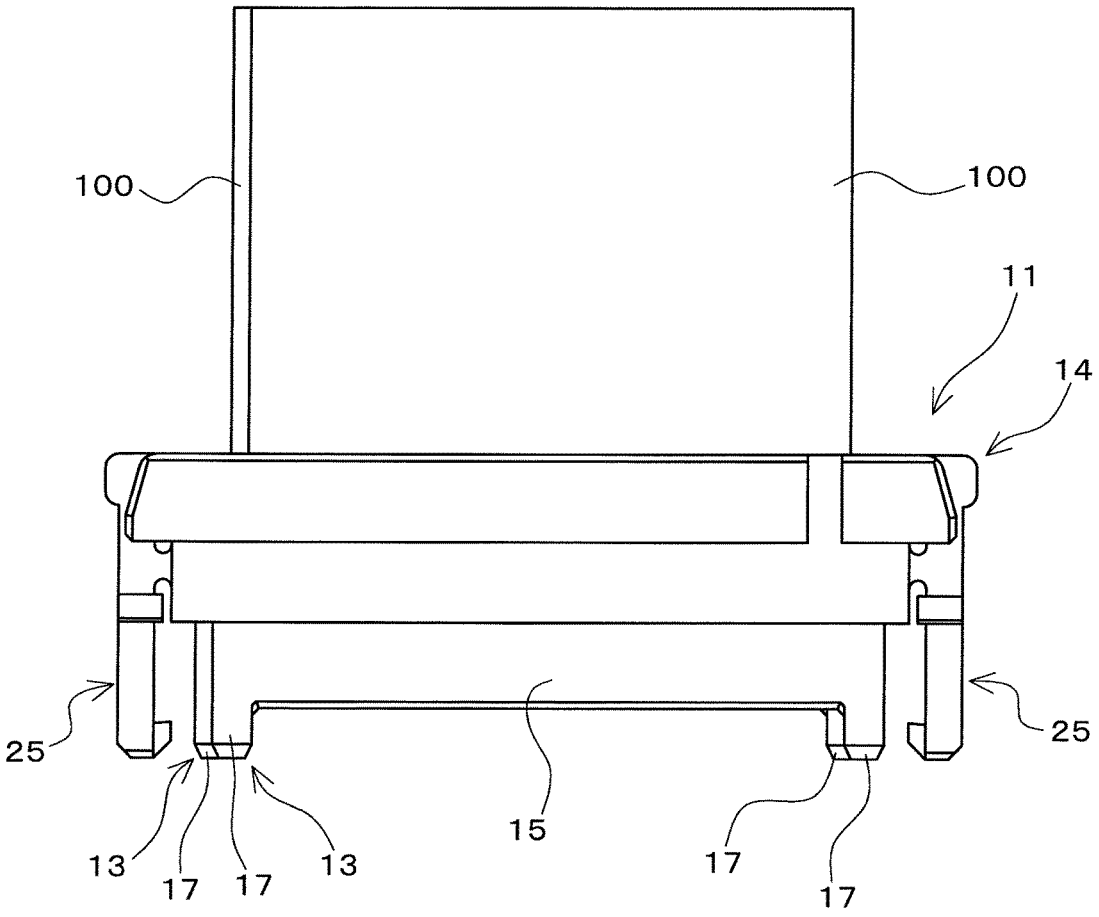
FIG. 5A is a plan view showing the first connector together with a part of the conductive member.
Figure 5B:
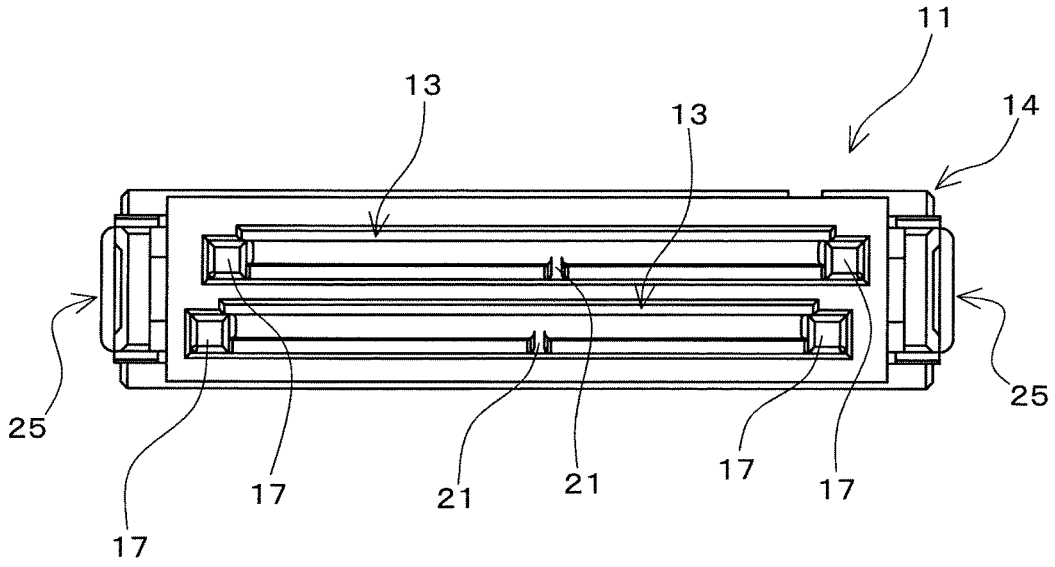
FIG. 5B is an elevational view showing the first connector together with a part of each conductive member.
Figure 6:
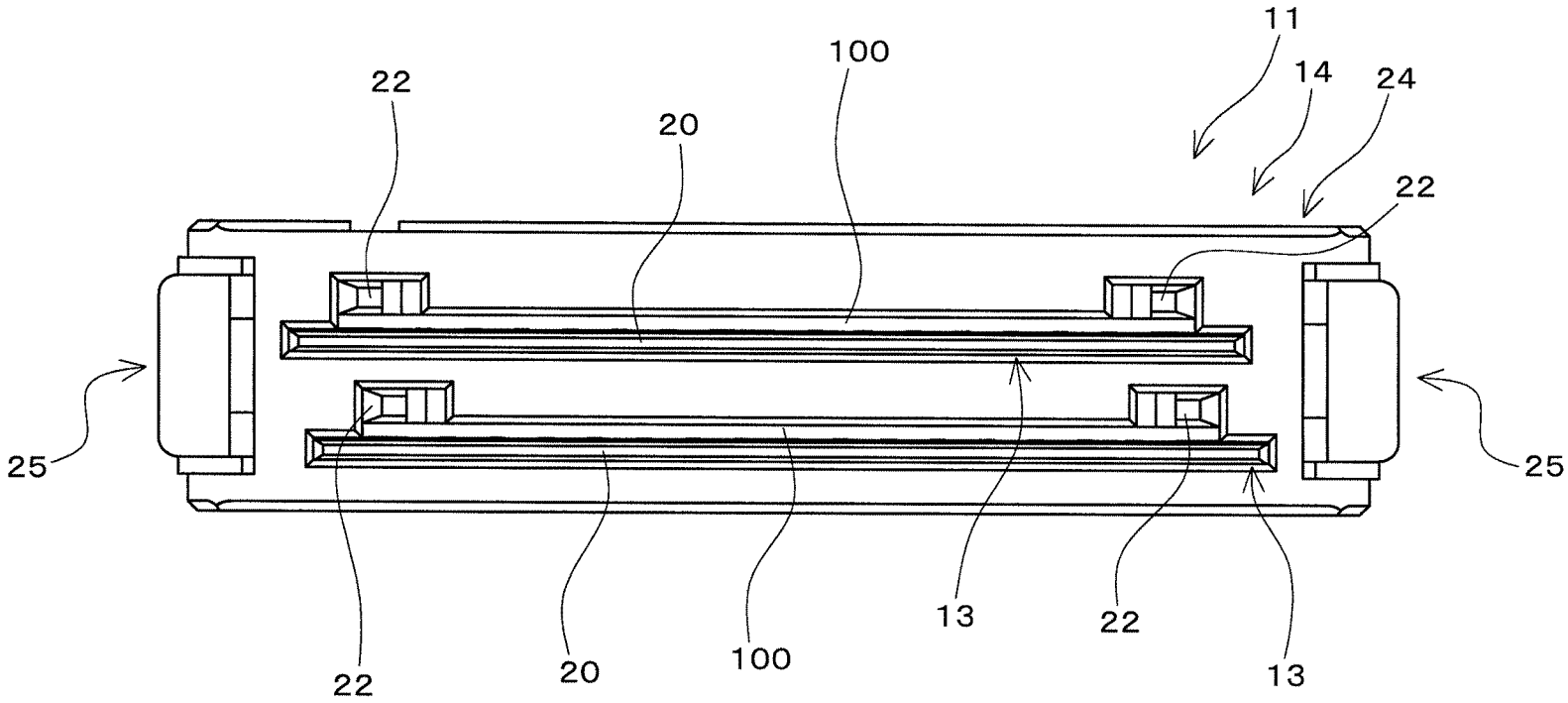
FIG. 6 is a rear view of the first connector and the conductive members.
Figure 7:
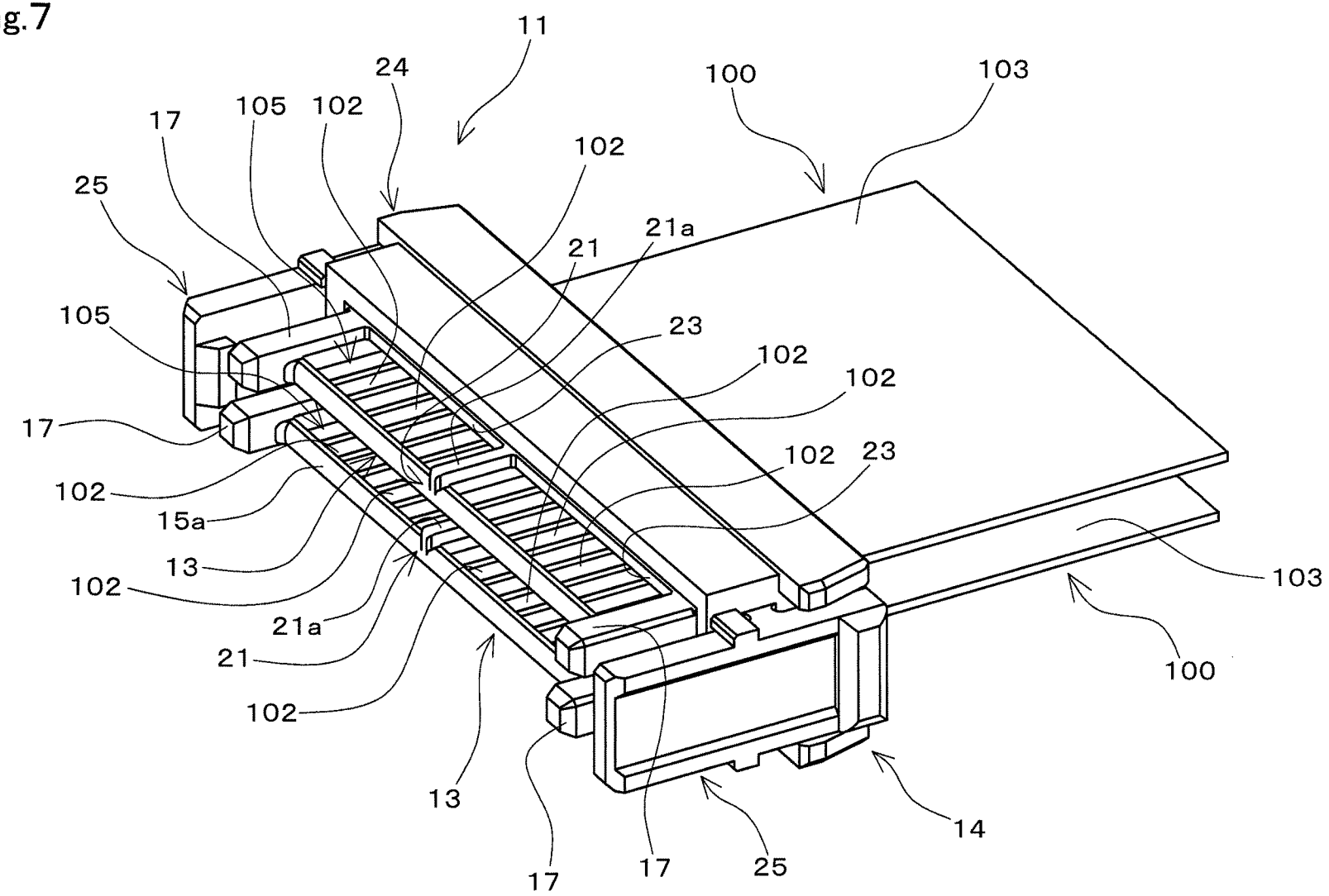
FIG. 7 is a perspective view of the first connector shown in FIG. 4 when viewed upside down.

FIG. 4 is a perspective view showing the first connector 11 in the electrical connection device 1, together with a part of each conductive member 100. FIG. 5A is a plan view showing the first connector 11 together with a part of the conductive member 100. FIG. 5B is an elevational view showing the first connector 11 together with a part of the conductive member 100. FIG. 6 is a rear view of the first connector 11 and the conductive members 100. FIG. 7 is a perspective view of the first connector 11 in FIG. 4 when viewed upside down. The first connector 11 in the electrical connection device 1 constitutes a connector according to an embodiment of the present invention. Note that the first connector 11 will be referred to also as a connector 11 in the following description.

The first connector 11 shown in FIGS. 1, 2, and 4 to 7 is configured to include the conductive member attaching portions 13 and the holder portion 14. This embodiment describes an exemplary mode of the first connector 11 that includes two conductive member attaching portion 13. The two conductive member attaching portions 13 are configured in the same manner. Note that the first connector 11 may be implemented in a mode in which only one conductive member attaching portion 13 is provided, or in a mode in which three or more conductive member attaching portions 13 are provided.

Conductive Member Attaching Portion

Figure 8:
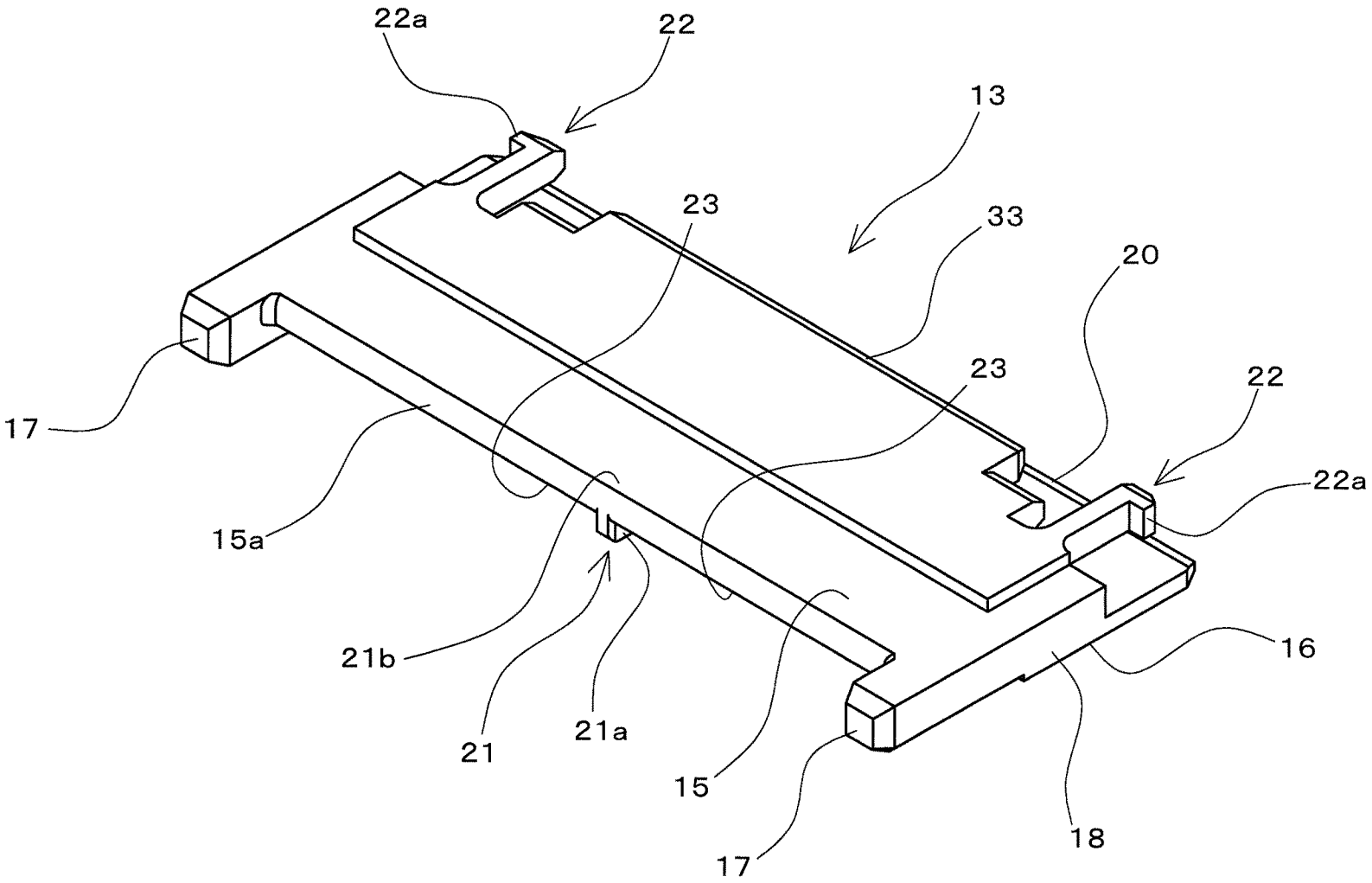
FIG. 8 is a perspective view showing a conductive member attaching portion of the first connector.
Figure 9A:
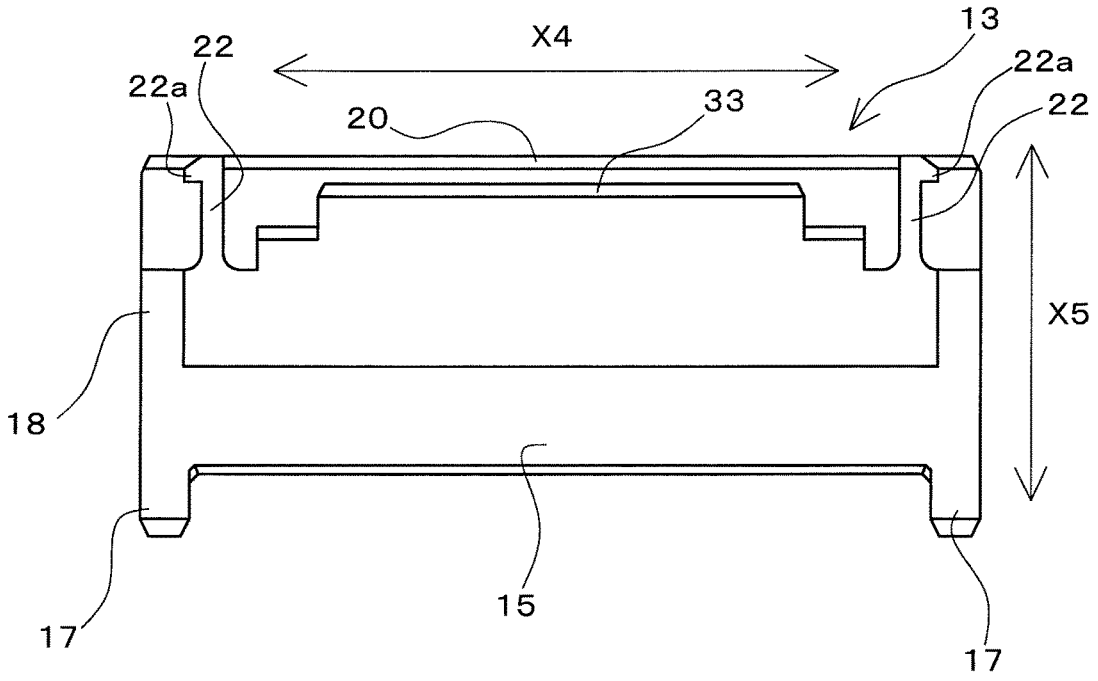
FIG. 9A is a plan view of the conductive member attaching portion.
Figure 9B:
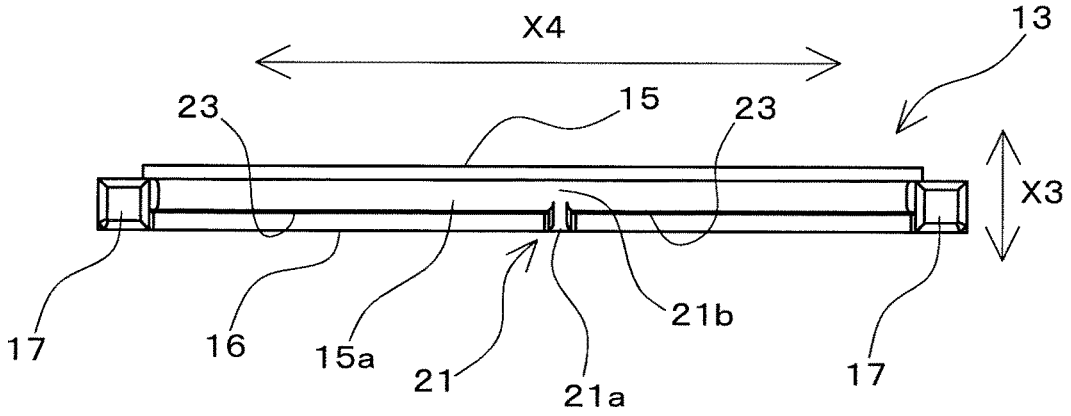
FIG. 9B is an elevational view of the conductive member attaching portion.
Figure 9C:
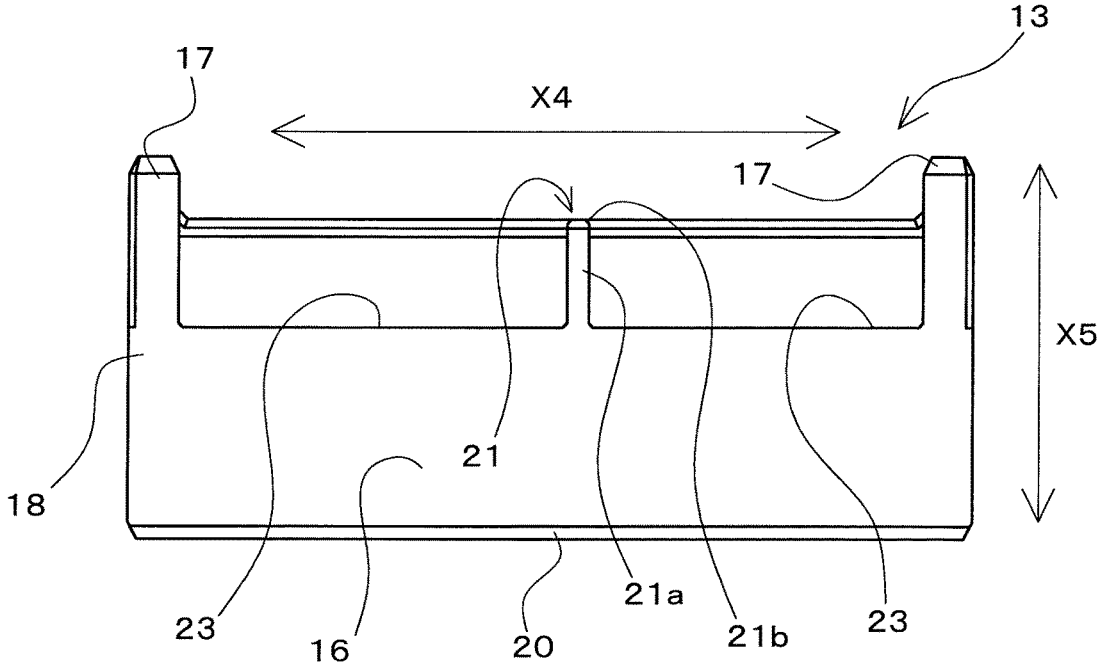
FIG. 9C is a bottom view of the conductive member attaching portion.
Figure 10A:
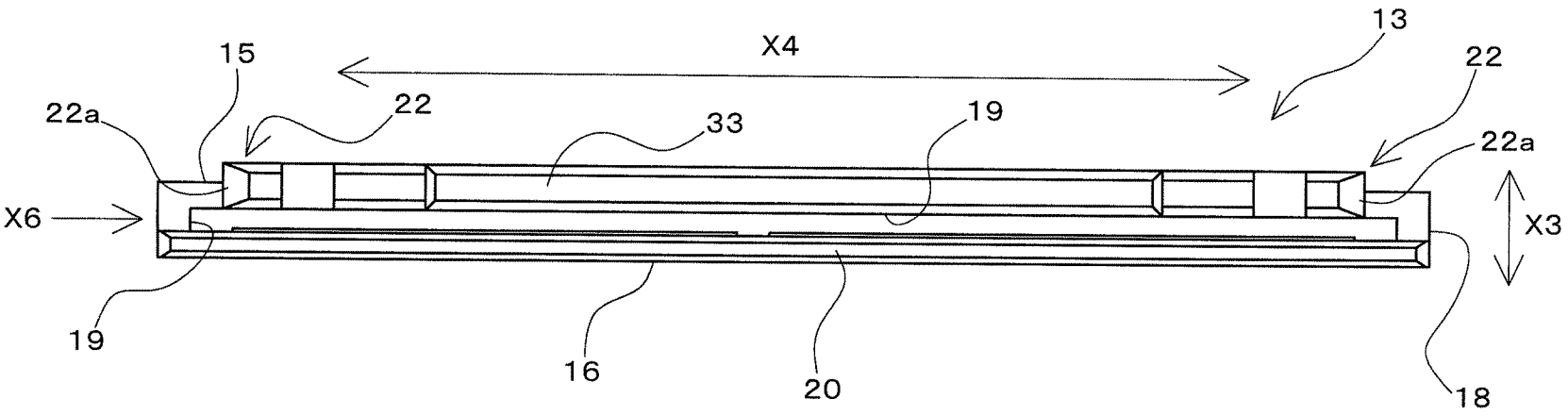
FIG. 10A is a rear view of the conductive member attaching portion.
Figure 10B:
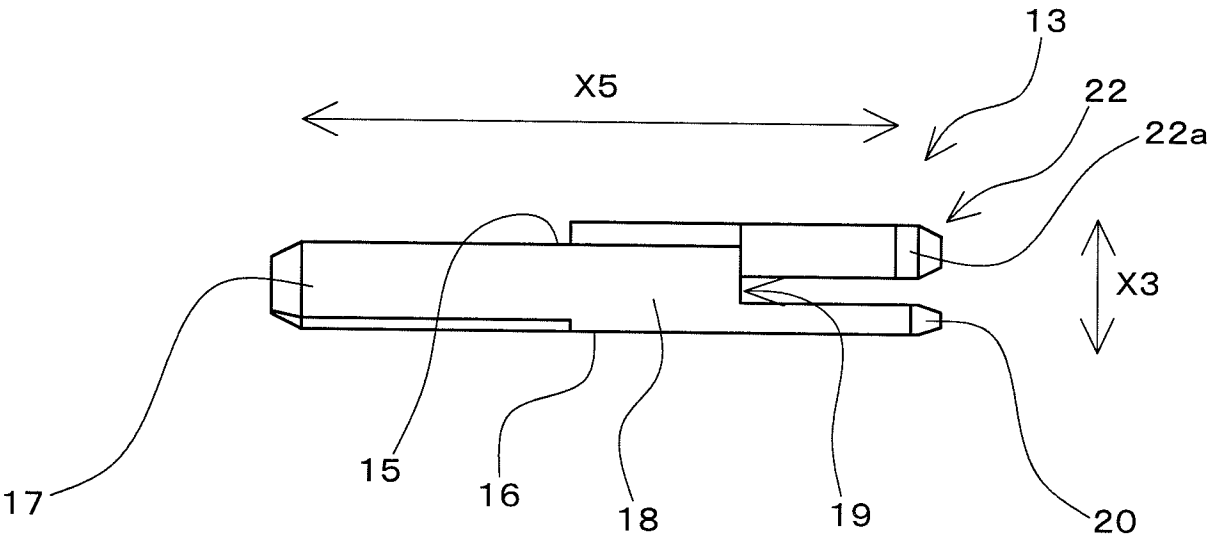
FIG. 10B is a side view of the conductive member attaching portion when viewed from a direction indicated by an arrow X6 in FIG. 10A.

FIG. 8 is a perspective view showing the conductive member attaching portion 13 in the first connector 11. FIG. 9A is a plan view of the conductive member attaching portion 13. FIG. 9B is an elevational view of the conductive member attaching portion 13. FIG. 9C is a bottom view of the conductive member attaching portion 13. FIG. 10A is a rear view of the conductive member attaching portion 13. FIG. 10B is a side view of the conductive member attaching portion 13 when viewed from a direction indicated by an arrow X6 in FIG. 10A. Note that FIGS. 8 to 10B show one conductive member attaching portion 13.

The conductive member attaching portion 13 shown in FIGS. 1 and 4 to 10B is made of an insulating resin material, and is configured such that the end portion 100*a* of the conductive member 100 is attached. The conductive member attaching portion 13 is provided as a member that is thin in the thickness direction and is elongated in the width direction. The conductive member attaching portion 13 is attached as a result of the end portion 100*a* of the conductive member 100 being inserted into the conductive member attaching portion 13 in a connecting direction, which is a direction perpendicular to the thickness direction and the width direction. The width direction of the conductive member attaching portions 13 corresponds to the width direction of the conductive member 100, and is set as the direction in which the plurality of conductors 102 in the conductive member 100 inserted in the conductive member attaching portion 13 are arranged. The connecting direction of the conductive member attaching portion 13 is parallel to the direction in which the end portion 100*a* of the conductive member 100 is inserted into the conductive member attaching portion 13, and is set as a direction parallel to the direction in which the conductive member attaching portion 13 is fitted into and connected to the later-described holder portion 14. Note that, in FIGS. 9, 10A, and 10B, the thickness direction of the conductive member attaching portion 13 is indicated by a double headed arrow X3. The width direction of the conductive member attaching portion 13 is indicated by a double headed arrow X4. The connecting direction of the conductive member attaching portion 13 is indicated by a double headed arrow X5.

The conductive member attaching portion 13 is provided with an upper face portion 15, a lower face portion 16, projecting portions 17, a casing portion 18, a closing portion 20, a bending restriction portion 21, engaging projecting portions 22, and the like.

The upper face portion 15 and the lower face portion 16 are configured to sandwich the end portion 100*a* of the conductive member 100 inserted and attached to the conductive member attaching portion 13 in the front-back face direction of the conductive member 100. The upper face portion 15 and the lower face portion 16 are each provided as a portion that extends to form a flat plate shape in the width direction in the conductive member attaching portion 13. When in a state where the first connector 11 that includes the conductive member attaching portion 13 is connected to the second connector 12 that has been connected to the substrate 101, in the conductive member attaching portion 13, the lower face portion 16 is arranged in a state of opposing the front face of the substrate 101, and the upper face portion 15 is arranged on the side opposite to the substrate 101 side.

The conductive member attaching portion 13 is provided with opening portions 23 on the leading end side of the lower face portion 16 side. Note that the leading end side of the conductive member attaching portion 13 is an end side of the conductive member attaching portion 13 that is to be connected to the later-described second connector 12. The opening portions 23 are provided on the leading end side of the lower face portion 16 side of the conductive member attaching portion 13, as areas that are open so as to expose, to the outside of the conductive member attaching portion 13, the conductor-exposing portion 105 of the end portion 100*a* of the conductive member 100 that has been inserted and attached to the conductive member attaching portion 13. This embodiment describes an exemplary mode in which two opening portions 23 are provided side-by-side in the width direction of the conductive member attaching portion 13, and are provided with a rib 21*a* of the later-described bending restriction portion 21 between two opening portions 23. By providing the opening portions 23, the conductive member attaching portion 13 is formed in a shape in which the area between each of the pair of later-described projecting portions 17 and the rib 21*a* of the bending restriction portion 21 is recessed to form a cutout on the lower face portion 16 side.

The projecting portions 17 are provided at respective ends of the conductive member attaching portion 13 in the width direction so as to project to the leading end side of the conductive member attaching portion 13. A pair of projecting portions 17 are provided as portions that project with a substantially rectangular cross-section at the respective ends of the conductive member attaching portion 13 in the width direction. The projecting portions 17 are configured such that, when the conductive member attaching portion 13 is fitted to a housing 34 of the later-described second connector 12, the projecting portions 17 are guided along and fitted into later-described guide grooves 38, which are provided in the housing 34.

Each projecting portion 17 is configured such that the projecting length of the projecting portion 17 relative to one of the upper face portion 15 and the lower face portion 16 is longer than the projecting length relative to the other one of the upper face portion 15 and the lower face portion 16. Since this embodiment describes an exemplary mode in which the opening portions 23 are provided on the leading end side of the lower face portion 16 side in the conductive member attaching portion 13, the conductive member attaching portion 13 in this exemplary mode is provided with the projecting portions 17 such that the projecting length of each projecting portion 17 relative to the lower face portion 16 is set to be longer than the projecting length relative to the upper face portion 15.

The casing portion 18 is provided as a casing-like portion of the conductive member attaching portion 13 for demarcating an insertion slot 19, into which the end portion 100*a* of the conductive member 100 is inserted. More specifically, the casing portion 18 is provided as a rectangular casing-like portion that is thin in the thickness direction of the conductive member attaching portion 13. An inner area of the casing portion 18 provided as a rectangular casing-like portion serves as the insertion slot 19. The insertion slot 19 is open to the outside on the side opposite to the leading end side of the conductive member attaching portion 13 such that the end portion 100*a* of the conductive member 100 can be inserted into the insertion slot 19. The end portion 100*a* of the conductive member 100 is attached to the conductive member attaching portion 13 by being inserted into the insertion slot 19 from the side opposite to the leading end side of the conductive member attaching portions 13.

The closing portion 20 is provided as an end portion of the lower face portion 16 on the side opposite to the opening portion 23 side. The closing portion 20 is provided as a portion to close a part of an insertion hole 26 in the later-described holder portion 14. As will be described later, the closing portion 20 is configured to close a part of the insertion hole 26 of the holder portion 14 with the engaging portions 106 engaged with the engaged portions 30 of the holder portion 14 when the conductive member attaching portion 13 has been fitted into the holder portion 14, the conductive member attaching portion 13 being in a state where the end portion 100*a* of the conductive member 100 inserted in the insertion hole 26 of the holder portion 14 has been attached thereto.

The bending restriction portion 21 is provided in a center part of the conductive member attaching portion 13 in the width direction. The bending restriction portion 21 is provided as a portion that is configured to sandwich, in the front-back face direction of the conductive member 100, the end portion 100*a* of the conductive member 100 attached to the conductive member attaching portion 13, thereby restricting bending deformation of the conductive member 100.

In the conductive member attaching portion 13 according to this embodiment, the bending restriction portion 21 is configured to include the rib 21*a* and a center holding portion 21*b*. The rib 21*a* is provided in a center part in the width direction on the lower face portion 16 side of the conductive member attaching portion 13, and is configured as a portion that extends from the lower face portion 16 toward the leading end side of the conductive member attaching portion 13. The two opening portions 23 are partitioned by the rib 21*a*. The center holding portion 21*b* is configured as a part of the upper face portion 15, and is configured as a center part in the width direction of the upper face portion 15. An end of the center holding portion 21*b* on the leading end side of the conductive member attaching portion 13 is integrated with the rib 21*a*.

Upon the end portion 100*a* of the conductive member 100 being inserted into the insertion slot 19 from the side opposite to the leading end side of the conductive member attaching portion 13 and attached to the conductive member attaching portion 13, the end portion 100*a* of the conductive member 100 enters a state of being sandwiched between the rib 21*a* and the center holding portion 21*b*. When in this state, an edge part at the leading end of the end portion 100*a* of the conductive member 100 abuts against a portion that integrally bridges the rib 21*a* and an end of the center holding portion 21*b* on the leading end side of the conductive member attaching portion 13, and enters a state of being positioned relative to the conductive member attaching portion 13.

Note that, at an end portion of the upper face portion 15 on the leading end side of the conductive member attaching portion 13, an abutting wall portion 15*a*, which extends in the width direction of the conductive member attaching portion 13, is provided. In a state where the end portion 100*a* of the conductive member 100 has been inserted into the insertion slot 19, attached to the conductive member attaching portion 13, and sandwiched between the rib 21*a* and the center holding portion 21*b*, the edge part at the leading end of the end portion 100*a* of the conductive member 100 abuts against the abutting wall portion 15*a* and enters a state of being positioned relative to the conductive member attaching portion 13. Note that, when the end portion 100*a* of the conductive member 100 is in a state of abutting against the abutting wall portion 15*a* and being positioned relative to the conductive member attaching portion 13, the conductor-exposing portion 105 is exposed to the outside from the opening portions 23.

The engaging projecting portions 22 are provided as portions to engage with the holder portion 14 when the conductive member attaching portion 13 has been fitted into and connected to the later-described holder portion 14. When the conductive member attaching portion 13 has been fitted into and connected to the holder portion 14, the engaging projecting portions 22 engage with the holder portion 14, causing the conductive member attaching portion 13 to be locked to the holder portion 14. Thus, the conductive member attaching portion 13 is prevented from coming off the holder portion 14 and falling out.

The engaging projecting portions 22 are provided so as to project in a cantilevered manner on respective sides of the conductive member attaching portion 13 in the width direction toward the side opposite to the leading end side of the conductive member attaching portion 13. A pair of engaging projecting portions 22 are provided at the respective ends of the conductive member attaching portion 13 in the width direction. A projection 22*a* is provided at an end of each engaging projecting portion 22, the end projecting in a cantilevered manner. When the conductive member attaching portion 13 has been fitted into and connected to the holder portion 14, the projection 22*a* of each engaging projecting portion 22 is engaged with the holder portion 14.

Holder Portion

Figure 11:
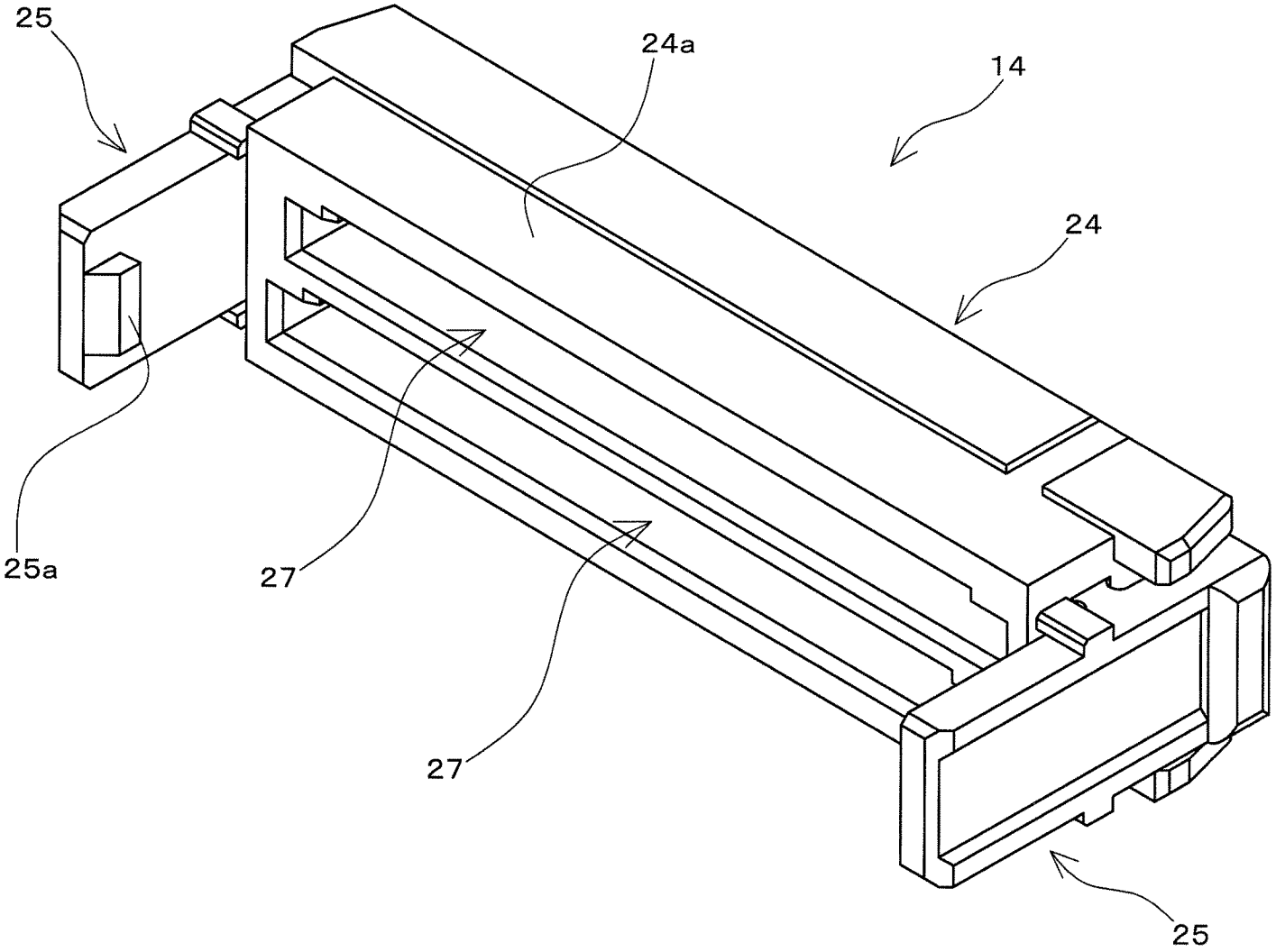
FIG. 11 is a perspective view showing a holder portion of the first connector.
Figure 12A:
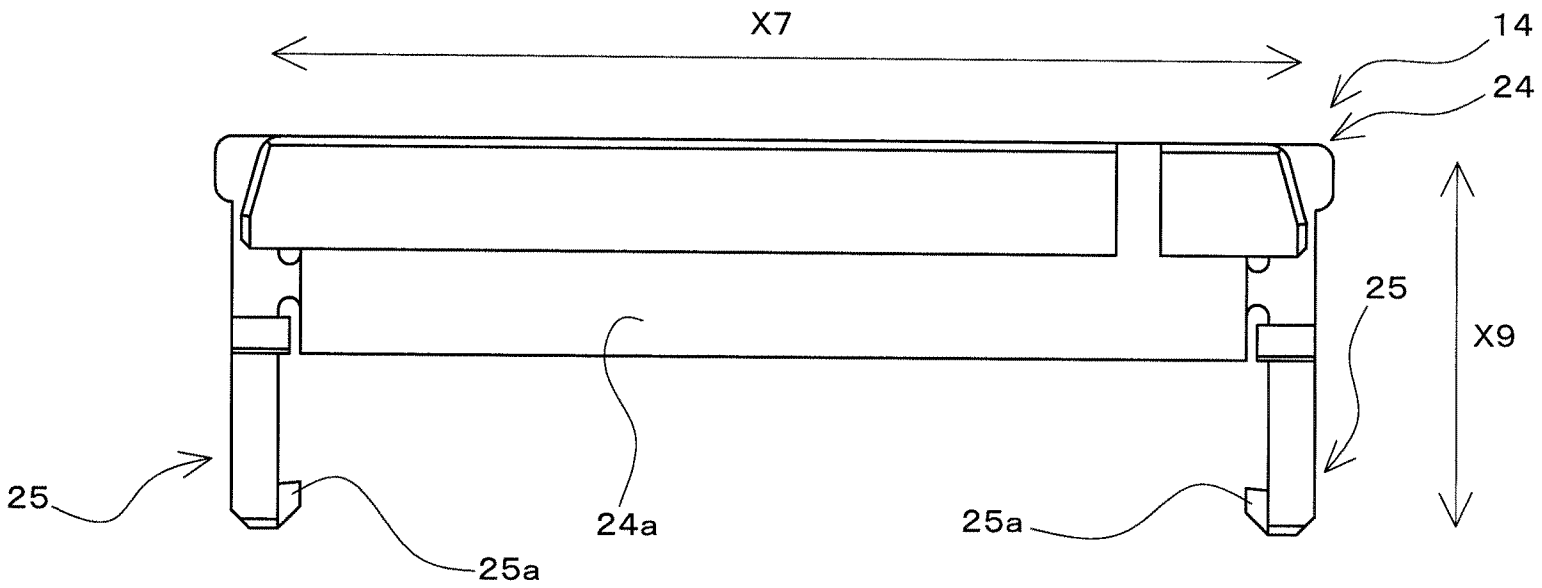
FIG. 12A is a plan view of the holder portion.
Figure 12B:
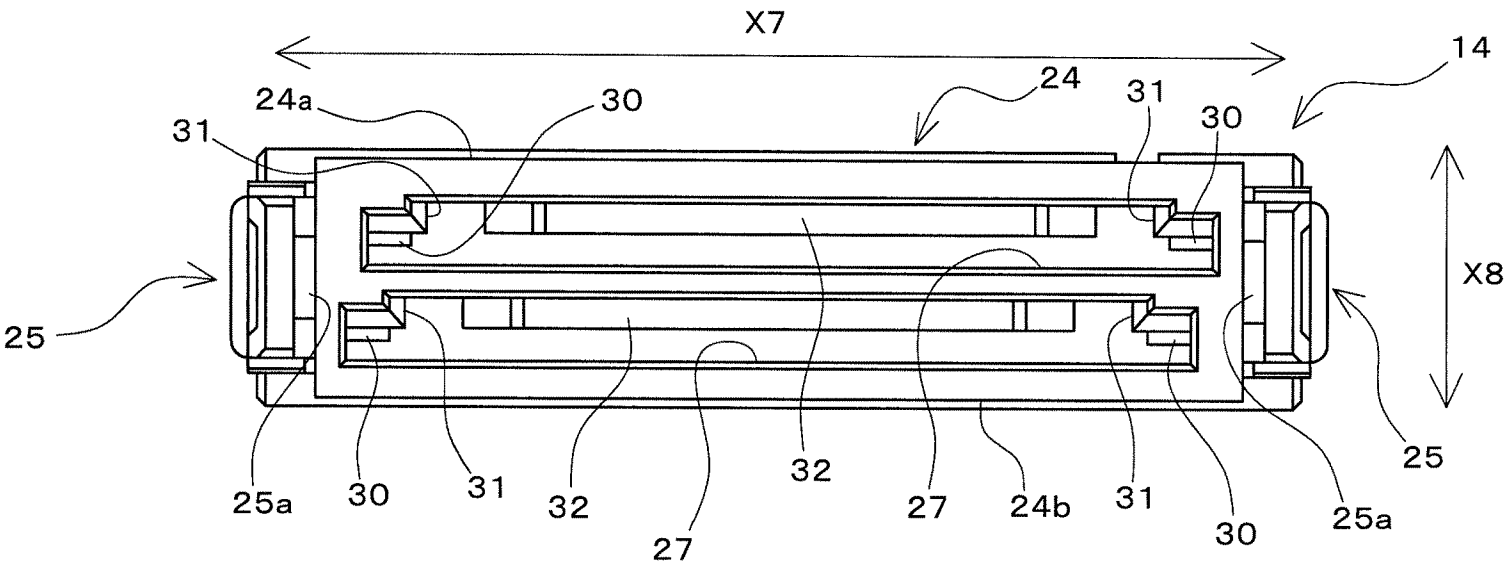
FIG. 12B is an elevational view of the holder portion.
Figure 13A:
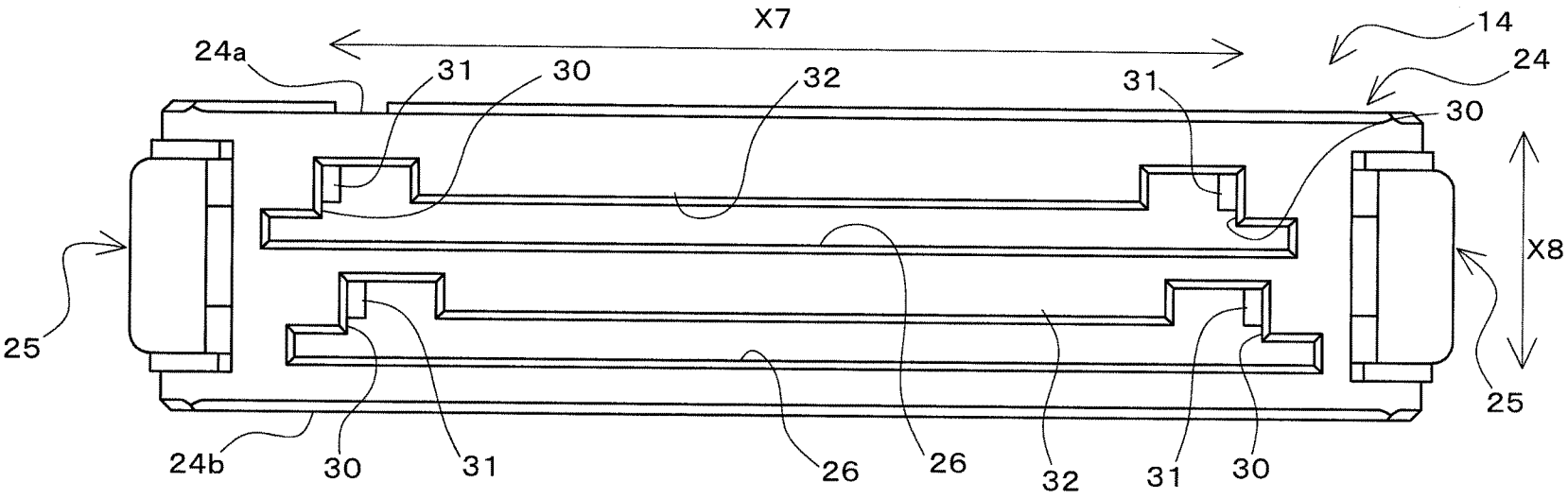
FIG. 13A shows a rear view of the holder portion.
Figure 13B:
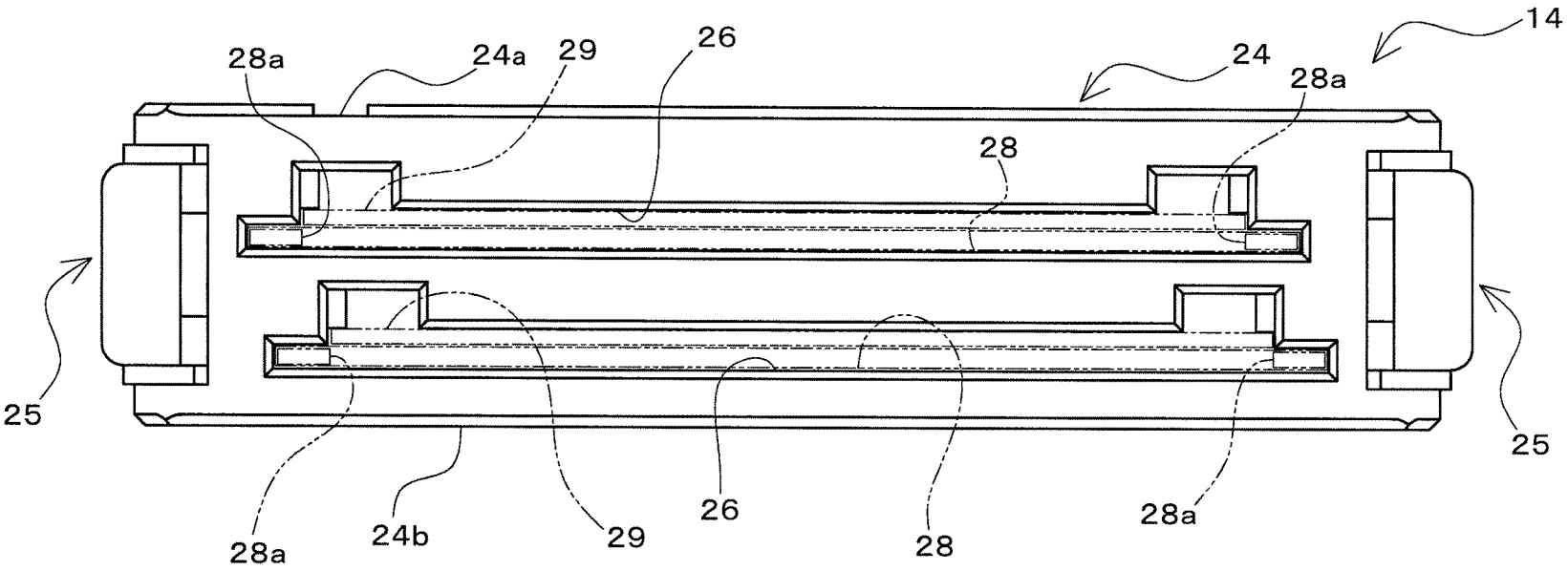
FIG. 13B shows a rear view of the holder portion and also schematically shows respective regions of insertion holes in the holder portion.

FIG. 11 is a perspective view of the holder portion 14 of the first connector 11. FIG. 12A is a plan view of the holder portion 14. FIG. 12B is an elevational view of the holder portion 14. FIG. 13A shows a rear view of the holder portion 14. FIG. 13B shows a rear view of the holder portion 14 and also schematically shows respective regions of the insertion holes 26 in the holder portion 14.

The holder portion 14 shown in FIGS. 1, 2, 4 to 7, and 11 to 13B is configured such that a conductive member 100 is inserted into the holder portion 14, and the conductive member attaching portion 13 is fitted into the holder portion 14 and thus connected to the holder portion 14. The holder portion 14 is configured to be engaged with and connected to the second connector 12. The holder portion 14 is made of an insulating resin material. The holder portion 14 is configured to include a body portion 24, lock arm portions 25, and the like.

The body portion 24 of the holder portion 14 is provided as a portion having a housing-like external shape, and is provided as a portion that is elongated in the width direction of the holder portion 14. The width direction of the holder portion 14 corresponds to the width direction of the conductive member 100 and the width direction of the conductive member attaching portion 13. The width direction of the holder portion 14 is set as a direction in which the plurality of conductors 102 in the conductive member 100 are arranged with the conductive member attaching portion 13, to which the conductive member 100 has been attached, fitted into and connected to the holder portion 14. Note that, in FIGS. 12A to 13A, the width direction of the holder portion 14 is indicated by a double headed arrow X7.

The body portion 24 is provided with insertion holes 26, into each of which a conductive member 100 is inserted. The body portion 24 is provided with a plurality of insertion holes 26. In this embodiment, two insertion holes 26 are provided. The body portion 24 is also provided with fitting holes 27, into which the conductive member attaching portion 13 is configured to be fitted, the conductive member attaching portion 13 being in a state where the end portion 100*a* of the conductive member 100 inserted in the insertion hole 26 has been attached to the conductive member attaching portion 13. The body portion 24 is provided with a plurality of fitting holes 27. In this embodiment, two fitting holes 27 are provided corresponding to the conductive member attaching portions 13 of the first connector 11.

Each insertion hole 26 is formed in the body portion 24 in a hole shape that extends in the width direction of the holder portion 14. The two insertion holes 26 are arranged in the body portion 24 side-by-side in the thickness direction of the holder portion 14. The thickness direction of the holder portion 14 corresponds to the thickness direction of the conductive member attaching portion 13. Note that, in FIGS. 12B and 13A, the thickness direction of the holder portion 14 is indicated by a double headed arrow X8.

Each fitting hole 27 is formed in the body portion 24 in a hole shape that extends in the width direction of the holder portion 14. The two fitting holes 27 are arranged in the body portion 24 side-by-side in the thickness direction of the holder portion 14.

The insertion holes 26 are in communication with the corresponding fitting holes 27. Each insertion hole 26 is open at an end, in the connecting direction of the holder portion 14, of the body portion 24 on the side to be connected to the later-described second connector 12. On the other hand, each fitting hole 27 is open at an end, in the connecting direction of the holder portion 14, of the body portion 24 on the side opposite to the side to be connected to the second connector 12, the end being on the side at which the conductive member attaching portion 13 is fitted. Each insertion hole 26 and the corresponding fitting hole 27 that are in communication with each other are configured to pass through the holder portion 14 in the connecting direction in the body portion 24.

Note that the connecting direction of the holder portion 14 is a direction perpendicular to the width direction and the thickness direction of the connecting portion 14. The connecting direction of the holder portion 14 is a direction parallel to the direction in which the conductive member attaching portion 13 is fitted to the holder portion 14, and is set as a direction parallel to the direction in which the holder portion 14 is connected to the later-described second connector 12. Note that, in FIG. 12A, the connecting direction of the holder portion 14 is indicated by a double headed arrow X9.

The holder portion 14 is connected to the second connector 12, which has been connected to the substrate 101, with the conductive member 100 inserted in the insertion hole 26, and with the conductive member attaching portion 13 fitted to the corresponding fitting hole 27. The holder portion 14, when in a state of having been connected to the second connector 12, is arranged with an upper face 24*a* of the body portion 24 arranged on the side opposite to the substrate 101 side, and with a lower face 24*b* of the body portion 24 opposing the front face of the substrate 101. Note that the upper face 24*a* and the lower face 24*b* of the body portion 24 are configured as respective end faces in the thickness direction of the holder portion 14.

A more detailed description will now be given of the configuration of the insertion holes 26 provided in the body portion 24 of the holder portion 14. Each insertion hole 26 in the holder portion 14 is configured to include a conductive member passage region 28 and a conductive member arrangement region 29 (see FIG. 13B). The conductive member passage region 28 and the conductive member arrangement region 29 in each insertion hole 26 are configured as continuous regions, and are open at an end, in the connecting direction of the holder portion 14, of the body portion 24 on the side at which the later-described second connector 12 is connected. The conductive member passage region 28 and the conductive member arrangement region 29, which are continuous with each other, are both configured as regions that extend in the width direction of the holder portion 14.

The conductive member passage region 28 is configured as a region through which the conductive member 100 passes when the conductive member 100 is inserted into the insertion hole 26. When the conductive member 100 is inserted into the insertion hole 26, the conductive member 100 passes through the conductive member passage region 28 with its width direction parallel to the width direction of the insertion hole 26. Note that the width direction of the insertion hole 26 is the same as the width direction of the conductive member passage region 28 and the width direction of the conductive member arrangement region 29, and corresponds to the width direction of the holder portion 14 and the width direction of the fitting hole 27.

The conductive member passage region 28 includes engaging portion passage regions 28*a* at respective end sides in the width direction of the insertion hole 26. A pair of engaging portion passage regions 28*a* are included in the conductive member passage region 28. The engaging portion passage regions 28*a* are regions on respective end sides of each insertion hole 26 in the width direction, and are configured as regions through which the engaging portions 106 of the conductive member 100 pass when the conductive member 100 is inserted into the insertion hole 26 and passes through the insertion hole 26.

The conductive member arrangement region 29 is provided as a region that is continuous, on the upper face 24*a* side of the body portion 24, with the conductive member passage region 28. The conductive member arrangement region 29 is configured as a region in which the conductive member 100 is arranged in a state of being displaced so as to be shifted from the conductive member passage region 28 after the conductive member 100 has been inserted in the insertion hole 26. The conductive member arrangement region 29 is arranged on the upper face 24*a* side relative to the conductive member passage region 28. Accordingly, the conductive member 100 is arranged in the conductive member arrangement region 29 in a state of being displaced, after being inserted in the insertion hole 26, so as to be shifted from the conductive member passage region 28 toward the upper face 24*a* side. Note that, when the conductive member 100 is arranged in the conductive member arrangement region 29, the conductive member 100 is arranged in the conductive member arrangement region 29 with its width direction parallel to the width direction of the insertion hole 26.

The body portion 24 of the holder portion 14 is provided with engaged portions 30, which are configured such that the engaging portions 106 of the conductive member 100 engage with engaged portions 30. A pair of engaged portions 30 are provided in the body portion 24, corresponding to each insertion hole 26. The pair of engaged portions 30 provided corresponding to each insertion hole 26 are provided within the body portion 24 at positions corresponding to respective end sides in the width direction of the insertion hole 26.

The engaged portions 30 are provided as portions that protrude step-wise within the body portion 24 so as to engage with the engaging portions 106, which are provided as substantially rectangular portions that protrude to the outside at respective ends of the conductive member 100 in the width direction. In the body portion 24, the pair of engaged portions 30 provided at positions corresponding to each insertion hole 26 are provided at positions adjacent, on the outer side in the width direction, to the respective ends of the conductive member arrangement region 29 in the width direction, the positions being adjacent, on the upper face 24*a* side, to the engaging portion passage region 28*a*. Thus, the pair of engaged portions 30 are configured to engage with the pair of engaging portions 106 of the conductive member 100 in a state where the conductive member 100, after being inserted into the insertion hole 26, has been displaced so as to be shifted from the conductive member passage region 28 toward the upper face 24*a* side, and then arranged in the conductive member arrangement region 29.

The body portion 24 is also provided with engaging protruding portions 31. The engaging protruding portions 31 are provided as portions to engage with the engaging projecting portions 22 of the conductive member attaching portion 13 when the conductive member attaching portion 13 has been fitted to the fitting hole 27 and connected to the holder portion 14. A pair of engaging protruding portions 31 are provided in the body portion 24, corresponding to each fitting hole 27. The pair of engaging protruding portions 31 provided corresponding to each fitting hole 27 are provided within the body portion 24 at positions corresponding to respective end sides of the fitting holes 27 in the width direction.

The engaging protruding portions 31 are provided as portions that protrude within the body portion 24 so as to engage with the projections 22*a* of the engaging projecting portions 22 provided on respective sides of the conductive member attaching portion 13 in the width direction. Upon the conductive member attaching portion 13 being inserted into the holder portion 14 from the fitting hole 27, initially, the engaging projecting portions 22, which are provided in a cantilevered manner, abut against the engaging protruding portions 31 and temporarily bend within the body portion 24 of the holder portion 14. Then, after the conductive member attaching portion 13 is further inserted up to the distal side of the fitting hole 27 and fitted into the fitting hole 27, the bent engaging projecting portions 22 are elastically restored, and the projections 22*a* at the end of the engaging projecting portions 22 provided in a cantilevered manner engage with the engaging protruding portions 31. Thus, the engaging projecting portions 22 of the conductive member attaching portion 13 engage with the holder portion 14 at the engaging protruding portion 31, and the conductive member attaching portion 13 is locked and held with respect to the holder portion 14. As a result, the conductive member attaching portion 13 is prevented from coming off the holder portion 14 and falling out. Thus, the holder portion 14 is configured to hold the conductive member attaching portion 13.

The body portion 24 of the holder portion 14 is provided with a positioning wall portion 32 for positioning the conductive member attaching portion 13 fitted and connected to the holder portion 14 at a fitting completion position, relative to the holder portion 14. The positioning wall portion 32 is provided in the body portion 24 at a position corresponding to each insertion hole 26 that is in communication with the corresponding fitting hole 27. More specifically, the positioning wall portion 32 is provided in the body portion 24 as a wall portion that extends in the width direction of the holder portion 14 at a position adjacent, on the upper face 24*a* side, to the opening of each insertion hole 26.

Note that the conductive member attaching portion 13 is provided with an abutting portion 33 that abuts against the positioning wall portion 32 of the body portion 24 of the holder portion 14 when the conductive member attaching portion 13 has been fitted and connected to the holder portion 14 (see FIGS. 8 to 10B). The abutting portion 33 is provided in the conductive member attaching portion 13 as a part of an end of the conductive member attaching portion 13 on the side opposite to the leading end side, and is provided as a portion that extends in the width direction of the conductive member attaching portion 13. The abutting portion 33 is provided between the pair of engaging projecting portions 22 in the conductive member attaching portion 13. The abutting portion 33 is provided on the upper face portion 15 side in the thickness direction of the conductive member attaching portion 13, relative to the closing portion 20.

Upon the conductive member attaching portion 13 being fitted and connected to the holder portion 14 from the fitting hole 27, the engaging projecting portions 22 of the conductive member attaching portion 13 engage with the engaging protruding portions 31 of the holder portion 14. When in a state where the engaging projecting portions 22 have been engaged with the engaging protruding portions 31, the abutting portion 33 of the conductive member attaching portion 13 abuts against the positioning wall portion 32 of the holder portion 14, within the holder portion 14. Thus, the fitting completion position of the conductive member attaching portion 13 fitted and connected to the holder portion 14 is positioned with respect to the holder portion 14.

The lock arm portions 25 of the holder portion 14 are provided as portions to engage with the later-described second connector 12 and lock the first connector 11 to the second connector 12 when the first connector 11 has been connected to the second connector 12. Note that the first connector 11 is connected to the second connector 12 with the conductive member attaching portion 13, to which the conductive member 100 inserted in the holder portion 14 has been attached, fitted, and connected to the holder portion 14 (see FIGS. 1 and 2).

A pair of lock arm portions 25 are provided. The lock arm portions 25 are provided at respective ends of the holder portion 14 in the width direction. The pair of lock arm portions 25 are provided integrally with the body portion 24. Each of the pair of lock arm portions 25 is provided so as to project in a cantilevered manner in the holder portion 14. Each of the pair of lock arm portions 25 is provided so as to project in a direction parallel to the connecting direction of the holder portion 14 from an end of the body portion 24 on the side at which the conductive member attaching portion 13 is fitted.

An engaging pawl portion 25*a* is provided at an end of each engaging lock arm portion 25, the end projecting in a cantilevered manner. The engaging pawl portion 25*a* is provided in each lock arm portion 25 as a protrusion that protrudes toward the inside of the holder portion 14 in the width direction. When the first connector 11 has been connected to the second connector 12, the engaging pawl portion 25*a* of each lock arm portion 25 is engaged with the second connector 12. As a result of the holder portion 14 being engaged with the second connector 12, the holder portion 14 to which the conductive member attaching portion 13 to which the conductive member 100 has been attached has been fitted, the first connector 11 is connected to and locked by the second connector 12. Thus, the first connector 11 and the second connector 12 that have been connected to each other are prevented from being disconnected.

Connection Between First Connector and Conductive Member

Figure 14A:
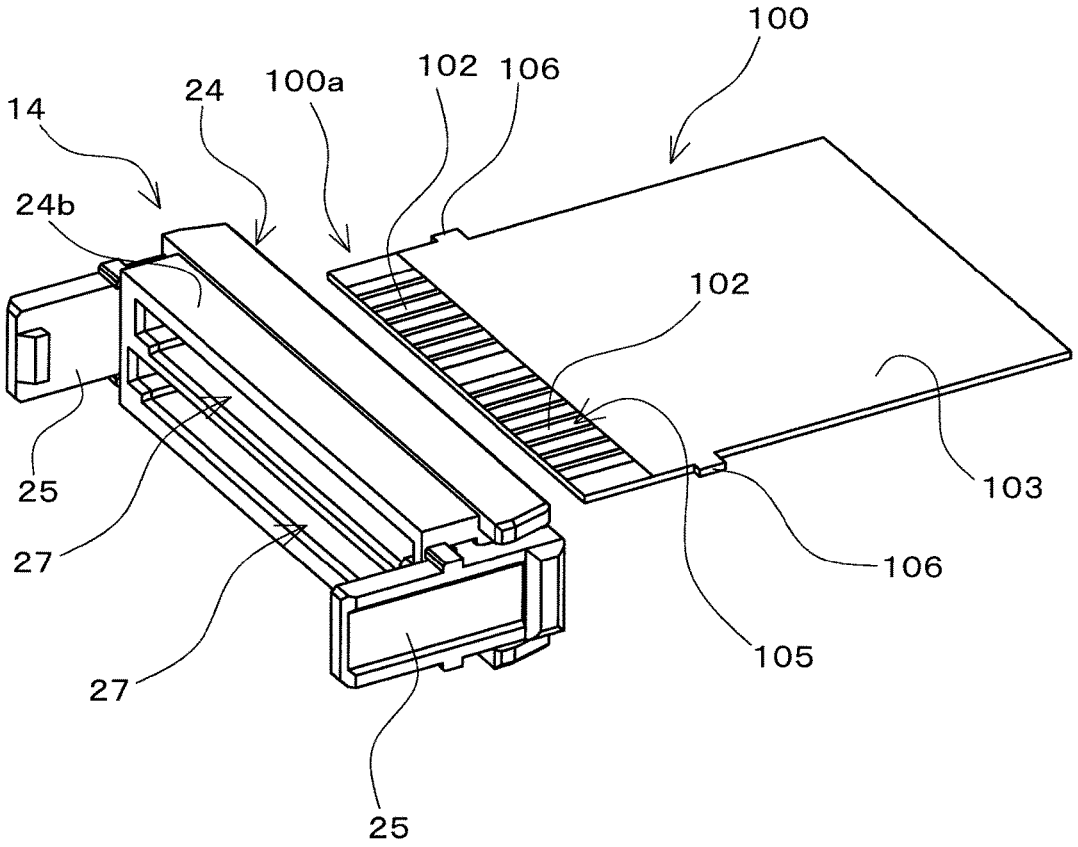
FIG. 14A is a perspective view for illustrating a mode in which a conductive member is connected to the first connector, showing a state before the conductive member is inserted into the holder portion.
Figure 14B:
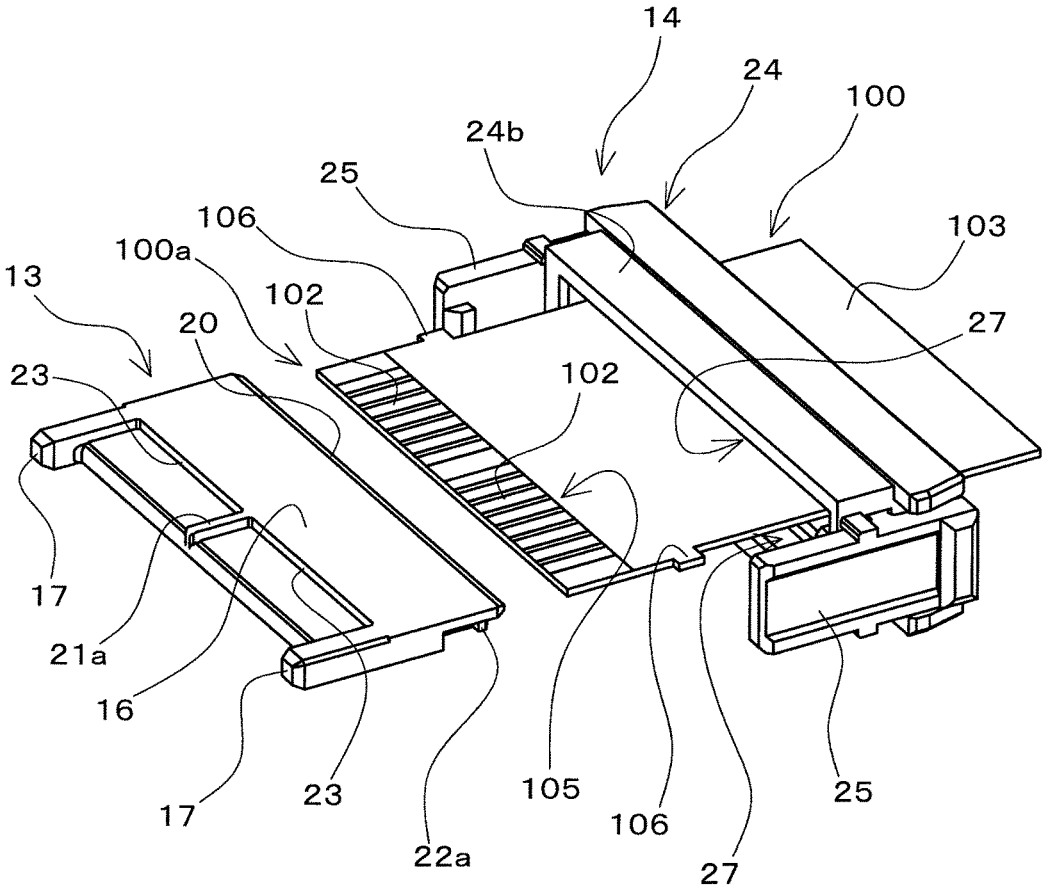
FIG. 14B is a perspective view for illustrating a mode in which a conductive member is connected to the first connector, showing a state before the conductive member inserted in the holder portion is attached to the conductive member attaching portion.
Figure 15A:
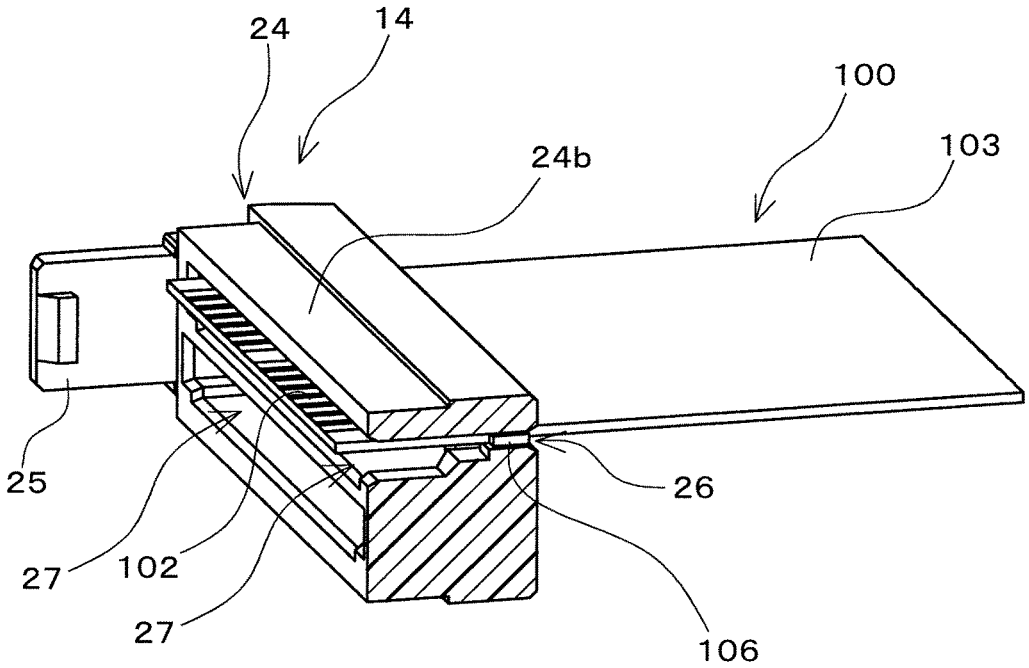
FIG. 15A is a perspective view with a partial cross-sectional view for illustrating a mode in which a conductive member is connected to the first connector, showing a state in the middle of the conductive member being inserted into the holder portion.
Figure 15B:
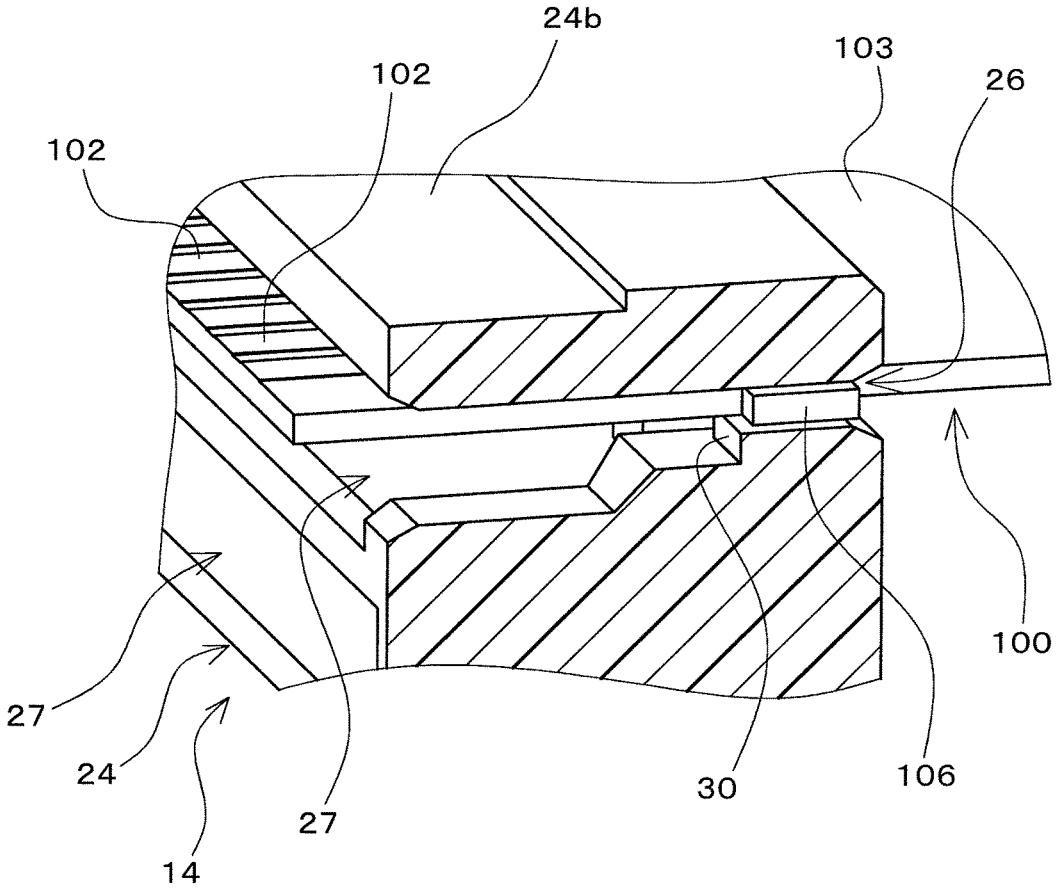
FIG. 15B is an enlarged view of a part of FIG. 15A, for illustrating a mode in which a conductive member is connected to the first connector.

Next, a configuration regarding the connection between the first connector 11 and the conductive member 100 will be described in more detail. FIG. 14A is a perspective view for illustrating a mode in which the conductive member 100 is connected to the first connector 11, showing a state before the conductive member 100 is inserted into the holder portion 14. FIG. 14B is a perspective view for illustrating a mode in which the conductive member 100 is connected to the first connector 11, showing a state before the conductive member 100 inserted in the holder portion 14 is attached to the conductive member attaching portion 13. FIG. 15A is a perspective view with a partial cross-sectional view for illustrating a mode in which the conductive member 100 is connected to the first connector 11, showing a state in the middle of the conductive member 100 being inserted into the holder portion 14. FIG. 15B is an enlarged view of a part of FIG. 15A, for illustrating a mode in which the conductive member 100 is connected to the first connector 11. Note that FIGS. 14A to 15B are perspective views in which the lower face 24*b* side of the body portion 24 of the holder portion 14 is shown on the upper side, and show a part of the conductive member 100. FIGS. 14A to 15B show an exemplary mode in which the first connector 11 and one conductive member 100 are connected.

As shown in FIGS. 14A to 15B, when the first connector 11 and the conductive member 100 are connected, initially, the end portion 100*a* of the conductive member 100 is inserted into the holder portion 14. At this time, as shown in FIG. 14A, the insertion of the conductive member 100 into the insertion hole 26 is started with the end portion 100*a* of the conductive member 100 opposing the insertion hole 26 in the holder portion 14.

Upon the insertion of the conductive member 100 into the insertion hole 26 being started, the end portion 100*a* of the conductive member 100 is inserted into the insertion hole 26 and the fitting hole 27, and passes through the insertion hole 26 and the fitting hole 27, as shown in FIGS. 15A, 15B, and 14B. At this time, the conductive member 100 passes through the conductive member passage region 28 in the insertion hole 26. Then, the engaging portions 106 of the conductive member 100 pass through the respective engaging portion passage regions 28*a* in the insertion hole 26.

After passing through the insertion hole 26 and the fitting hole 27, the end portion 100*a* of the conductive member 100 is then attached to the conductive member attaching portion 13. At this time, the attachment of the conductive member 100 to the conductive member attaching portion 13 is started with the end portion 100*a* of the conductive member 100 opposing the insertion slot 19 in the conductive member attaching portion 13 (see FIG. 14B).

Note that, although FIGS. 14A to 15B show an exemplary mode in which the conductive member 100 is inserted into the insertion hole 26 from the end portion 100*a* side, this need not be the case. For example, in the case where the length of the conductive member 100 is relatively short, a mode may be implemented in which the conductive member 100 is inserted into the fitting hole 27 from the side opposite to the end portion 100*a* side, rather than from the end portion 100*a* side, and is further inserted into the insertion hole 26.

Figure 16A:
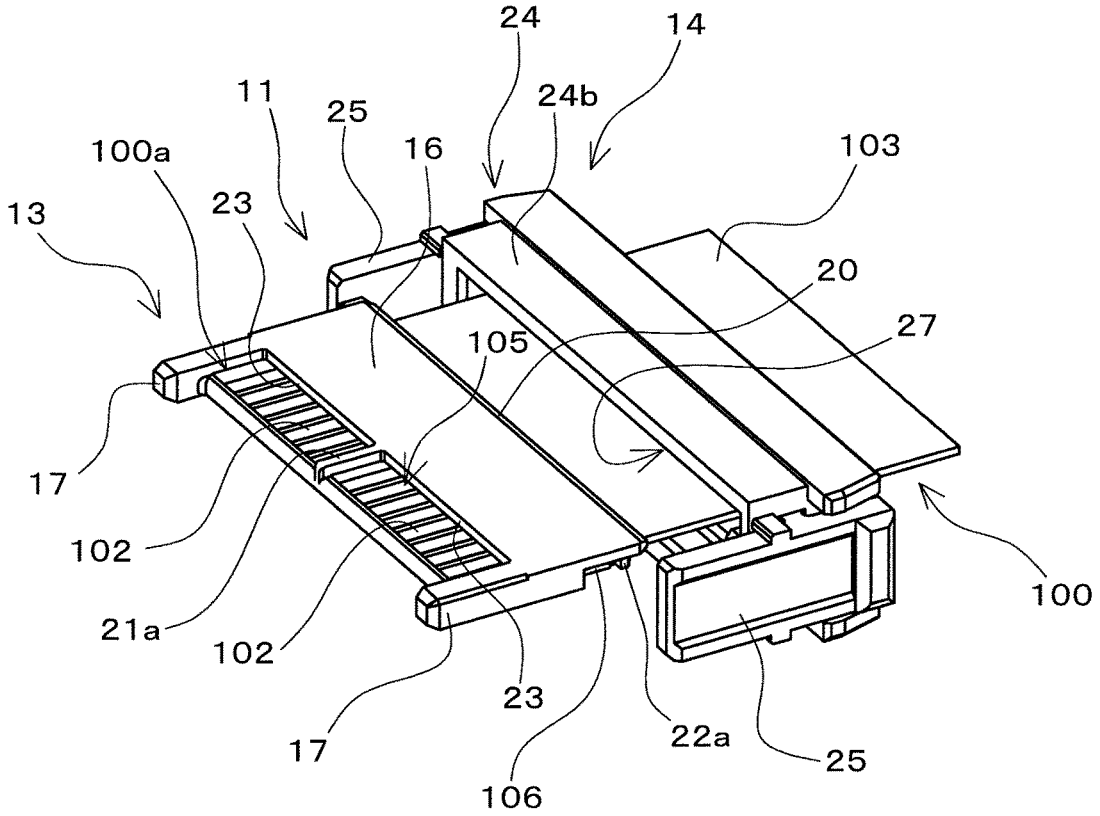
FIG. 16A is a perspective view for illustrating a mode in which a conductive member is connected to the first connector, showing a state where the conductive member has been inserted in the holder portion and attached to the conductive member attaching portion.
Figure 16B:
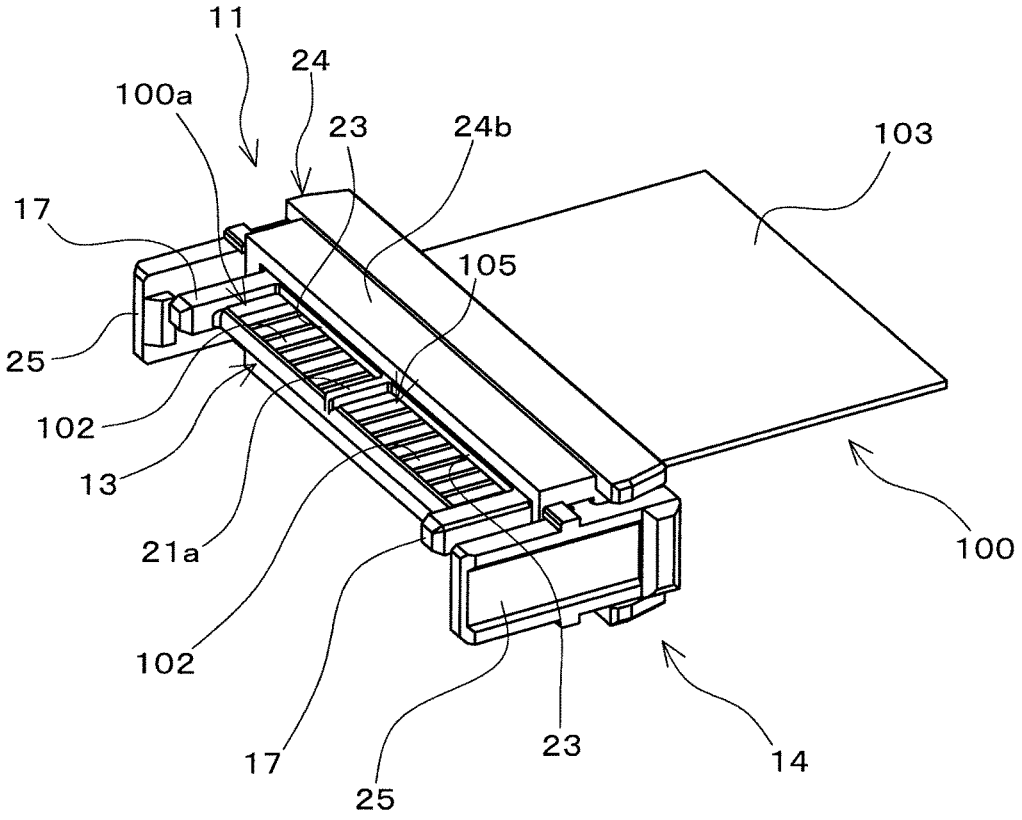
FIG. 16B is a perspective view for illustrating a mode in which a conductive member is connected to the first connector, showing a state where the conductive member attaching portion, to which the conductive member inserted in the holder portion has been attached, has been connected to the holder portion.

FIG. 16A is a perspective view for illustrating a mode in which the conductive member 100 is connected to the first connector 11, showing a state where the conductive member 100 has been inserted into the holder portion 14 and attached to the conductive member attaching portion 13. FIG. 16B is a perspective view for illustrating a mode in which the conductive member 100 is connected to the first connector 11, showing a state where the conductive member attaching portion 13, to which the conductive member 100 inserted in the holder portion 14 has been attached, has been connected to the holder portion 14. Note that FIGS. 16A and 16B are perspective views in which the lower face portion 16 side of the conductive member attaching portion 13 and the lower face 24*b* side of the body portion 24 of the holder portion 14 are shown on the upper side, and show a part of the conductive member 100. FIGS. 16A and 16B show a state where the first connector 11 and one conductive member 100 are connected.

Upon the end portion 100*a* of the conductive member 100 being inserted into the holder portion 14, next, the conductive member attaching portion 13 is attached to the end portion 100*a* of the conductive member 100 that has been inserted into the insertion hole 26 of the holder portion 14, as shown in FIG. 16A. Then, as shown in FIG. 16B, the conductive member attaching portion 13 is fitted into and thus connected to the holder portion 14 with the conductive member 100 inserted in the insertion hole 26, and with the conductive member attaching portion 13 attached to the end portion 100*a* of the conductive member 100.

Figure 17A:
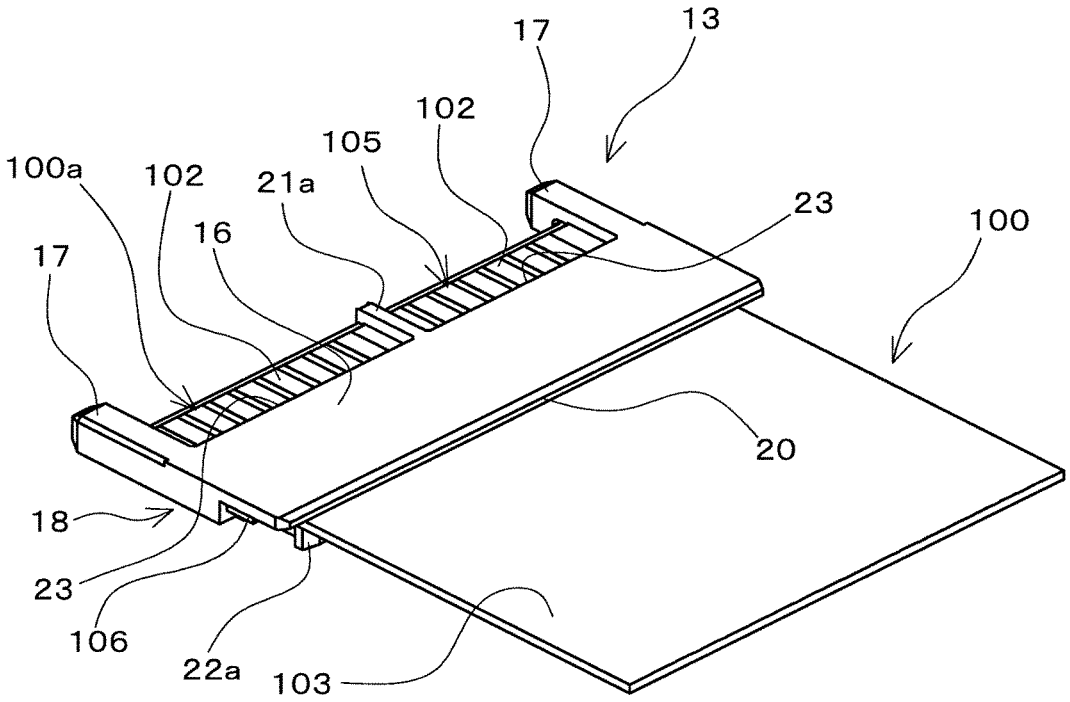
FIG. 17A is a perspective view showing a state where a conductive member has been attached to the conductive member attaching portion, when viewed from the lower face portion side of the conductive member attaching portion.
Figure 17B:
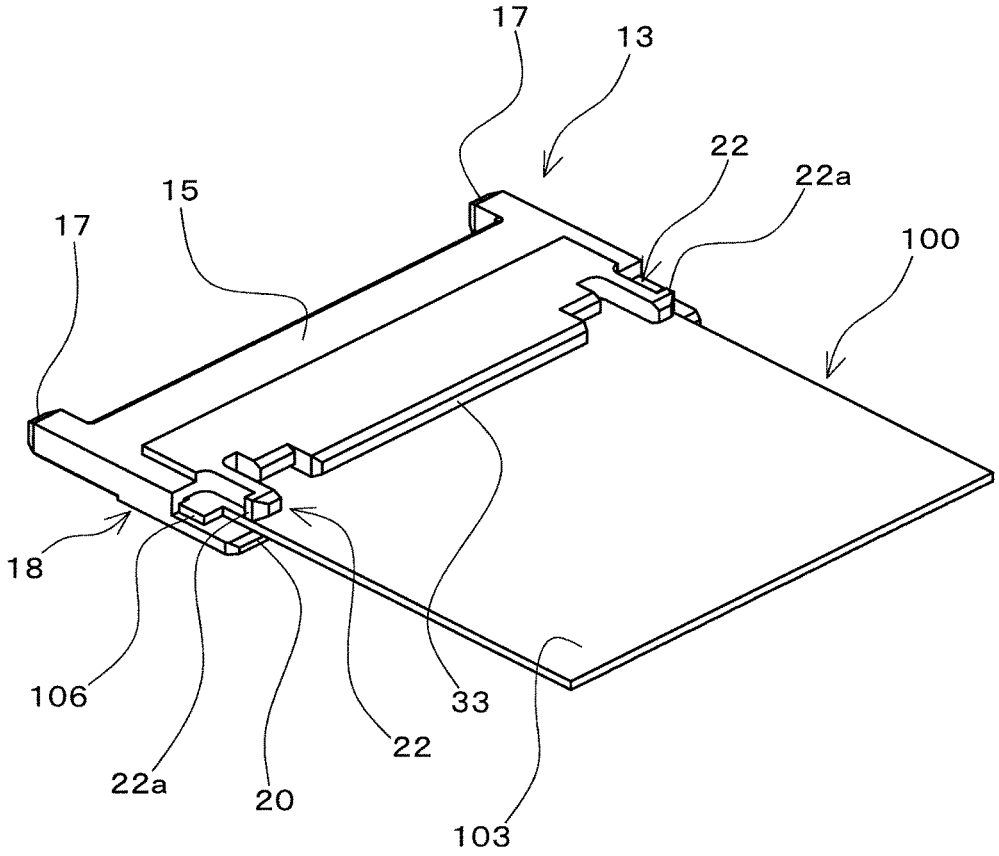
FIG. 17B is a perspective view showing a state where a conductive member has been attached to the conductive member attaching portion, when viewed from the upper face portion side of the conductive member attaching portion.
Figure 18A:
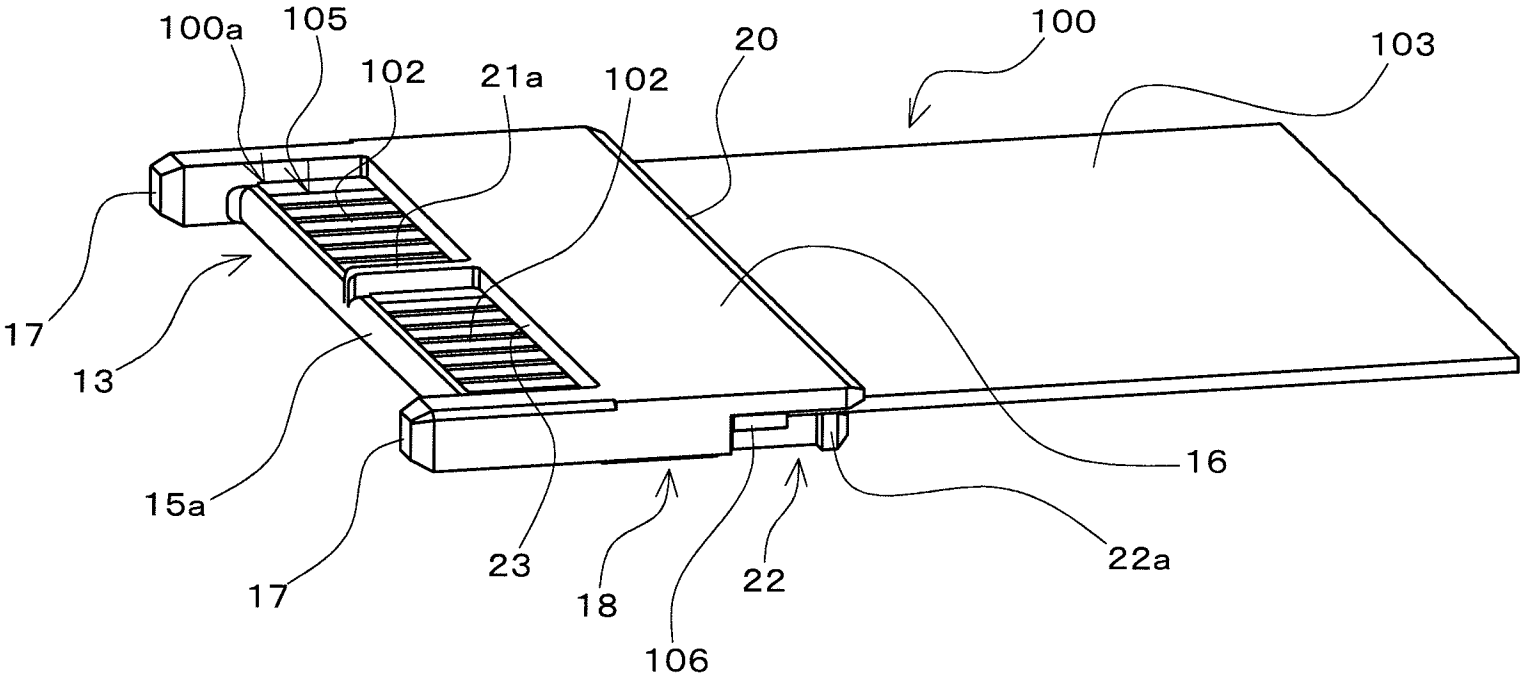
FIG. 18A is a perspective view showing a state where a conductive member has been attached to the conductive member attaching portion.
Figure 18B:
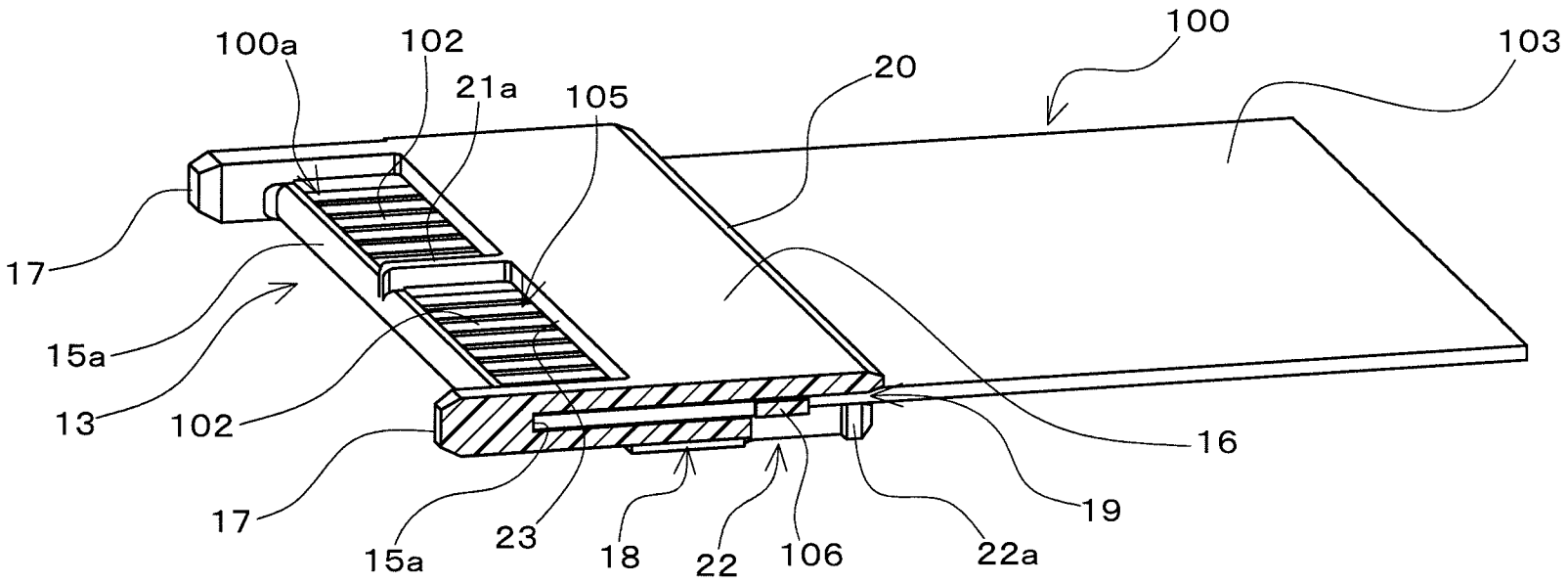
FIG. 18B is a perspective view showing a state where a conductive member has been attached to the conductive member attaching portion, showing a cross-section of a part of the perspective view in FIG. 18A.
Figure 19A:
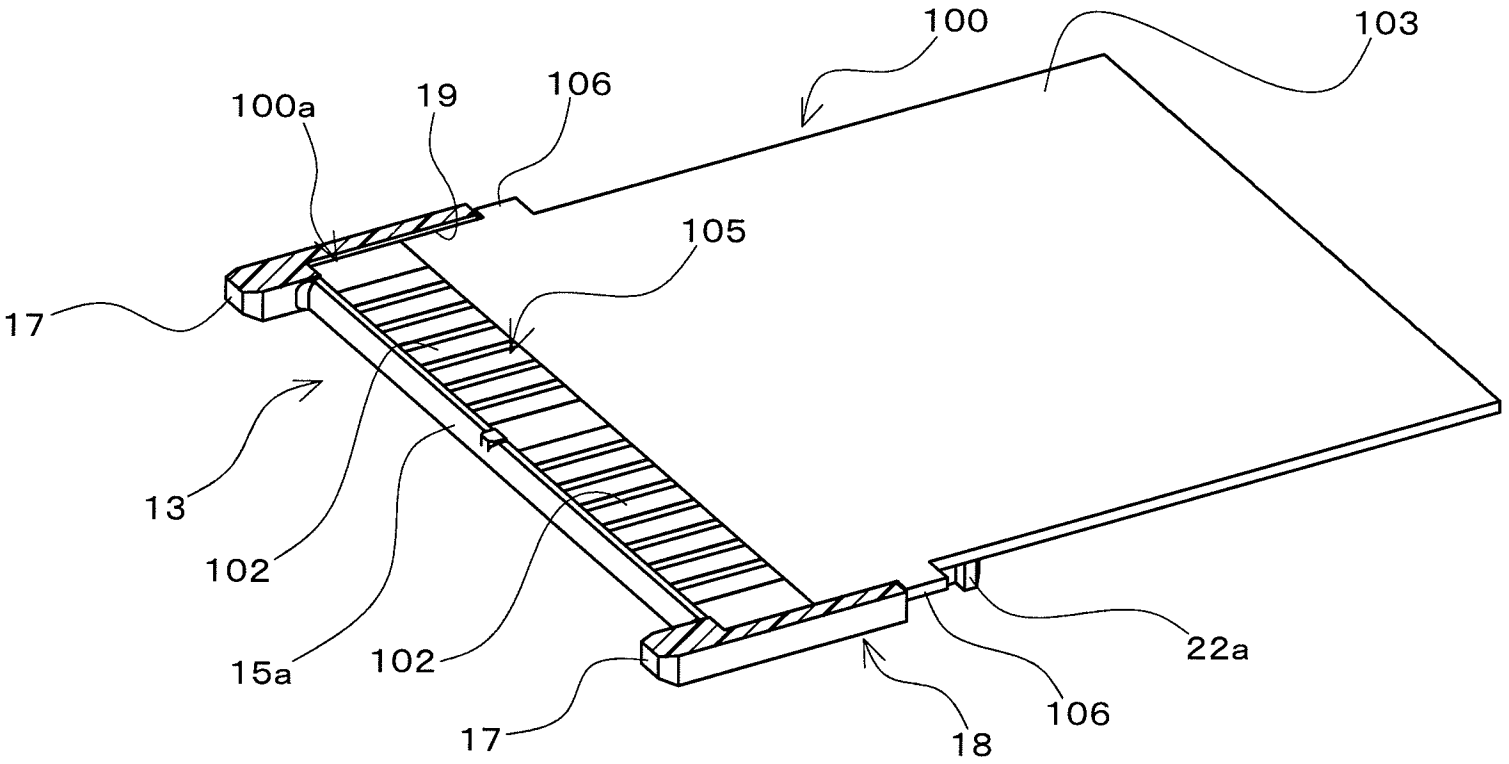
FIG. 19A is a perspective view with a partial cross-sectional view showing a state where a conductive member has been attached to the conductive member attaching portion.
Figure 19B:
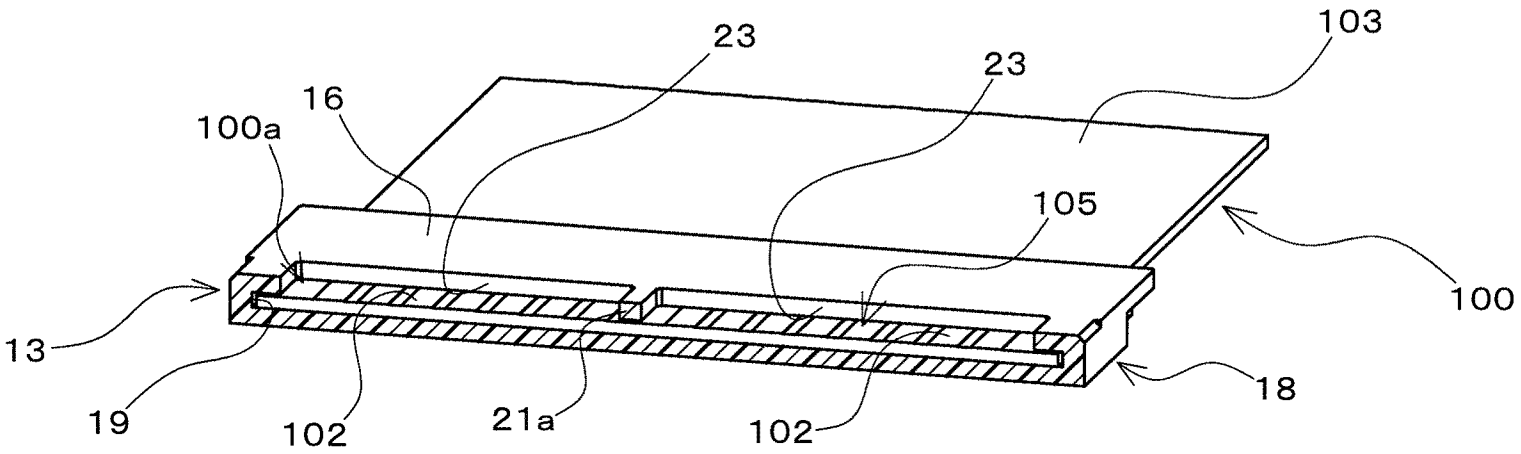
FIG. 19B is a perspective view with a cross-sectional view including portions not shown in FIG. 19A, showing a state where a conductive member has been attached to the conductive member attaching portion.

FIG. 17A is a perspective view showing a state where the conductive member 100 has been attached to the conductive member attaching portion 13, when viewed from the lower face portion 16 side of the conductive member attaching portion 13. FIG. 17B is a perspective view showing a state where the conductive member 100 has been attached to the conductive member attaching portion 13, when viewed from the upper face portion 15 side of the conductive member attaching portion 13. FIG. 18A is a perspective view showing a state where the conductive member 100 has been attached to the conductive member attaching portion 13. FIG. 18B is a perspective view showing a state where the conductive member 100 has been attached to the conductive member attaching portion 13, showing a cross-section of a part of the perspective view in FIG. 18A. FIG. 18B is a perspective view including a cross-section perpendicular to the width direction of the conductive member attaching portion 13. FIG. 19A is a perspective view with a partial cross-sectional view showing a state where the conductive member 100 has been attached to the conductive member attaching portion 13. FIG. 19B is a perspective view with a cross-sectional view including a portion not shown in FIG. 19A, showing a state where the conductive member 100 has been attached to the conductive member attaching portion 13. FIG. 19A is a perspective view including a cross-section perpendicular to the thickness direction of the conductive member attaching portion 13. FIG. 19B is a perspective view including a cross-section perpendicular to the connecting direction of the conductive member attaching portion 13. Note that FIGS. 17A to 19B show a part of the conductive member 100. FIGS. 17A to 19B omit the holder portion 14. FIGS. 18A to 19B are perspective views in which the lower face portion 16 side of the conductive member attaching portion 13 is shown on the upper side.

When the conductive member 100 inserted in the insertion hole 26 in the holder portion 14 is attached to the conductive member attaching portion 13 at the end portion 100*a* of the conductive member 100, the end portion 100*a* of the conductive member 100 is inserted into the insertion slot 19 of the conductive member attaching portion 13. At this time, the end portion 100*a* of the conductive member 100 is inserted from the insertion slot 19, parallel to the connecting direction of the conductive member attaching portion 13, toward the leading end side of the conductive member attaching portion 13. Upon the end portion 100*a* of the conductive member 100 inserted in the insertion slot 19, which is demarcated by the casing portion 18, being inserted up to the distal side of the insertion slot 19, the edge part at the leading end of the end portion 100*a* abuts against the abutting wall portion 15*a* from the inside of the conductive member attaching portion 13. Thus, as shown in FIGS. 16A and 17A to 19B, the end portion 100*a* of the conductive member 100 inserted in the insertion slot 19 is attached in a state of being positioned relative to the conductive member attaching portion 13.

When in a state where the end portion 100*a* of the conductive member 100 has been attached to the conductive member attaching portion 13, the conductor-exposing portion 105 of the end portion 100*a* of the conductive member 100 is exposed to the outside from the opening portions 23 of the conductive member attaching portions 13. Further, when in a state where the end portion 100*a* of the conductive member 100 has been attached to the conductive member attaching portion 13, the periphery of a given region of the end portion 100*a* of the conductive member 100 in the longitudinal direction of the conductive member 100 is circumferentially covered and enclosed by the casing portion 18 of the conductive member attaching portion 13. More specifically, a portion of the end portion 100*a* of the conductive member 100 adjacent to the conductor-exposing portion 105 in the longitudinal direction of the conductive member 100 enters a state of being covered and enclosed by the casing portion 18.

Figure 20A:
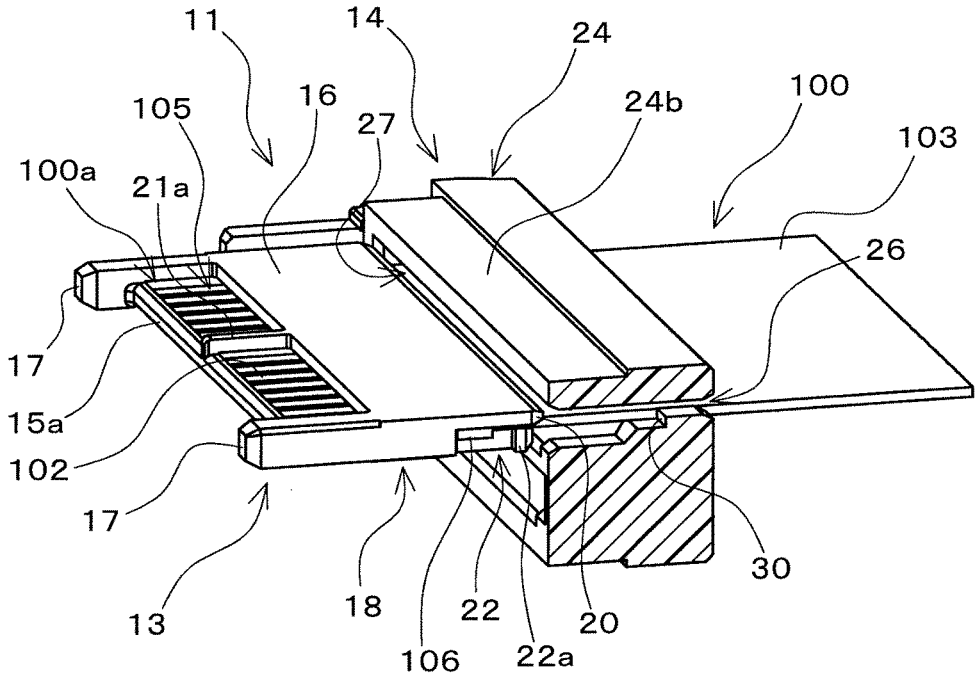
FIG. 20A is a perspective view with a partial cross-sectional view for illustrating a mode in which a conductive member is connected to the first connector, showing a state where the conductive member has been inserted in the holder portion and attached to the conductive member attaching portion.
Figure 20B:
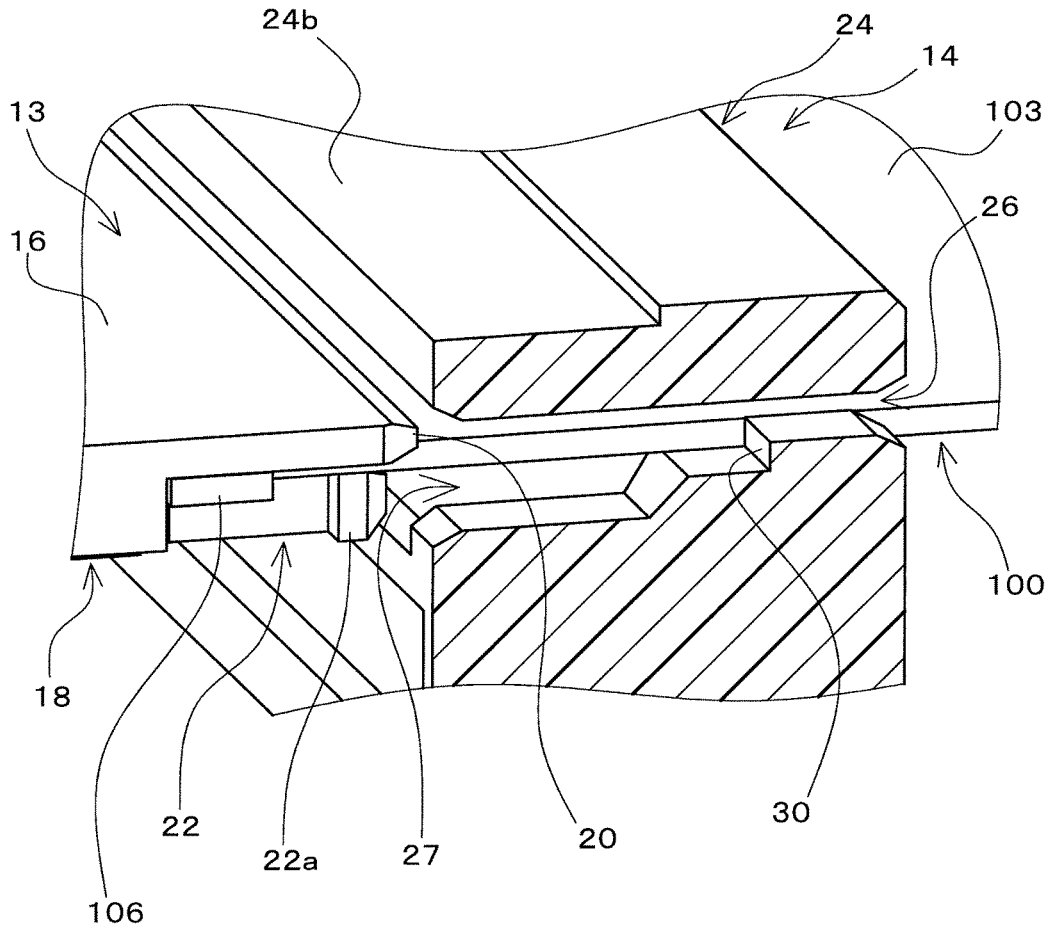
FIG. 20B is an enlarged view of a part of FIG. 20A, for illustrating a mode in which a conductive member is connected to the first connector.

FIG. 20A is a perspective view with a partial cross-sectional view for illustrating a mode in which the conductive member 100 is connected to the first connector 11, showing a state where the conductive member 100 has been inserted in the holder portion 14 and attached to the conductive member attaching portion 13. FIG. 20B is an enlarged view of a part of FIG. 20A, for illustrating a mode in which the conductive member 100 is connected to the first connector 11. Note that FIGS. 20A and 20B show a state in the middle of an operation in which the conductive member attaching portion 13 is fitted into and connected to the holder portion 14. FIGS. 20A and 20B show a part of the conductive member 100. FIGS. 20A and 20B are perspective views including a cross-section perpendicular to the width direction of the holder portion 14.

As shown in FIGS. 20A and 20B, upon the conductive member 100 being inserted into the insertion hole 26, and the conductive member attaching portion 13 being attached to the end portion 100*a* of the conductive member 100, an operation is performed in which the conductive member attaching portion 13 is fitted into and connected to the holder portion 14. At this time, the conductive member attaching portion 13 is fitted into the holder portion 14 from the fitting hole 27 in a state where the conductive member 100 has been displaced so as to be shifted from the conductive member passage region 28 toward the conductive member arrangement region 29 in the insertion hole 26. That is to say, when the conductive member attaching portion 13, to which the conductive member 100 has been attached, is fitted into the holder portion 14, the conductive member attaching portion 13 is fitted into the fitting hole 27 in the holder portion 14 such that the conductive member 100 passes through the conductive member arrangement region 29 in the insertion hole 26.

Figure 21A:
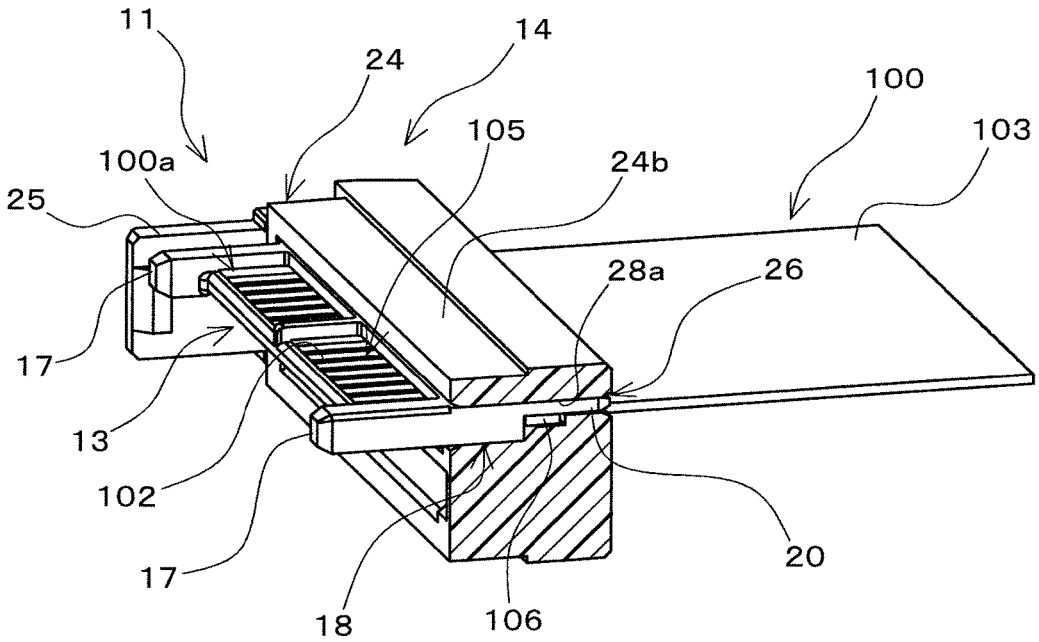
FIG. 21A is a perspective view with a partial cross-sectional view showing a state where a conductive member has been connected to the first connector.
Figure 21B:
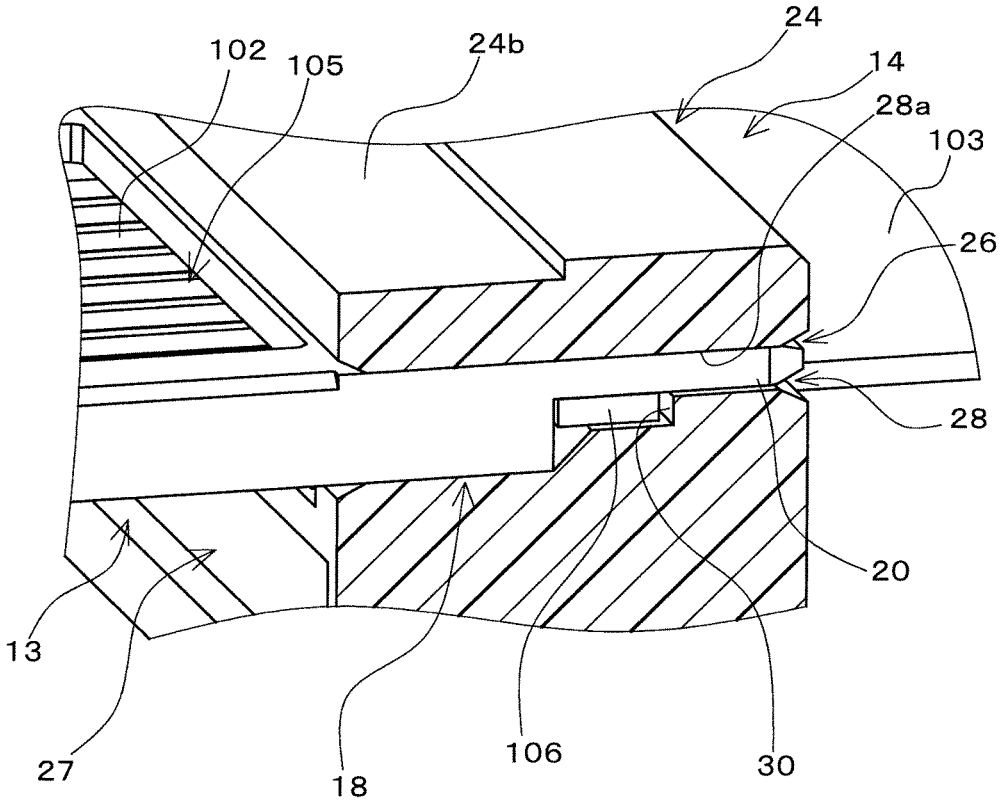
FIG. 21B is an enlarged perspective view of a part of FIG. 21A, showing a state where a conductive member has been connected to the first connector.
Figure 22:
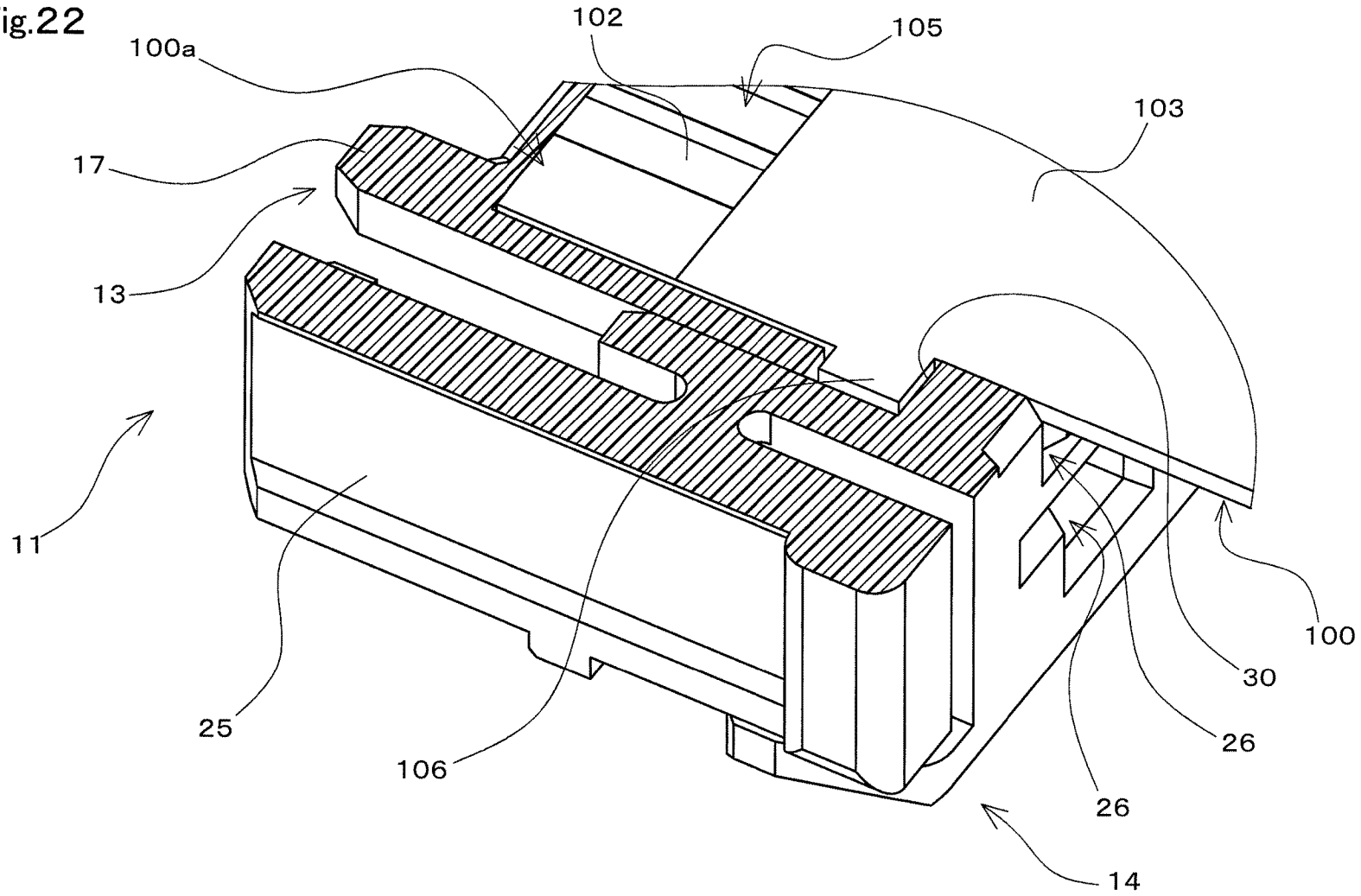
FIG. 22 is a perspective view with a partial cross-sectional view showing a state where a conductive member has been connected to the first connector.
Figure 23A:
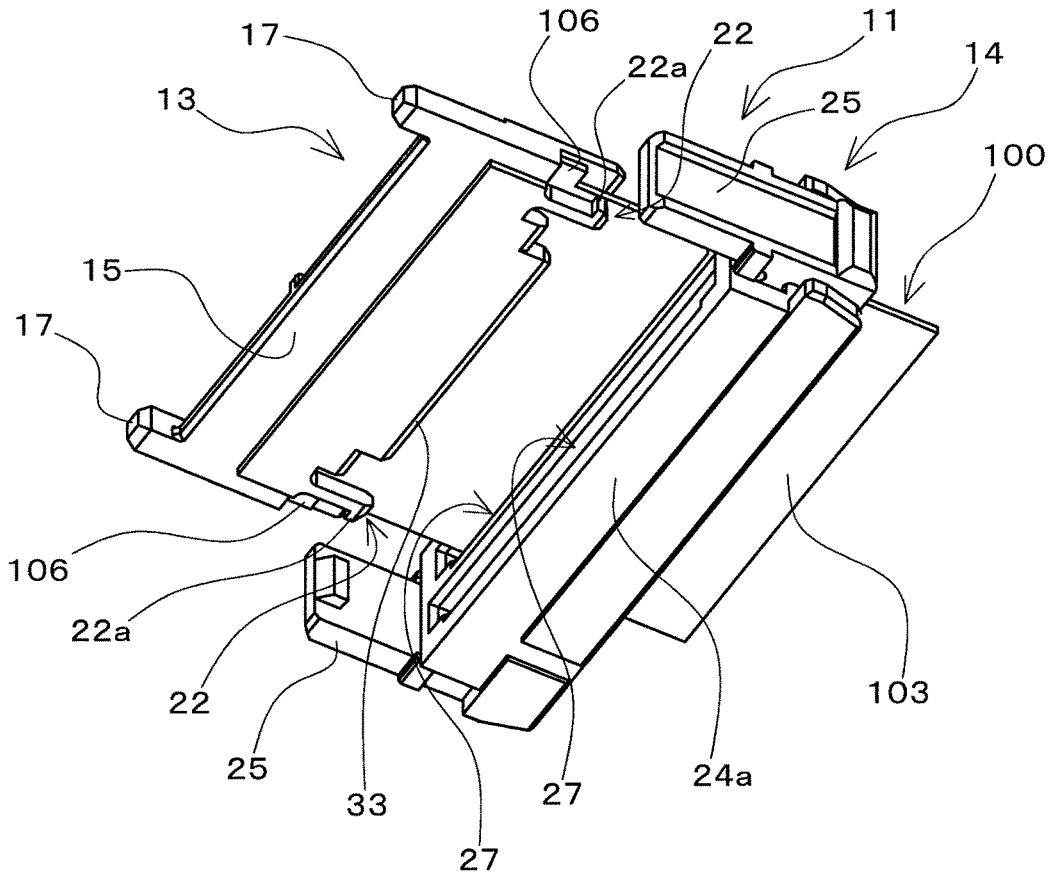
FIG. 23A is a perspective view for illustrating a mode in which a conductive member is connected to the first connector, showing a state where the conductive member has been inserted into the holder portion and attached to the conductive member attaching portion.
Figure 23B:
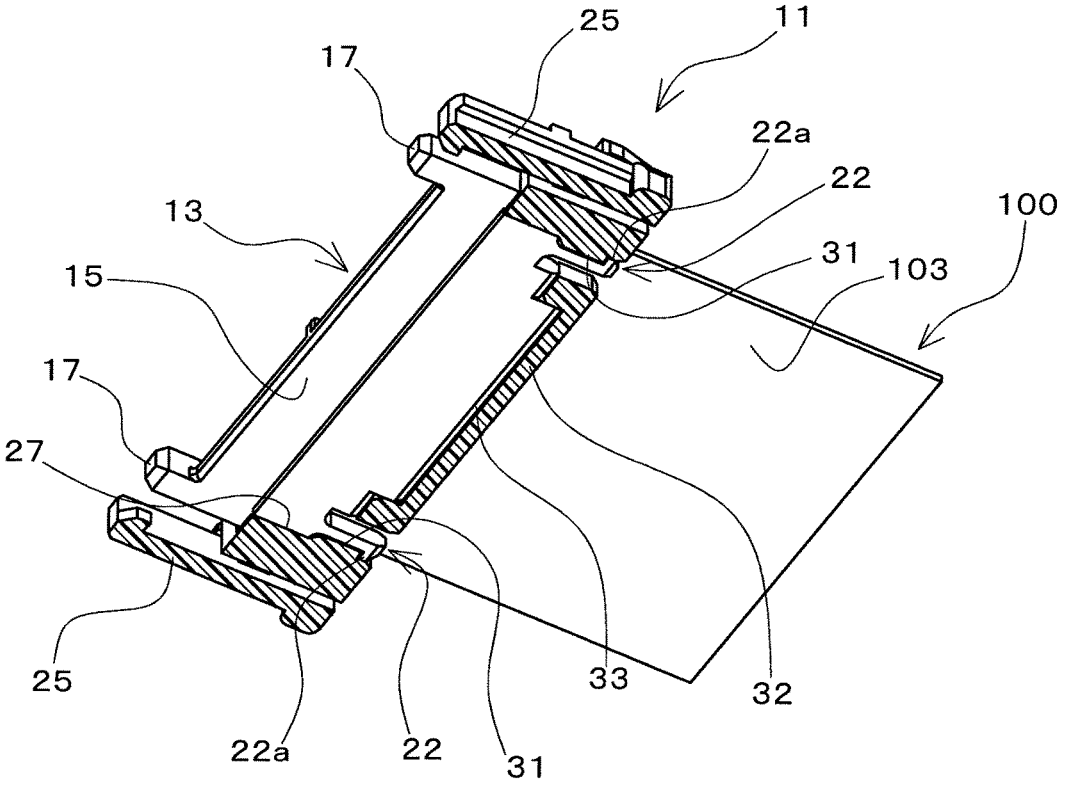
FIG. 23B is a perspective view with a partial cross-sectional view for illustrating a mode in which a conductive member is connected to the first connector, showing a state where the conductive member has been connected to the first connector.
Figure 24:
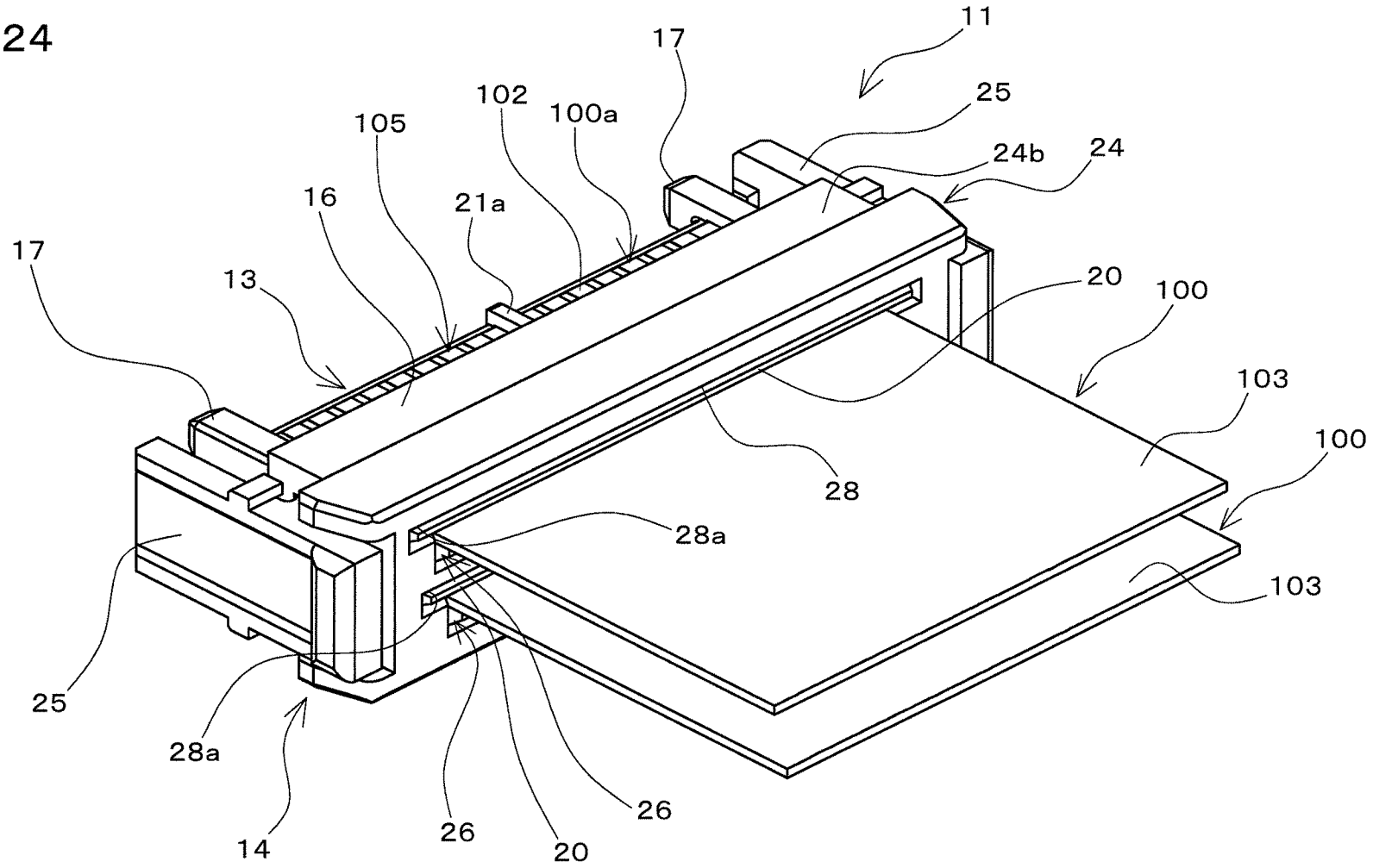
FIG. 24 is a perspective view showing a state where conductive members have been connected to the first connector.
Figure 25A:
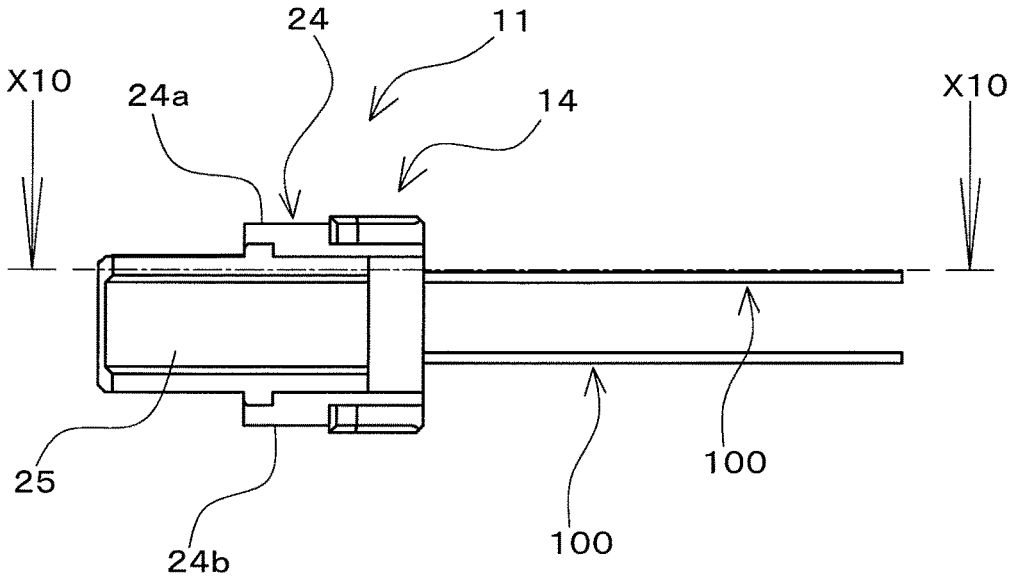
FIG. 25A is a side view showing a state where conductive members have been connected to the first connector.
Figure 25B:
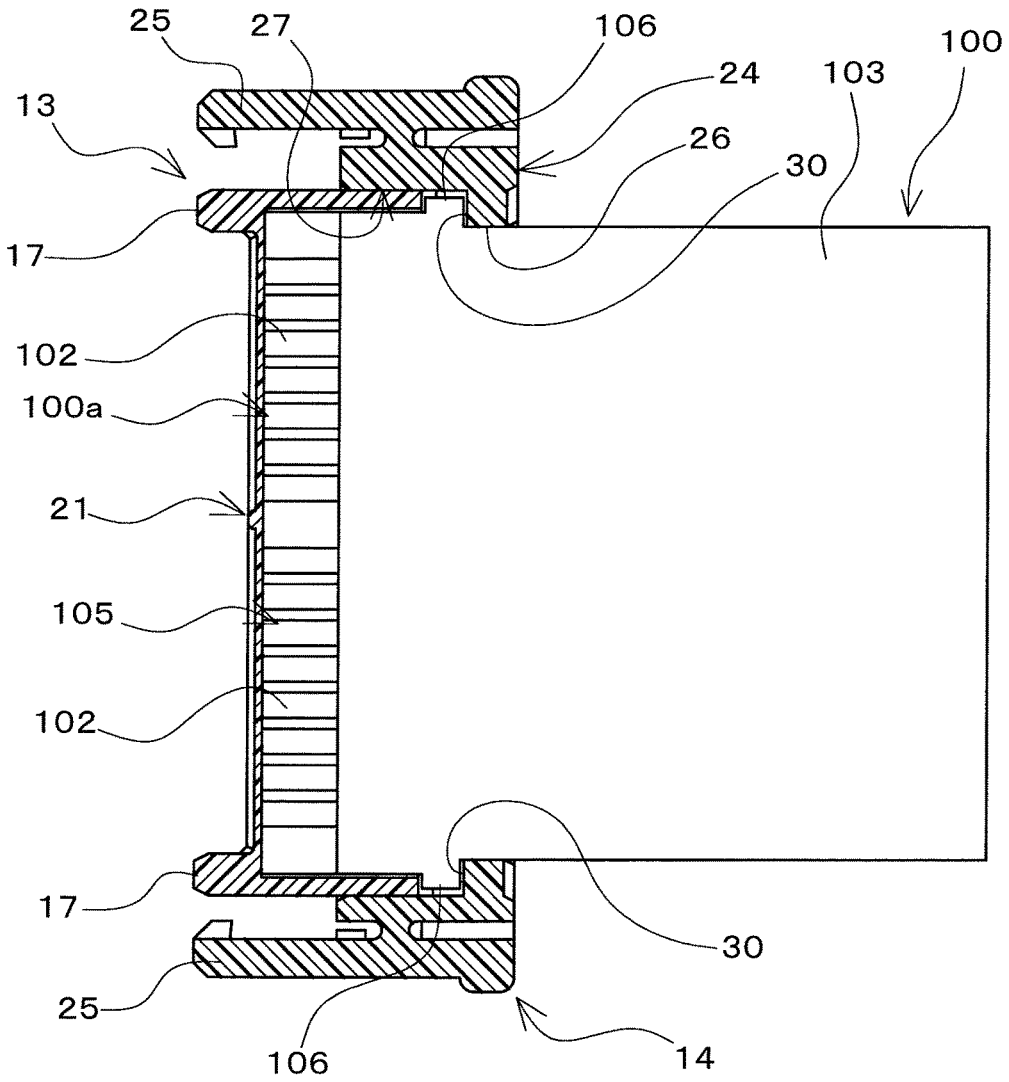
FIG. 25B is a cross-sectional view showing a state where a conductive member has been connected to the first connector, taken along a line X10-X10 in FIG. 25A.

FIG. 21A is a perspective view with a partial cross-sectional view showing a state where the conductive member 100 has been connected to the first connector 11. FIG. 21B is an enlarged perspective view of a part of FIG. 21A, for illustrating a mode in which the conductive member 100 has been connected to the first connector 11. FIGS. 21A and 21B are perspective views including a cross-section perpendicular to the width direction of the holder portion 14. FIG. 22 is a perspective view with a partial cross-sectional view showing a state where the conductive member 100 has been connected to the first connector 11. FIG. 22 is a perspective view including a cross-section perpendicular to the thickness direction of the conductive member attaching portion 13 and the thickness direction of the holder portion 14. FIG. 23A is a perspective view for illustrating a mode in which the conductive member 100 is connected to the first connector 11, showing a state where the conductive member 100 has been inserted in the holder portion 14 and attached to the conductive member attaching portion 13. FIG. 23B is a perspective view with a partial cross-sectional view for illustrating a mode in which the conductive member 100 is connected to the first connector 11, showing a state where the conductive member 100 has been connected to the first connector 11. FIG. 23B is a perspective view including a cross-section perpendicular to the thickness direction of the holder portion 14. FIG. 24 is a perspective view showing a state where the conductive members 100 have been connected to the first connector 11. FIG. 25A is a side view showing a state where the conductive members 100 have been connected to the first connector 11. FIG. 25B is a cross-sectional view showing a state where the conductive member 100 has been connected to the first connector 11, showing a cross-section taken along a line X10-X10 in FIG. 25A.

Note that FIGS. 21A to 25B show a part of the conductive member 100. FIGS. 21A to 23B show a state where the first connector 11 and one conductive member 100 are connected. FIGS. 24 to 25B show a state where the first connector 11 and two conductive members 100 are connected.

When the conductive member attaching portion 13, to which the conductive member 100 has been attached, is fitted into the holder portion 14, the conductive member attaching portion 13 is fitted into the fitting hole 27 in the holder portion 14 from the end at which the closing portion 20, the engaging projecting portions 22, and the abutting portion 33 are provided (see FIGS. 20A, 20B, 23A, and 23B). Upon the conductive member attaching portion 13 being fitted into the holder portion 14 up to the distal side of the fitting hole 27, the conductive member 100 is arranged in the conductive member arrangement region 29 in the insertion hole 26.

When in a state where the conductive member attaching portion 13 has been fitted into the holder portion 14, the pair of engaging portions 106 of the conductive member 100 enter a state of being engaged with the pair of engaged portions 30 of the holder portion 14 (see FIGS. 21A, 21B, 22, 25A, and 25B). The pair of engaging portions 106, when in a state of being engaged with the pair of engaged portions 30, are firmly held by the conductive member attaching portion 13 and the holder portion 14, in a state of being sandwiched by the conductive member attaching portion 13 and the holder portion 14 in the connecting direction and the thickness direction of the conductive member attaching portion 13 and the holder portion 14.

Note that, as shown in FIGS. 24 to 25B, when two conductive members 100 are connected to the first connector 11, the conductive member attaching portions 13, to each of which a conductive member 100 has been attached, are fitted into the respective fitting holes 27 in the holder portion 14. Then, the pair of engaging portions 106 of each conductive member 100 engage with the pair of engaged portions 30 corresponding to the corresponding insertion hole 26 in the holder portion 14.

When in a state where the conductive member attaching portion 13 has been fitted into the holder portion 14, the closing portion 20 of the conductive member attaching portion 13 is configured to close the conductive member passage region 28 which is a part of the insertion hole 26, in a state of being fitted into the insertion hole 26 in the holder portion 14 (see FIGS. 21A, 21B, and 24). Thus, when the conductive member attaching portion 13 has been fitted into the holder portion 14, the conductive member attaching portion 13 being in a state where the end portion 100*a* of the conductive member 100 inserted in the insertion hole 26 has been attached to the conductive member attaching portion 13, the closing portion 20 is configured to close the conductive member passage region 28 in the insertion hole 26, with the engaging portions 106 engaged with the engaged portions 30. Due to the above-described configuration, when the conductive member attaching portion 13 has been fitted into the holder portion 14, the conductive member attaching portion 13 being in a state where the end portion 100*a* of the conductive member 100 inserted in the insertion hole 26 has been attached to the conductive member attaching portion 13, the closing portion 20 is configured to close at least the engaging portion passage region 28*a* in the insertion hole 26, with the engaging portions 106 engaged with the engaged portions 30.

When in a state where the conductive member attaching portion 13 has been fitted into the holder portion 14, the pair of engaging projecting portions 22 of the conductive member attaching portion 13 enter a state of being engaged, at the projections 22*a*, with the pair of engaging protruding portions 31 in the holder portion 14 within the holder portion 14 (see FIG. 23B). Thus, the conductive member attaching portion 13 is locked with respect to the holder portion 14, and the conductive member attaching portion 13 is prevented from coming off the holder portion 14 and falling out. Note that, when two conductive members 100 are connected to the first connector 11 as shown in FIGS. 24 to 25B, the pair of engaging projecting portions 22 of the conductive member attaching portion 13, to which the conductive member 100 has been attached, are engaged, at the projections 22*a*, with the pair of engaging protruding portions 31 that correspond to the corresponding insertion hole 26 in the holder portion 14.

When in a state where the conductive member attaching portion 13 has been fitted into the holder portion 14, the abutting portion 33 of the conductive member attaching portion 13 abuts against the positioning wall portion 32 of the holder portion 14 within the holder portion 14 (see FIG. 23B). Thus, the fitting completion position of the conductive member attaching portion 13 fitted and connected to the holder portion 14 is positioned with respect to the holder portion 14. Note that, when two conductive members 100 are connected to the first connector 11 as shown in FIGS. 24 to 25B, the abutting portions 33 of the conductive member attaching portions 13, to which the conductive members 100 have been attached, abut against the positioning wall portions 32 corresponding to the respective insertion holes 26 in the holder portion 14.

Second Connector

Figure 26:
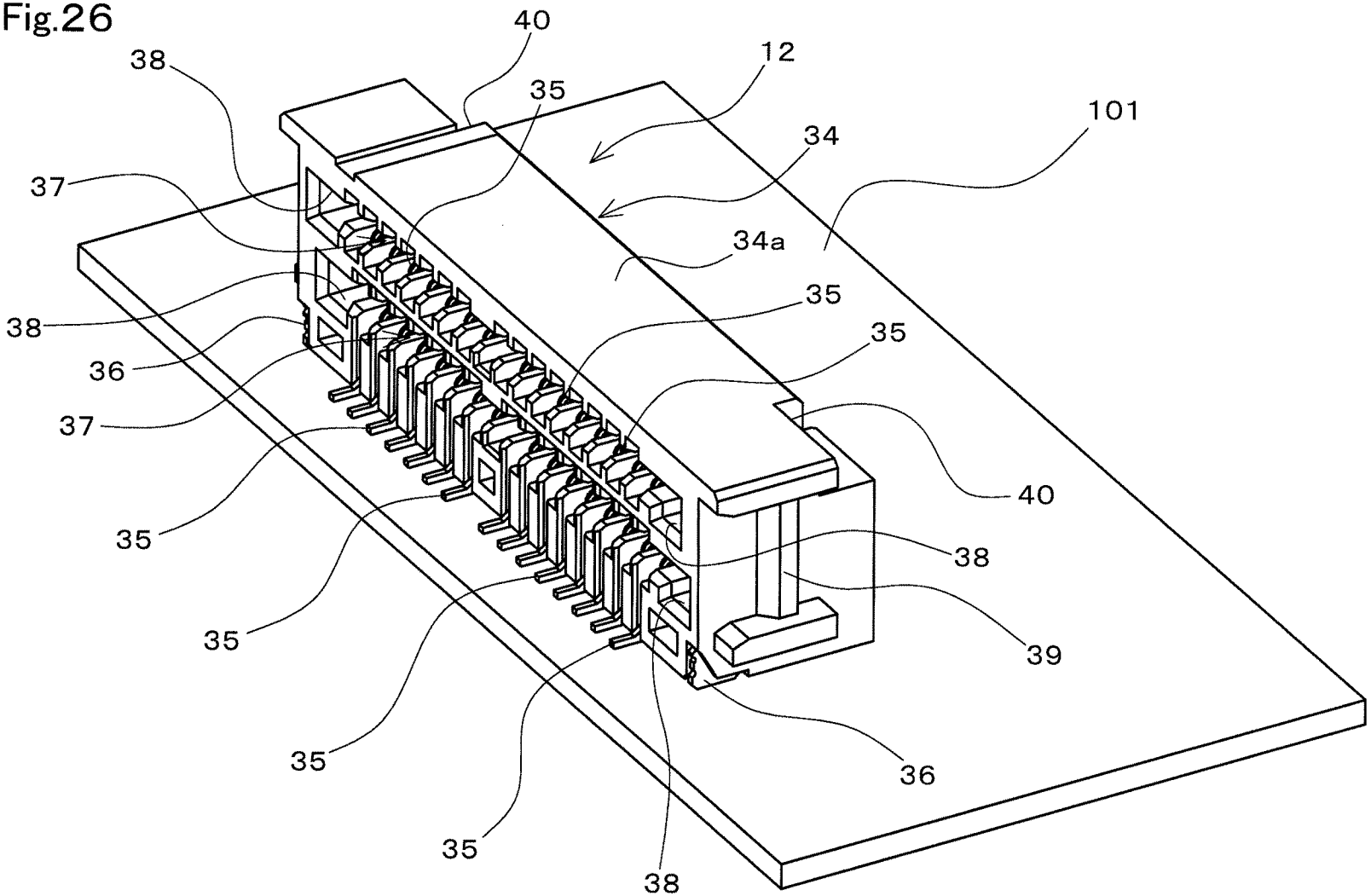
FIG. 26 is a perspective view showing a second connector in the electrical connection device, together with a part of the substrate.
Figure 27:
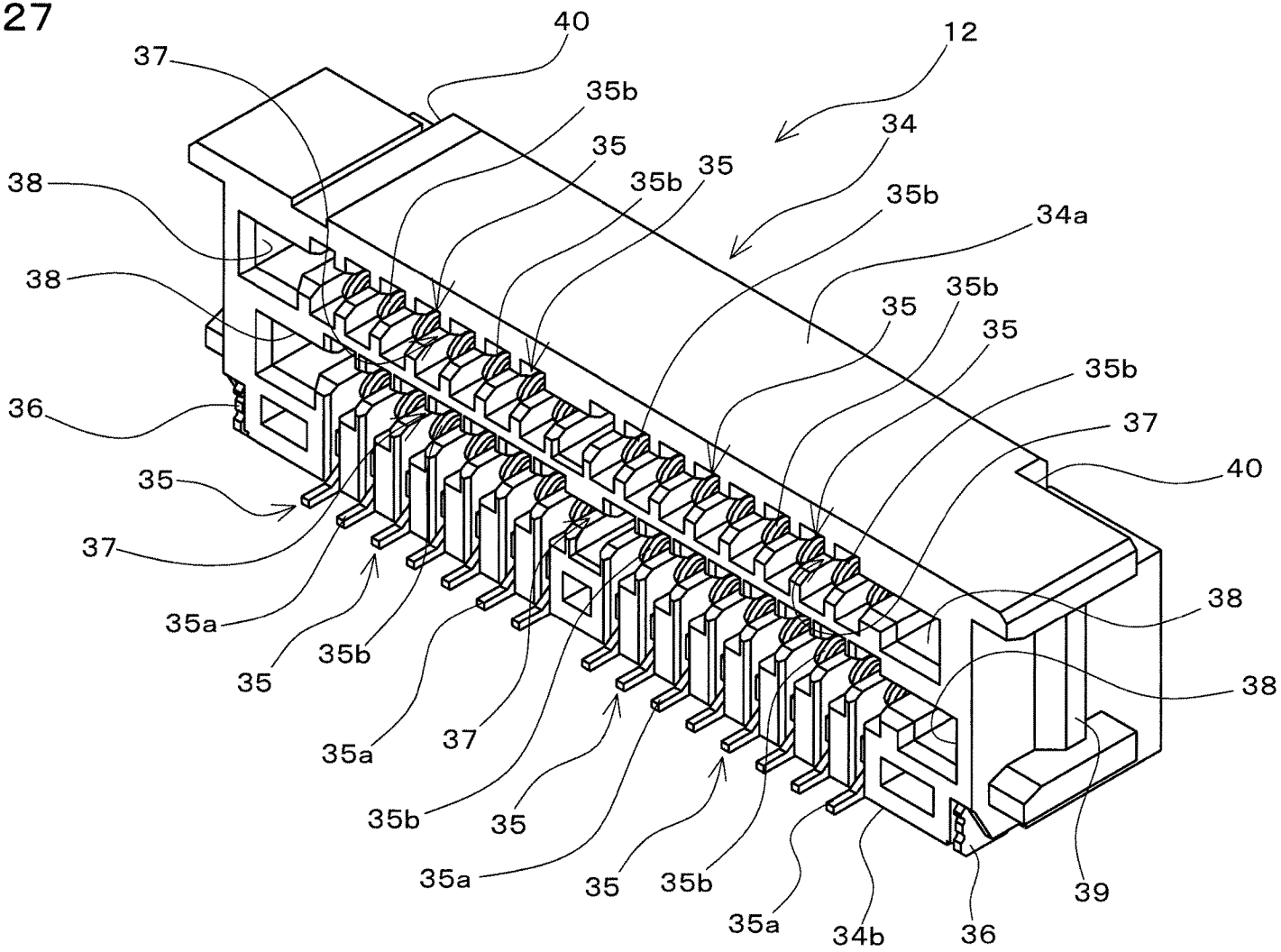
FIG. 27 is a perspective view of the second connector.
Figure 28A:
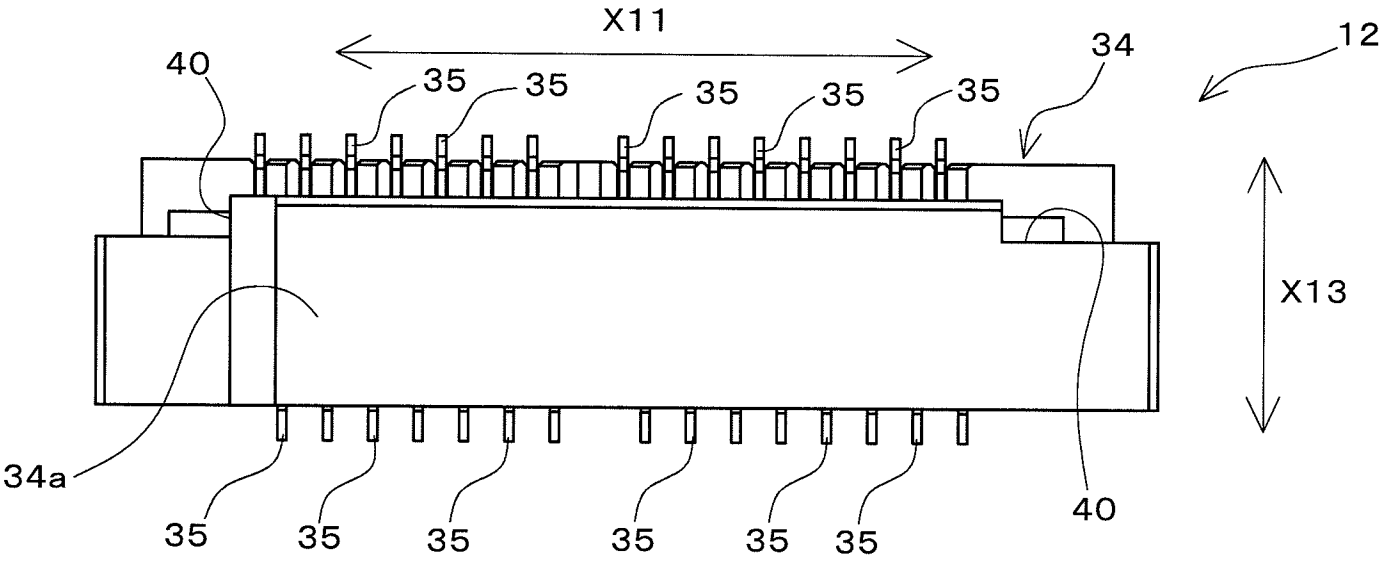
FIG. 28A is a plan view of the second connector.
Figure 28B:
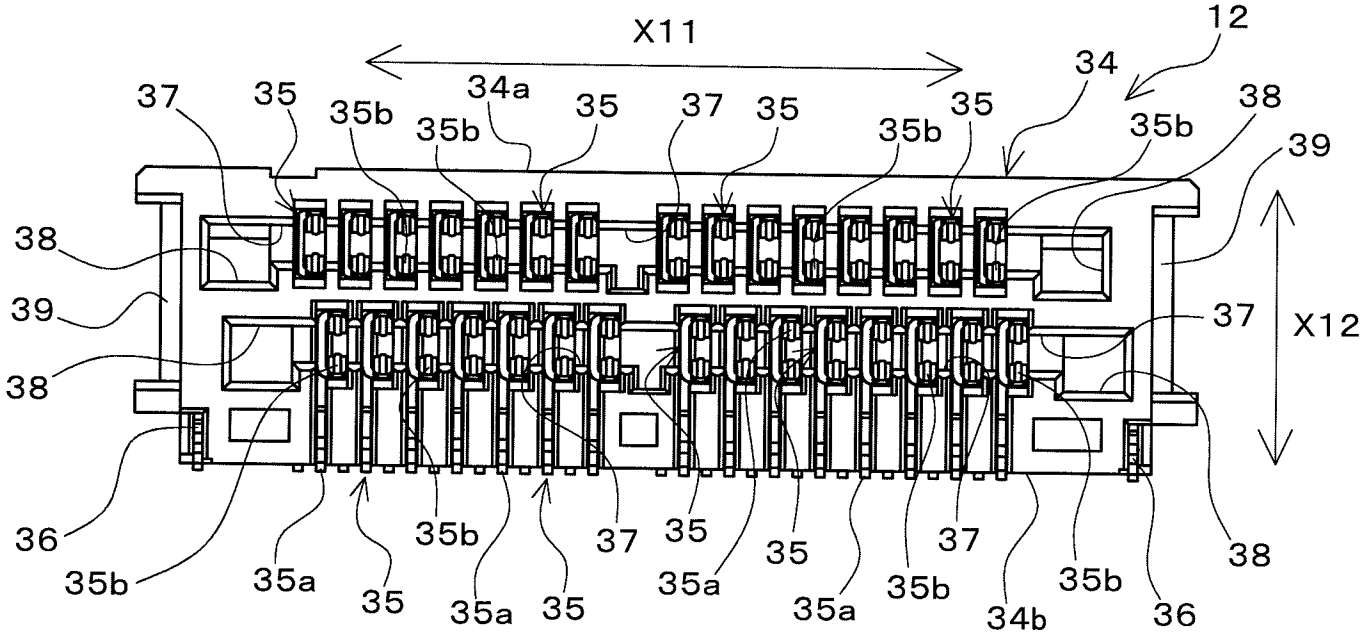
FIG. 28B is an elevational view of the second connector.
Figure 28C:
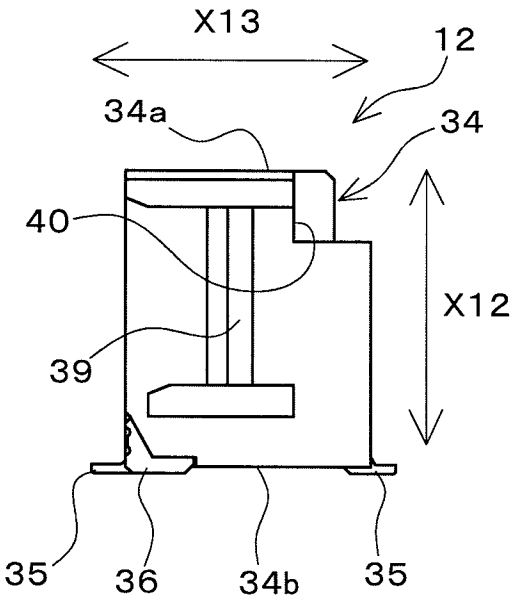
FIG. 28C is a side view of the second connector.

FIG. 26 is a perspective view showing the second connector 12 in the electrical connection device 1, together with a part of the substrate 101. FIG. 27 is a perspective view of the second connector 12. FIG. 28A is a plan view of the second connector 12. FIG. 28B is an elevational view of the second connector 12. FIG. 28C is a side view of the second connector 12.

The first connector 11 is mechanically and electrically connected to the second connector 12 shown in FIGS. 1, 2, and 26 to 28C. The second connector 12 in a state of having been connected to the substrate 101 is connected to the first connector 11. The second connector 12 is configured to include the housing 34, a plurality of terminals 35, fixture fittings 36, and the like.

The plurality of terminals 35 are made of a conductive metal material, and are held by the housing 34. The plurality of terminals 35 are configured to be electrically connected to the plurality of conductors 102 in the conductive member 100 attached to the conductive member attaching portion 13. More specifically, when the first connector 11 has been connected to the second connector 12, the terminals 35 are electrically connected to the conductors 102 by coming into contact with the conductors 102.

The plurality of terminals 35 are mechanically and electrically connected to the substrate 101. More specifically, the terminals 35 are mechanically fixed to the substrate 101 and electrically connected to the conductive circuit pattern on the substrate 101, by being soldered onto the front face of the substrate 101.

The plurality of terminals 35 are arranged in the housing 34 in two lines side-by-side in the width direction of the housing 34. That is to say, the width direction of the housing 34 is set as a direction in which the plurality of terminals 35 are arranged side-by-side. The width direction of the housing 34 is indicated by a double headed arrow X11 in FIGS. 28A and 28B. Note that the width direction of the housing 34 is the same as the width direction of the second connector 12. When in a state where the second connector 12 and the first connector 11 have been connected, the width direction of the second connector 12 is the same as the width direction of the first connector 11.

Each terminal 35 is configured to include a substrate connecting portion 35*a* and a conductor connecting portion 35*b*, which are integrally provided. The substrate connecting portion 35*a* is provided as a portion of each terminal 35 on one end side, and is configured as a portion to be connected to the substrate 101. The conductor connecting portion 35*b* is provided as a portion of each terminal 35 on the other end side, and is configured as a portion to be connected to the conductor 102 in the conductive member 100.

Note that each terminal 35 has, on the other end side, i.e. on the side opposite to the substrate connecting portion 35*a* side, a pair of holding portions that are provided as a pair of cantilever-like end portions for sandwiching the end portion 100*a* of the conductive member 100 in the thickness direction. The conductor connecting portion 35*b* is configured as one of the pair of holding portions. The conductor connecting portion 35*b*, which is provided as one of the pair of holding portions, comes into contact with and is electrically connected to the conductor 102 that is exposed in the conductor-exposing portion 105 in the end portion 100*a* of the conductive member 100, with the pair of holding portions sandwiching the end portion 100*a* of the conductive member 100.

The fixture fittings 36 are made of a metal material, and are provided as members for firmly fixing the second connector 12 to the substrate 101. A pair of fixture fittings 36 are provide, and are fixed on respective end sides of the housing 34 in the width direction. The fixture fittings 36 are fixed by, for example, being pressed into the housing 34. The fixture fittings 36 are mechanically fixed to the substrate 101 by being soldered onto the front face of the substrate 101.

The housing 34 is made of an insulating resin material, and is provided as a member having an external shape elongated in the width direction. The housing 34 is configured to hold the plurality of terminals 35. The housing 34 is configured such that the conductive member attaching portion 13 of the first connector 11 is fitted to the housing 34, and the holder portion 14 is engaged with the housing 34.

The housing 34 has an upper face 34*a* and a lower face 34*b* that extend in the width direction of the housing 34. When in a state where the housing 34 has been installed onto and connected to the substrate 101, the upper face 34*a* of the housing 34 is arranged on the side opposite to the substrate 101 side, and the lower face 34*b* of the housing 34 is arranged in a state of opposing the front face of the substrate 101. Note that the upper face 34*a* and the lower face 34*b* of the housing 34 are configured as respective end faces of the housing 34 in the thickness direction. The thickness direction of the housing 34 is indicated by a double headed arrow X12 in FIGS. 28B and 28C. Note that the thickness direction of the housing 34 is the same as the thickness direction of the second connector 12. When in a state where the second connector 12 and the first connector 11 have been connected, the thickness direction of the second connector 12 is the same as the thickness direction of the first connector 11.

The housing 34 is provided with connection ports 37 each including guide grooves 38, lock protruding portions 39, leading end exposing portions 40, and the like.

The connection ports 37 are provided as openings to which the conductive member attaching portions 13 are fitted and connected. A plurality of connection ports 37 are provided in the housing 34. In this embodiment, two connection ports 37 are provided corresponding to the conductive member attaching portions 13, in the first connector 11. Each connection port 37 is formed in the housing 34 in an opening shape that extends in the width direction of the housing 34. The two connection ports 37 are arranged in the housing 34 one on top of the other in the thickness direction of the housing 34.

The connection ports 37 are open in the housing 34 at one end of the housing 34 in the connecting direction on the side at which the conductive member attaching portions 13 are connected. Note that the connecting direction of the housing 34 is a direction perpendicular to the width direction and the thickness direction of the housing 34. The connecting direction of the housing 34 is a direction parallel to the direction in which the conductive member attaching portion 13 is fitted to the housing 34, and is set as a direction parallel to the direction in which the first connector 11 is connected to the second connector 12. Note that, in FIGS. 28A and 28C, the connecting direction of the housing 34 is indicated by a double headed arrow X13.

Within the connection ports 37, the conductor connecting portions 35*b* in the plurality of terminals 35 arranged in the width direction of the housing 34 are exposed. Each conductive member attaching portion 13 is fitted and connected to the corresponding connection port 37 on the leading end side where the opening portions 23 are provided. Upon the conductive member attaching portion 13 being fitted to the connection port 37, the plurality of conductors 102 exposed from the opening portions 23 come into contact with the respective conductor connecting portions 35*b* in the plurality of terminals 35 exposed within the connection port 37. Thus, the conductors 102 and the terminals 35 are electrically connected.

A pair of guide grooves 38 are provided in each connection port 37, and are provided as portions on respective end sides of each connection port 37 in the width direction. The guide grooves 38 are each configured as a groove for guiding the conductive member attaching portion 13 when being fitted to the housing 34, in the direction in which the projecting portions 17 of the conductive member attaching portion 13 are fitted into the housing 34. That is to say, when the conductive member attaching portion 13 is fitted to the housing 34, the projecting portions 17 are guided along the guide grooves 38 and fitted into the guide grooves 38.

The lock protruding portions 39 are provided as portions to engage with the engaging pawl portions 25*a* of the lock arm portions 25 of the holder portion 14, when the first connector 11 has been connected to the second connector 12 such that the conductive member attaching portion 13 is fitted to the connection port 37. A pair of lock protruding portions 39 are provided in the housing 34, and are provided at respective ends of the housing 34 in the width direction.

The pair of lock protruding portions 39 are provided as portions that protrude outside the housing 34 so as to engage with the engaging pawl portions 25*a* of the lock arm portions 25 provided on the respective sides of the holder portion 14 in the width direction. When the conductive member attaching portion 13 is fitted to the housing 34, and the first connector 11 is connected to the second connector 12, initially, the lock arm portions 25 provided in a cantilevered manner on the respective sides in the width direction of the holder portion 14 abut against the lock protruding portions 39, and temporarily bend. Then, upon the leading end of the conductive member attaching portion 13 being inserted and fitted toward the distal side of the connection port 37, the bent lock arm portions 25 are elastically restored, and the engaging pawl portions 25*a* at the ends of the cantilevered lock arm portions 25 are engaged with the lock protruding portions 39. Thus, the holder portion 14 is engaged with the housing 34 at the lock arm portions 25 with the conductive member attaching portion 13 fitted to the housing 34, and the first connector 11 is locked and held with respect to the second connector 12. As a result, the first connector 11 is prevented from coming off the second connector 12 and falling out.

A pair of leading end exposing portions 40 are provided at respective ends of the housing 34 in the width direction. The leading end exposing portions 40 are provided in the housing 34 on the end side opposite to the connection port 37 side of the housing 34 in the connecting direction. The leading end exposing portions 40 are configured as cutout portions that are formed to be recessed toward the inside of the housing 34 at the respective ends of the housing 34 in the width direction, on the side being opposite to the connection port 37 side. The leading end exposing portions 40 are each provided with an opening that is in communication with the corresponding guide groove 38. Thus, the housing 34 is configured such that, upon the conductive member attaching portion 13 being fitted to the housing 34 and the projecting portions 17 being fitted into the guide grooves 38, the ends of the projecting portions 17 are exposed to the outside from the leading end exposing portions 40.

Due to the above-described configuration, the leading end exposing portions 40 provided as cutout portions in the housing 34 are configured to expose a part of the leading end portion of the conductive member attaching portion 13 to the outside, with the conductive member attaching portion 13 fitted to the housing 34, and with the plurality of terminals 35 electrically connected to the plurality of conductors 102 in the conductive member 100. Note that, as mentioned above, this embodiment describes the leading end exposing portions 40 in an exemplary mode in which the ends of the projecting portions 17, which serve as a part of a leading end portion of the conductive member attaching portion 13, are exposed to the outside.

Connection Between First Connector and Second Connector

Figure 29:
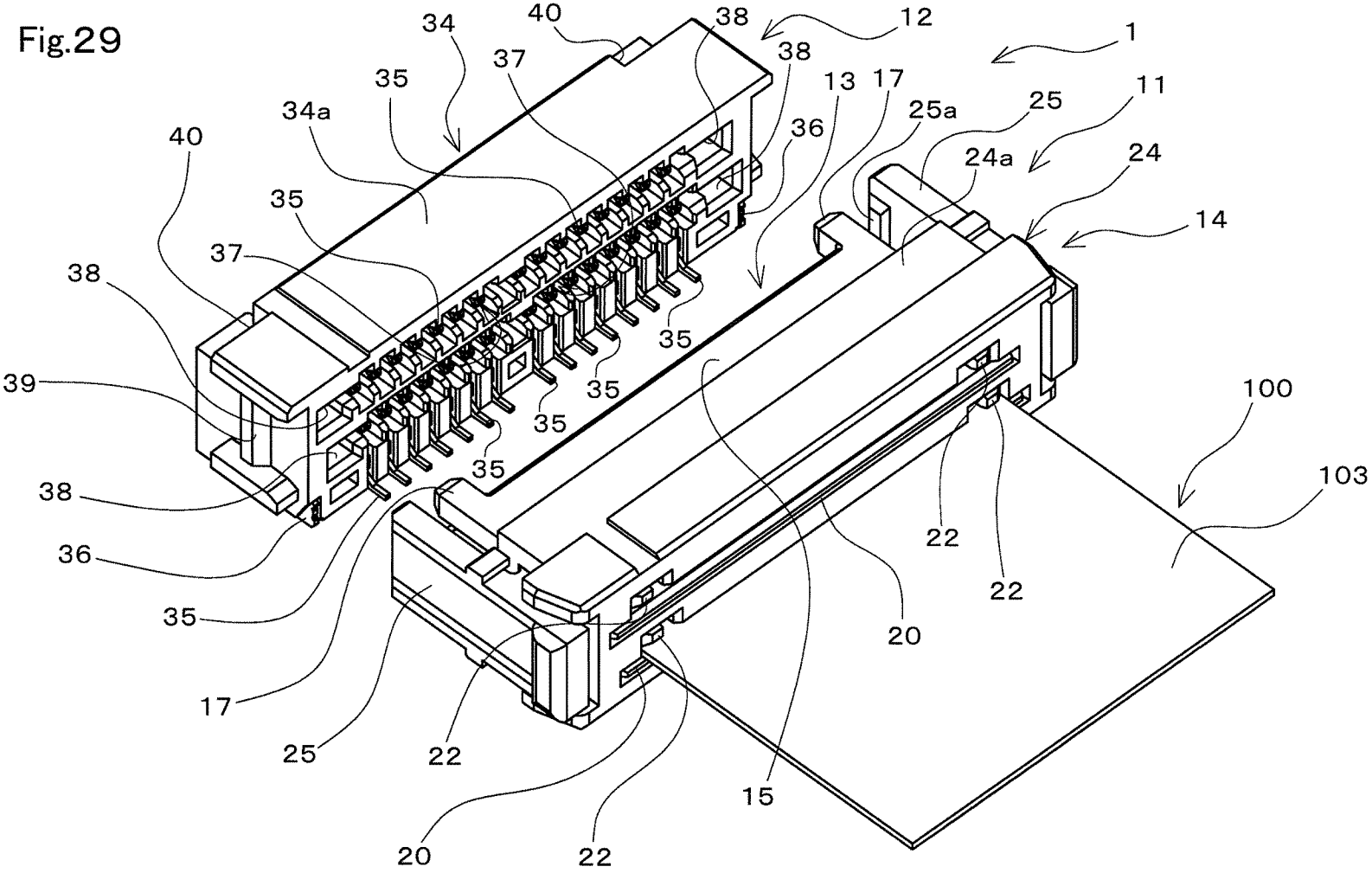
FIG. 29 is a perspective view showing the electrical connection device in a state before the first connector is connected to the second connector, together with a part of a conductive member.
Figure 30A:
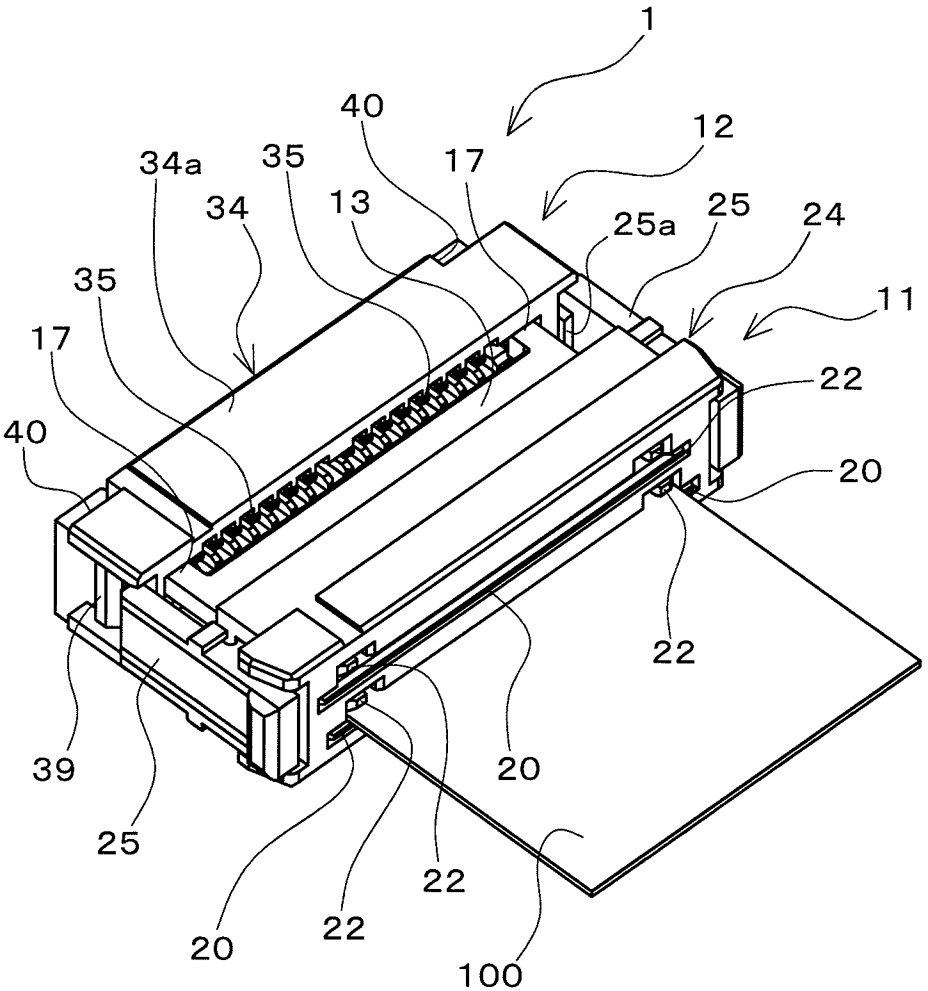
FIG. 30A is a perspective view showing the electrical connection device in the middle of the first connector being connected to the second connector, together with a part of a conductive member.
Figure 30B:
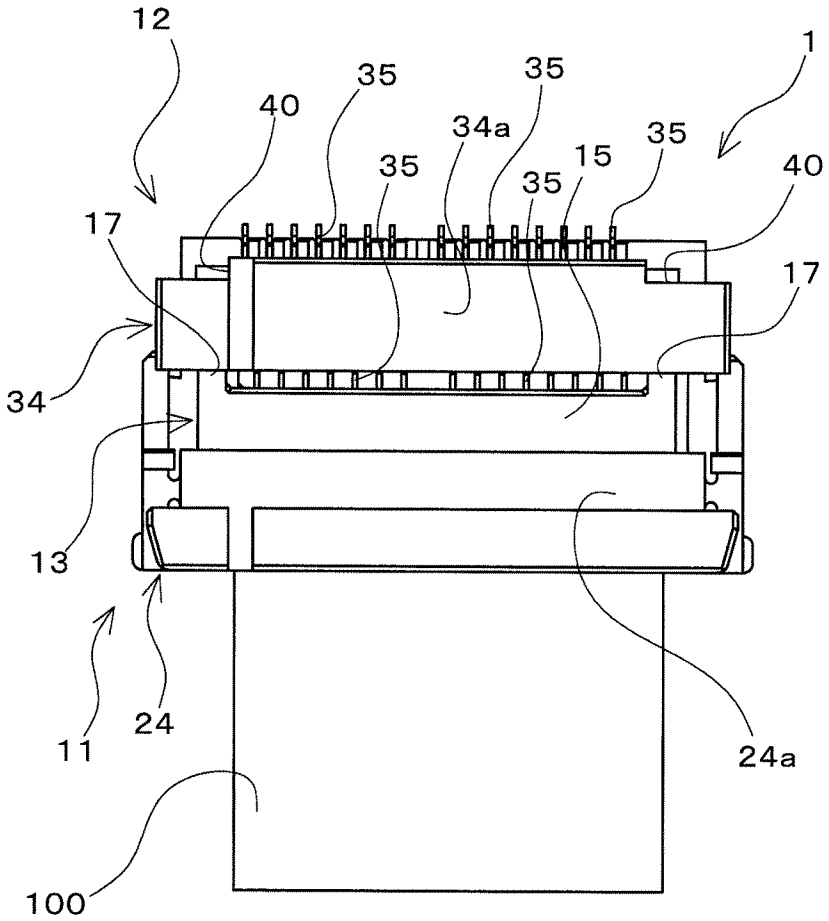
FIG. 30B is a plan view showing the electrical connection device in the middle of the first connector being connected to the second connector, together with a part of a conductive member.
Figure 31A:
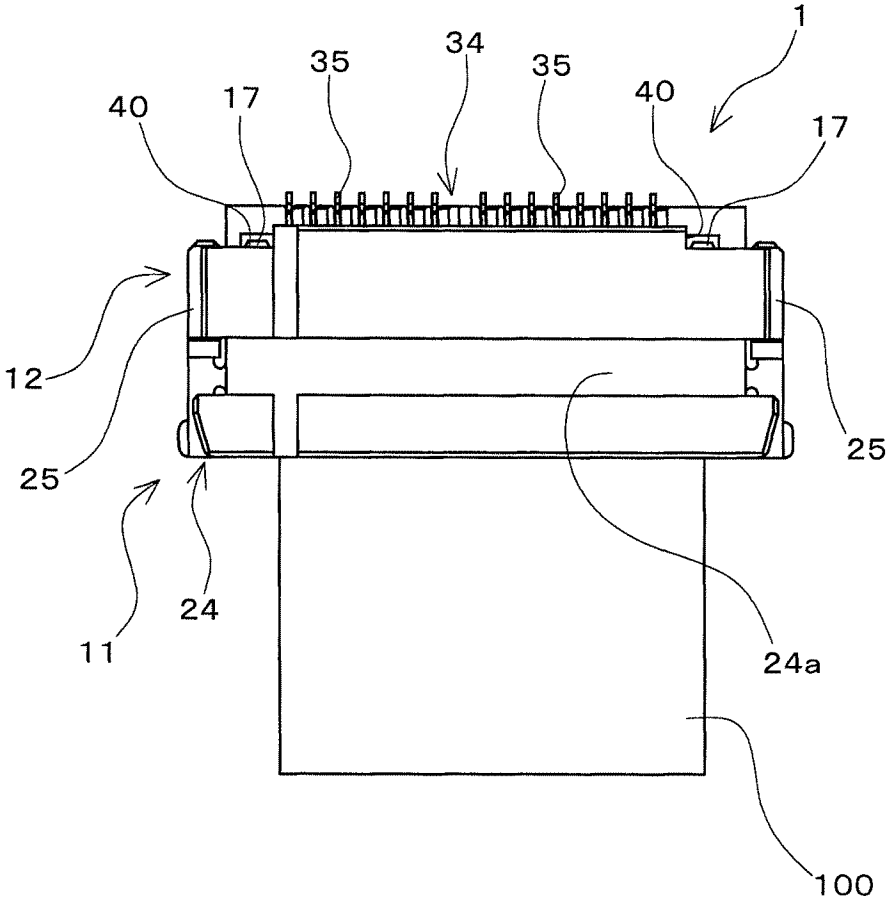
FIG. 31A is a plan view showing the electrical connection device with the first connector connected to the second connector, together with a part of a conductive member.
Figure 31B:
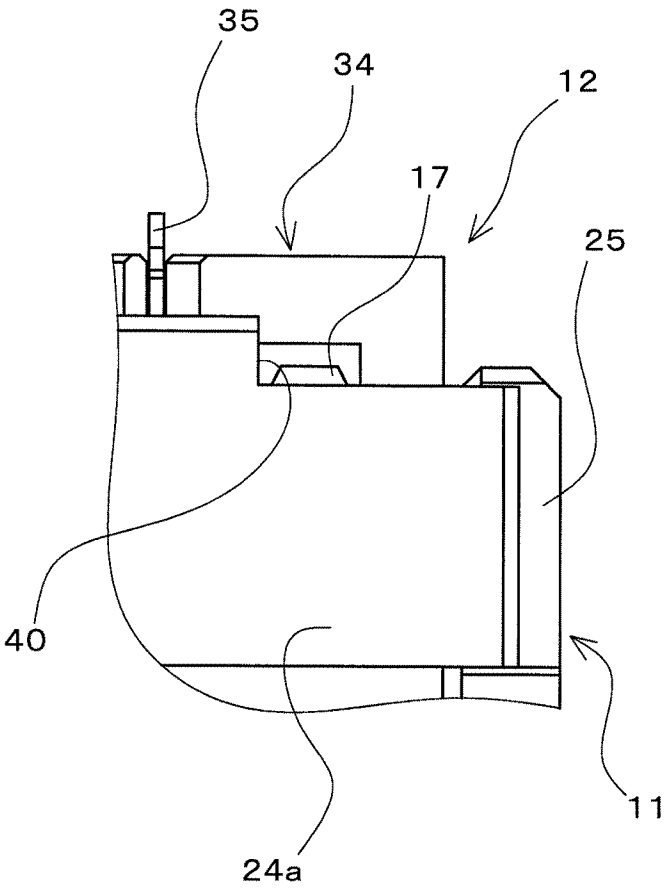
FIG. 31B is a diagram showing the electrical connection device with the first connector connected to the second connector, together with a part of a conductive member, enlarging a part of FIG. 31A.

Next, a configuration regarding the connection between the first connector 11 and the second connector 12 will be described in more detail. FIG. 29 is a perspective view showing the electrical connection device 1 in a state before the first connector 11 is connected to the second connector 12, together with a part of the conductive member 100. FIG. 30A is a perspective view showing the electrical connection device 1 in the middle of the first connector 11 being connected to the second connector 12, together with a part of the conductive member 100. FIG. 30B is a plan view showing the electrical connection device 1 in the middle of the first connector 11 being connected to the second connector 12, together with a part of the conductive member 100. FIG. 31A is a plan view showing the electrical connection device 1 with the first connector 11 connected to the second connector 12, together with a part of the conductive member 100. FIG. 31B is a diagram showing the electrical connection device 1 with the first connector 11 connected to the second connector 12, together with a part of the conductive member 100, enlarging a part of FIG. 31A.

Note that FIGS. 29 to 31B omit the substrate 101 to which the second connector 12 is connected. FIGS. 29 to 31B show an exemplary mode in which the first connector 11, to which one conductive member 100 has been connected, is connected to the second connector 12. Also, FIGS. 29 to 31B show an exemplary state where, in the first connector 11, a conductive member attaching portion 13 to which a conductive member 100 has been attached, and a conductive member attaching portion 13 to which no conductive member 100 is attached, have been fitted into the holder portion 14.

As shown in FIG. 29, when the first connector 11 and the second connector 12 are connected, initially, a connecting operation is started with the leading end side of the conductive member attaching portion 13 in the first connector 11 opposing the connection port 37 in the second connector 12. At this time, an operation to connect the first connector 11 and the second connector 12 is started with the upper face portion 15 of each conductive member attaching portion 13, the upper face 24*a* of the body portion 24 of the holder portion 14, and the upper face 34*a* of the housing 34 corresponding to one another, and with the lower face portion 16 of each conductive member attaching portion 13, the lower face 24*b* of the body portion 24 of the holder portion 14, and the lower face 34*b* of the housing 34 corresponding to one another.

Upon an operation to connect the first connector 11 and the second connector 12 being started, initially, the projecting portions 17 of the conductive member attaching portion 13 of the first connector 11 are inserted into the respective guide grooves 38 in the connection port 37 in the housing 34 of the second connector 12, as shown in FIGS. 30A and 30B. At this time, the pair of projecting portions 17 of the conductive member attaching portion 13, which has been fitted to the fitting hole 27 in the first connector 11 on the upper face 24*a* side of the body portion 24, are inserted into the pair of guide grooves 38 in the connection port 37 in the second connector 12 on the upper face 34*a* side of the housing 34. Also, the pair of projecting portions 17 of the conductive member attaching portion 13, which has been fitted to the fitting hole 27 in the first connector 11 on the lower face 24*b* side of the body portion 24, are inserted into the pair of guide grooves 38 in the connection port 37 in the second connector 12 on the lower face 34*b* side of the housing 34. The projecting portions 17 inserted into the respective guide grooves 38 as described above are further inserted toward the distal side while being guided along the guide grooves 38, and are fitted into the guide grooves 38.

Upon the projecting portions 17 being fitted up to the distal side of the guide grooves 38, the portion of each conductive member attaching portion 13 in which the opening portions 23 are provided is fitted into the connection port 37 of the housing 34. Then, when in a state where the first connector 11 has been connected to the second connector 12 as shown in FIGS. 31A and 31B, a state is entered where each conductive member attaching portion 13 has been fitted into the corresponding connection port 37 in the housing 34 until an end of the holder portion 14 abuts against an end of the housing 34. That is to say, when in a state where the first connector 11 has been connected to the second connector 12, a state is entered where an end of the body portion 24 on the fitting hole 27 side, to which the conductive member attaching portion 13 is fitted, abuts against an end of the housing 34 on the side where the connection port 37 is open. Also, when in a state where the first connector 11 has been connected to the second connector 12, the portion of the conductive member attaching portion 13 in which the opening portions 23 are provided enters a state of having been entirely fitted to the inside of the connection port 37 of the housing 34.

Upon the first connector 11 and the second connector 12 being connected as described above, the plurality of conductors 102 in the conductive member 100 come into contact with the plurality of terminals 35 within the connection ports 37, and the terminals 35 and the conductors 102 enter a state of being electrically connected to each other.

Furthermore, when in a state where the first connector 11 and the second connector 12 have been connected, the pair of lock arm portions 25 of the holder portion 14 enter a state of being engaged, at the engaging pawl portions 25*a*, with the pair of lock protruding portions 39 of the housing 34. Thus, the holder portion 14 is engaged with the housing 34 at the lock arm portions 25 with the conductive member attaching portions 13, which have been fitted to the fitting holes 27 in the holder portion 14, further fitted to the connection ports 37 in the housing 34. As a result, the first connector 11 is locked and held with respect to the second connector 12. Also, when in a state where the first connector 11 and the second connector 12 have been connected, ends of the projecting portions 17 of the conductive member attaching portions 13 enter a state of being exposed to the outside at the leading end exposing portions 40 in the housing 34.

Figure 32A:
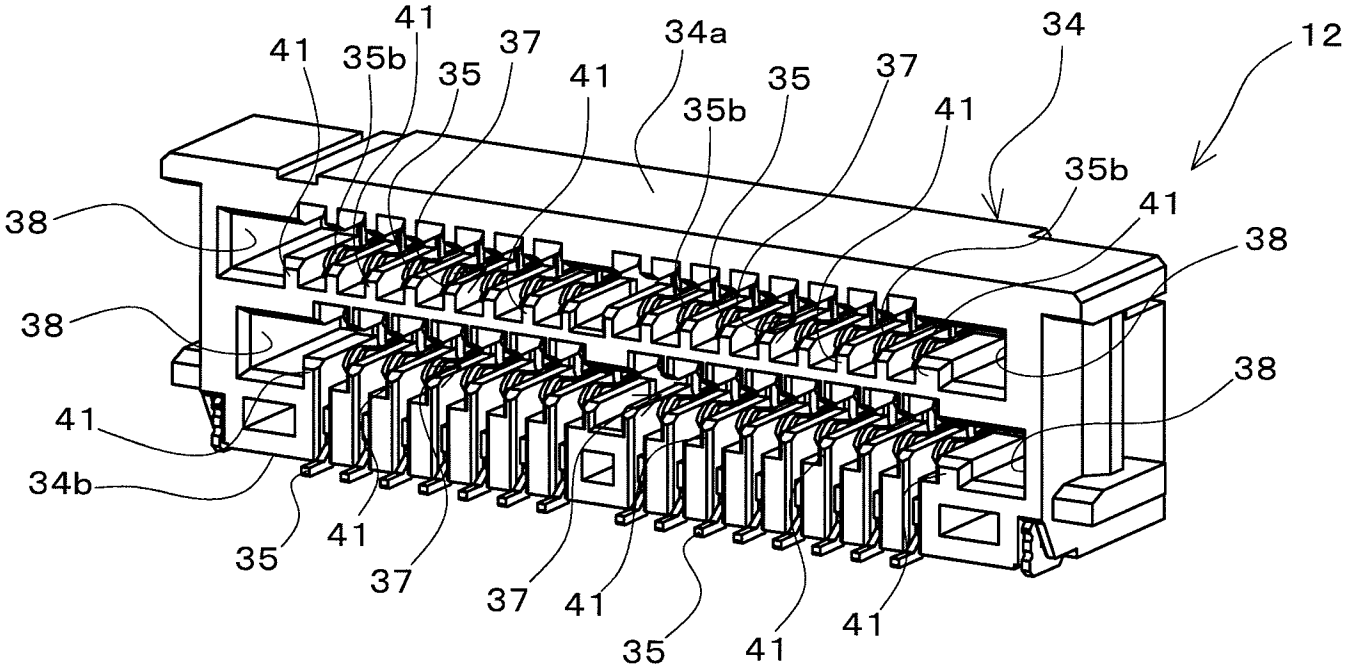
FIGS. 32A and 32B show the first connector and the second connector in the electrical connection device arranged side-by-side.
Figure 32B:
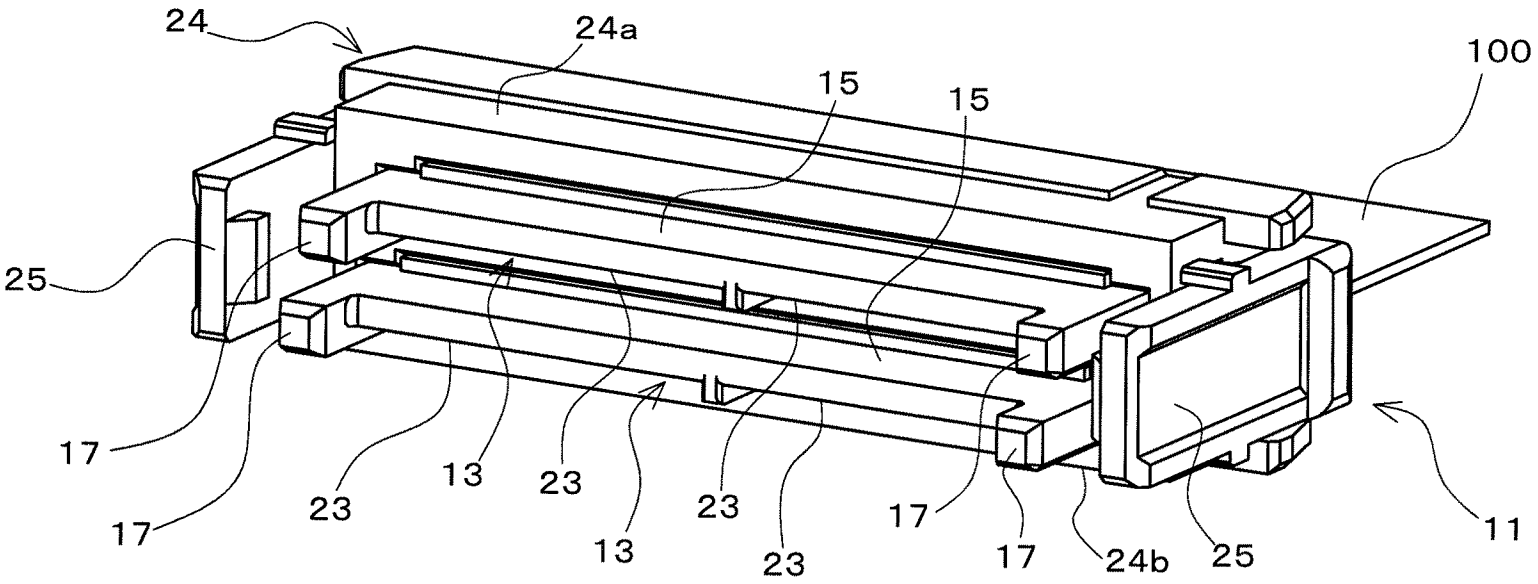

Here, a description will be given, with reference to FIGS. 32A and 32B, of a configuration for preventing the first connector 11 from being connected, upside down, to the second connector 12. FIGS. 32A and 32B show the first connector 11 and the second connector 12 in the electrical connection device 1 arranged side-by-side. FIG. 32A is a perspective view of the second connector 12. FIG. 32B is a perspective view showing the first connector 11 together with a part of the conductive member 100.

In each conductive member attaching portion 13 in the first connector 11, the opening portions 23 are provided on the leading end side of the lower face portion 16 side. On the other hand, the opening portions 23 are not provided on the leading end side on the upper face portion 15 side of each conductive member attaching portion 13. The upper face portion 15 is configured to be further elongated to the leading end side than the lower face portion 16. Thus, each projecting portion 17 is configured such that the projecting length of the projecting portions 17 relative to the lower face portion 16 is longer than the projecting length relative to the upper face portion 15. For this reason, in the conductive member attaching portion 13, the positions of each projecting portion 17 relative to the upper face portion 15 and the lower face portion 16 are set asymmetrically in the projecting direction of the projecting portion 17.

The housing 34 of the second connector 12 is provided with the connection ports 37 to each of which the leading end side of the conductive member attaching portion 13 is fitted. The guide grooves 38 are provided in respective end portions of the connection ports 37 in the width direction. In a portion of the connection ports 37 extending in the housing 34 in the width direction excluding the guide grooves 38, a plurality of grooves are provided into which the pairs of holding portions are fitted, the holding portions being provided in the terminals 35 as portions for sandwiching the end portion 100*a* of the conductive member 100 in the thickness direction. The grooves into which the aforementioned pairs of holding portions are fitted are provided as grooves that are recessed to the upper face 34*a* side and the lower face 34*b* side relative to the connection ports 37 that extend in the width direction of the housing 34.

The guide grooves 38 are provided at positions closer to the lower face 34*b* side relative to the portions of the connection ports 37 that extend in the width direction of the housing 34 excluding the guide grooves 38. Thus, the housing 34 is provided with the guide grooves 38 that correspond to the projecting portions 17, whose positions relative to the upper face portion 15 and the lower face portion 16 of the conductive member attaching portion 13 are set asymmetrically. The housing 34 is also provided with lower face-side abutting portions 41, which demarcate grooves into which the conductor connecting portions 35*b* arranged on the lower face 34*b* side in the pair of holding portions are fitted, among the aforementioned grooves into which the pairs of holding portions of the terminals 35 are fitted. A plurality of lower face-side abutting portions 41 are arranged side-by-side in the width direction of the housing 34 on the lower face 34*a* side in the connection ports 37.

A correct and appropriate state regarding the up-down direction refers to a state where the upper face portion 15 of the conductive member attaching portion 13 corresponds to the upper face 34*a* of the housing 34, and the lower face portion 16 of the conductive member attaching portion 13 corresponds to the lower face 34*b* of the housing 34. Upon the leading end side of the conductive member attaching portion 13 being fitted to the corresponding connection port 37 in the correct and appropriate state regarding the up-down direction, the projecting portions 17 are fitted into the respective guide grooves 38, and the upper face portion 15 of the conductive member attaching portion 13 is inserted into the connection port 37 while sliding against the upper face 34*a* side of the connection port 37.

On the other hand, if the correspondence between the conductive member attaching portion 13 and the housing 34 regarding the up-down direction is opposite to the above-described state, it is an inappropriate state where the up-down direction is incorrect. That is to say, a state where the upper face portion 15 of the conductive member attaching portion 13 corresponds to the lower face 34*b* of the housing 34, and the lower face portion 16 of the conductive member attaching portion 13 corresponds to the upper face portion

34*a* of the housing 34, is an inappropriate state where the up-down direction is incorrect. Upon the leading end side of the conductive member attaching portion 13 being fitted to the connection port 37 in an inappropriate state where the up-down direction is incorrect, the projecting portions 17 are inserted into the respective guide grooves 38 so as to be fitted into the respective guide grooves 38, but the ends of the upper face portion 15 of the conductive member attaching portion 13 on the leading end side abut against the plurality of lower face-side abutting portions 41. For this reason, if an operator who performs the operation to connect the first connector 11 to the second connector 12 tries to insert the conductive member attaching portion 13 to the housing 34 upside down, the operator cannot insert the conductive member attaching portion 13 to the housing 34, and cannot fit the conductive member attaching portion 13 to the housing 34. For this reason, in the electrical connection device 1, the first connector 11 is prevented from being connected, upside down, to the second connector 12.

Effects of this Embodiment

According to this embodiment, the end portion 100*a* of the conductive member 100 inserted in the insertion hole 26 is attached to the conductive member attaching portion 13. Then, in this state, the conductive member attaching portion 13 is fitted to the holder portion 14. With the engaging portions 106 of the conductive member 100 engaged with the engaged portions 30 of the holder portion 14, a part of the insertion hole 26 in the holder portion 14 is closed by the closing portion 20 of the conductive member attaching portion 13. For this reason, the conductive member 100 connected to the connector 11 (first connector 11) is held in a state of being engaged with the holder portion 14 of the connector 11. In addition, as a result of a part of the insertion hole 26 in the holder portion 14 being closed by the conductive member attaching portion 13, the conductive member 100 is prevented from falling out of the insertion hole 26 and coming off the connector 11. Thus, the connector 11 can firmly hold the connected conductive member 100.

Accordingly, this embodiment can provide a connector 11 capable of preventing a conductive member 100, which is configured as a flexible cable or a flexible board having a plurality of conductors 102, from coming off, and capable of firmly holding the conductive member 100. Furthermore, this embodiment can provide an electrical connection device 1 that includes this connector 11.

As mentioned above, according to this embodiment, the conductive member 100 can be prevented from coming off, and can be firmly held. Since the conductive member 100, on which the plurality of conductors 102 are densely arranged, is connected to the connector 11, a compact and simple structure can be achieved. Accordingly, according to this embodiment, a compact and simple structure can be achieved, and the conductive member 100 can be prevented from coming off, and can be firmly held. The electrical connection device 1 can be stably used even in a harsh environment in which a load, such as vibrations, is likely to be applied to the connector 11, for example.

According to this embodiment, the end portion 100*a* of the conductive member 100 is attached to the conductive member attaching portion 13 as a result of the end portion 100*a* of the conductive member 100 being inserted into the insertion slot 19, which is demarcated by the casing portion 18 of the conductive member attaching portion 13. For this reason, when in a state where the end portion 100*a* of the conductive member 100 has been attached to the conductive member attaching portion 13, a given region of the end portion 100*a* of the conductive member 100 in the longitudinal direction of the conductive member 100 is circumferentially covered and enclosed by the casing portion 18 of the conductive member attaching portion 13. Thus, the conductive member 100 is prevented from bending in the width direction. As a result of the bending of the conductive member 100 in the width direction being prevented, an operation to connect the conductive member 100 to the connector 11 is facilitated, and the operability can be improved. Furthermore, as a result of the bending of the conductive member 100 in the width direction being prevented when the connector 11, to which the conductive member 100 has been connected, is fitted and thus connected to the counterpart second connector 12, it is possible to prevent a fitting failure that leads to electrical contact failure between the conductors 102 in the conductive member 100 and the terminals 35 in the second connector 12.

According to this embodiment, the closing portion 20 is fitted into the insertion hole 26 to more firmly close a part of the insertion hole 26. Accordingly, it is possible to more reliably prevent the conductive member 100 from coming off, and more firmly hold the conductive member 100.

According to this embodiment, the closing portion 20 closes a part of the insertion hole 26 so as to close at least the engaging portion passage region 28*a*. Accordingly, it is possible to more reliably prevent the engaging portions 106 of the conductive member 100 from coming off the engaged portions 30 of the holder portion 14 and passing through the insertion hole 26. Thus, the conductive member 100 can be more firmly held.

According to this embodiment, the closing portion 20 closes a part of the insertion hole 26 so as to close the conductive member passage region 28. Accordingly, the conductive member 100 can be more reliably prevented from coming off, and can be more firmly held.

According to this embodiment, the end portion 100*a* of the conductive member 100 is sandwiched in the front-back face direction by the bending restriction portion 21 in a center part of the conductive member attaching portion 13 in the width direction. Thus, bending deformation of the end portion 100*a* of the conductive member 100 is restricted. For this reason, the conductive member 100 is prevented from bending in the width direction. As a result of the bending of the conductive member 100 in the width direction being prevented, an operation to connect the conductive member 100 to the connector 11 is facilitated, and the operability can be improved. Furthermore, as a result of the bending of the conductive member 100 in the width direction being prevented when the connector 11, to which the conductive member 100 has been connected, is fitted and connected to the counterpart second connector 12, it is possible to prevent a fitting failure that leads to electrical contact failure between the conductors 102 in the conductive member 100 and the terminals 35 in the second connector 12.

According to this embodiment, an operator who performed an operation to connect the first connector 11 to the second connector 12 can visually check whether a part of a leading end portion of the conductive member attaching portion 13 is exposed from the leading end exposing portions 40 of the housing 34. Thus, the operator can readily check whether the first connector 11 and the second connector 12 are appropriately connected with the plurality of terminals 35 and the plurality of conductors 102 electrically connected. Furthermore, according to this embodiment, a structure with which the operator can readily check whether the first connector 11 and the second connector 12 are appropriately connected can be realized by a simple structure in which cutout portions are provided in the housing 34.

According to this embodiment, when an operation is performed to fit the conductive member attaching portion 13 to the housing 34 to connect the first connector 11 to the second connector 12, the projecting portions 17 that project to the leading end side at the respective ends of the conductive member attaching portions 13 in the width direction are guided by the guide grooves 38 in the housing 34. For this reason, the conductive member attaching portion 13 can be readily fitted to the housing 34 as a result of the conductive member attaching portion 13 being guided into the housing 34. Furthermore, failure during the fitting can be prevented from occurring between the conductive member attaching portion 13 and the housing 34.

According to this embodiment, the projecting length of each projecting portion 17 relative to one of the upper face portion 15 and the lower face portion 16 is set to be longer than the projecting length relative to the other one. That is to say, the electrical connection device 1 is configured such that the length by which each projecting portion 17 projects from one of the upper face portion 15 and the lower face portion 16 is longer than the length by which each projecting portion 17 projects relative to the other one of the upper face portion 15 and the lower face portion 16. For this reason, the positions of each projecting portion 17 relative to the upper face portion 15 and the lower face portion 16 are set asymmetrically in the projecting direction of the projecting portion 17. The housing 34 is provided with the guide grooves 38 that correspond to the projecting portions 17, whose positions relative to the upper face portion 15 and the lower face portion 16 of the conductive member attaching portion 13 are set asymmetrically. For this reason, if an operator tries to insert the conductive member attaching portion 13 to the housing 34 upside down, the operator cannot insert the conductive member attaching portion 13 to the housing 34, and cannot fit the conductive member attaching portion 13 to the housing 34. Thus, this embodiment can prevent the first connector 11 from being connected, upside down, to the second connector 12.

Modifications

Although an embodiment of the present invention has been described above, needless to say, all modifications, applications, and equivalents thereof that fall within the claims, for which modifications and applications would become apparent by reading and understanding the present specification, are intended to be embraced in the scope of the present invention. For example, the present invention may be modified and implemented as described below.

Figure 33:
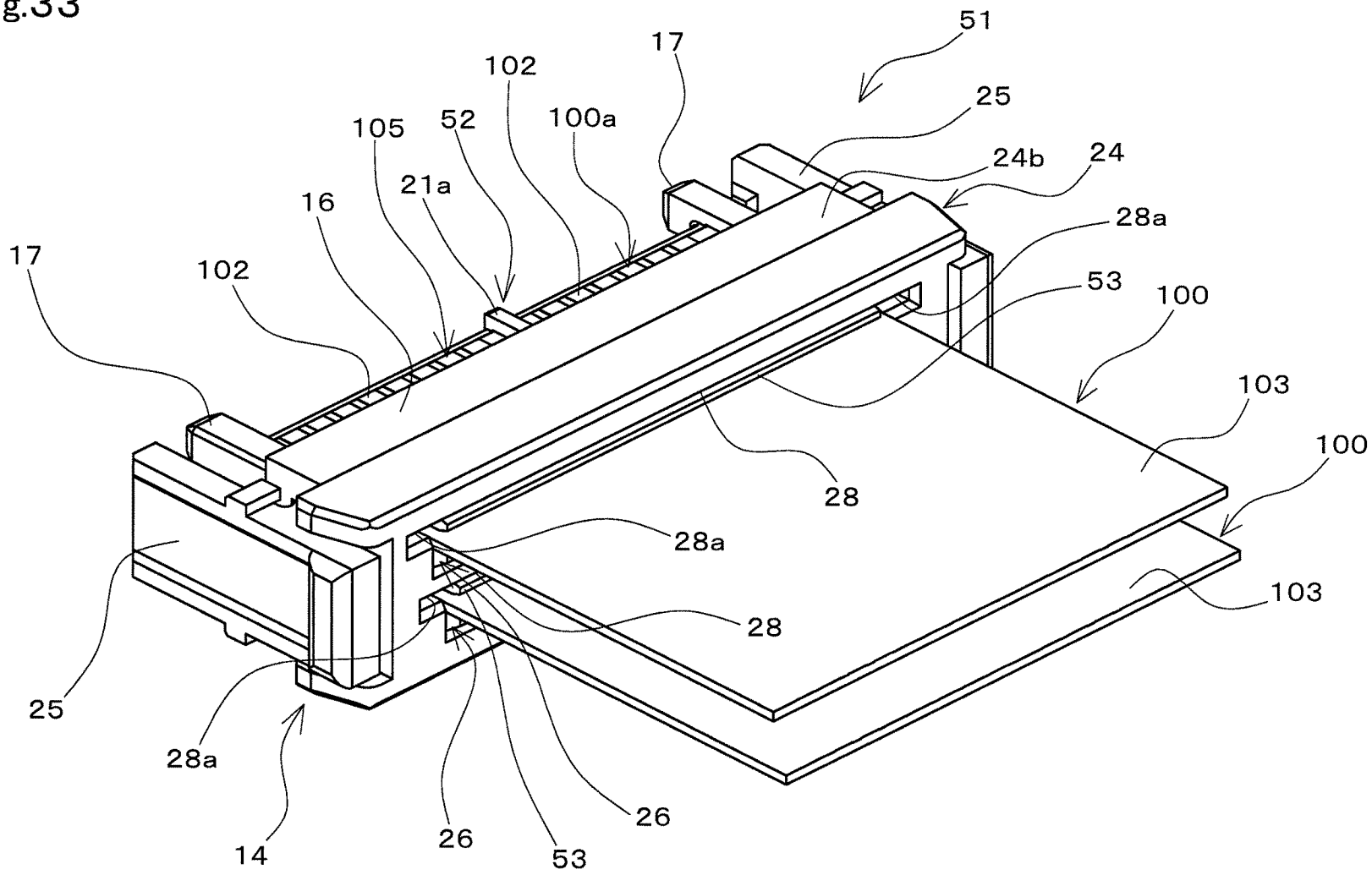
FIG. 33 is a perspective view showing a connector according to a first modification, together with a part of each conductive member.
Figure 34A:
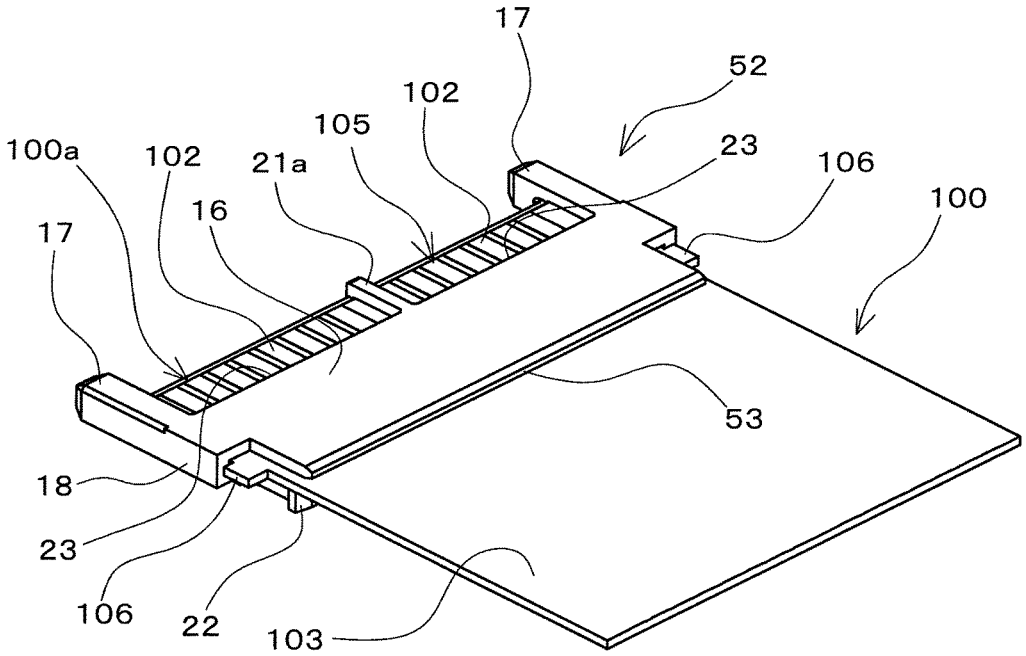
FIG. 34A is a perspective view showing a conductive member attaching portion of the connector according to the first modification, together with a part of a conductive member, when viewed from the lower face portion side.
Figure 34B:
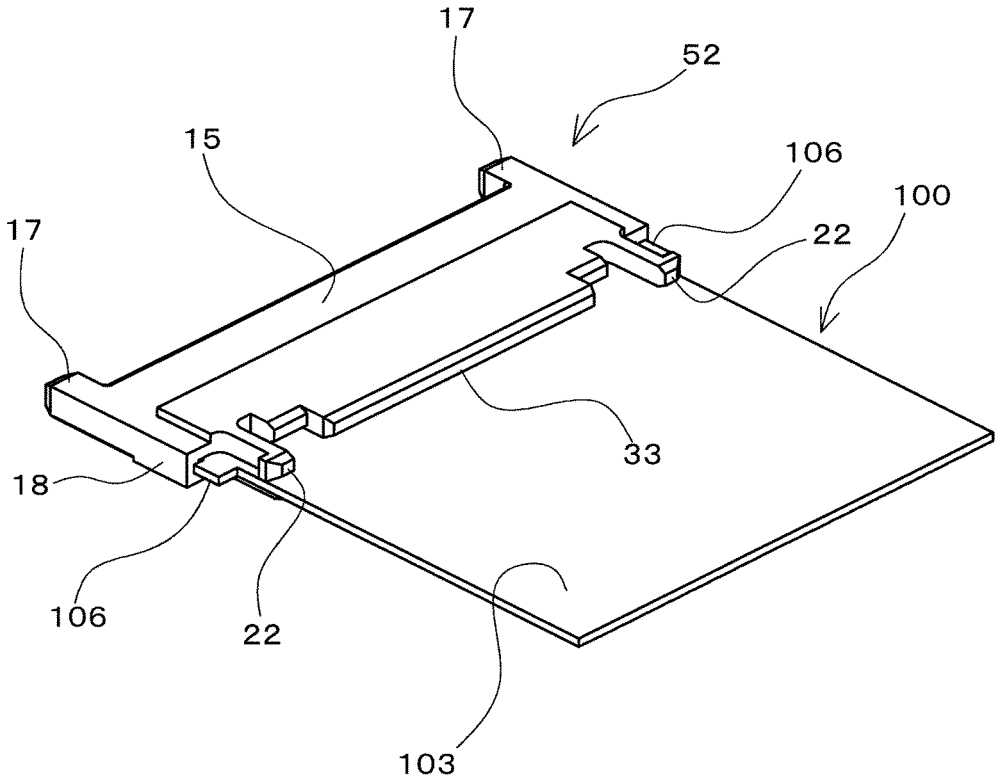
FIG. 34B is a perspective view showing the conductive member attaching portion of the connector according to the first modification, together with a part of a conductive member, when viewed from the upper face portion side.

(1) FIG. 33 is a perspective view showing a connector 51 according to a first modification together with a part of each conductive member 100. FIG. 34A is a perspective view showing a conductive member attaching portion 52 in the connector 51 according to the first modification together with a part of the conductive member 100, when viewed from the lower face portion 16 side. FIG. 34B is a perspective view showing the conductive member attaching portion 52 in the connector 51 according to the first modification together with a part of the conductive member 100, when viewed from the upper face portion 15 side.

The connector 51 according to the first modification is configured similarly to the connector 11 according to the above-described embodiment. However, the connector 51 is different from the above-described connector 11 in the configuration of a closing portion 53 in the conductive member attaching portion 52. The connector 51 according to the first modification will be described below in terms of a configuration that is different from the configuration of the connector 11 according to the above-described embodiment. Elements that are configured similarly to those in the above-described embodiment will be assigned the same signs in the drawings, or will be described by citing the signs of the elements described in the above-described embodiment, to omit redundant descriptions as appropriate.

The conductive member attaching portion 52 of the connector 51 shown in FIGS. 33 to 34B is configured similarly to the conductive member attaching portion 13 according to the above-described embodiment. However, the conductive member attaching portion 52 is different, in the configuration of the closing portion 53, from the conductive member attaching portion 13 according to the above-described embodiment. The closing portion 53 is configured to close only a partial region in the insertion hole 26, the partial region being other than the engaging portion passage region 28*a* in the conductive member passage region 28, with the engaging portions 106 of the conductive member 100 engaged with the engaged portions 30, when the conductive member attaching portion 52, to which the end portion 100*a* of the conductive member 100 inserted in the insertion hole 26 in the holder portion 14 has been attached, has been fitted into the holder portion 14. That is to say, the closing portion 20 according to the above-described embodiment is configured to close the entire conductive member passage region 28 that includes the engaging portion passage region 28*a*. In contrast, the closing portion 53 is configured to close the region in the conductive member passage region 28 excluding the engaging portion passage region 28*a*.

Note that FIGS. 33 to 34B show an exemplary mode of the closing portion 53 that closes the entire region of the conductive member passage region 28 other than the engaging portion passage region 28*a*. However, this need not be the case. A mode of the closing portion that closes a part of the region in the conductive member passage region 28 excluding the engaging portion passage region 28*a* may also be implemented.

Also, an electrical connection device may be implemented in a mode in which a first connector 51, which is configured as a connector 51 according to the first modification, and a second connector 12 according to the above-described embodiment are provided.

According to this modification, the closing portion 53 closes a part of the insertion hole 26 so as to close the region in the conductive member passage region 28 excluding the engaging portion passage region 28*a*. Accordingly, it is possible to more reliably prevent the engaging portions 106 of the conductive member 100 from coming off the engaged portions 30 of the holder portion 14 and passing through the insertion hole 26. Thus, the conductive member 100 can be more firmly held.

Figure 35:
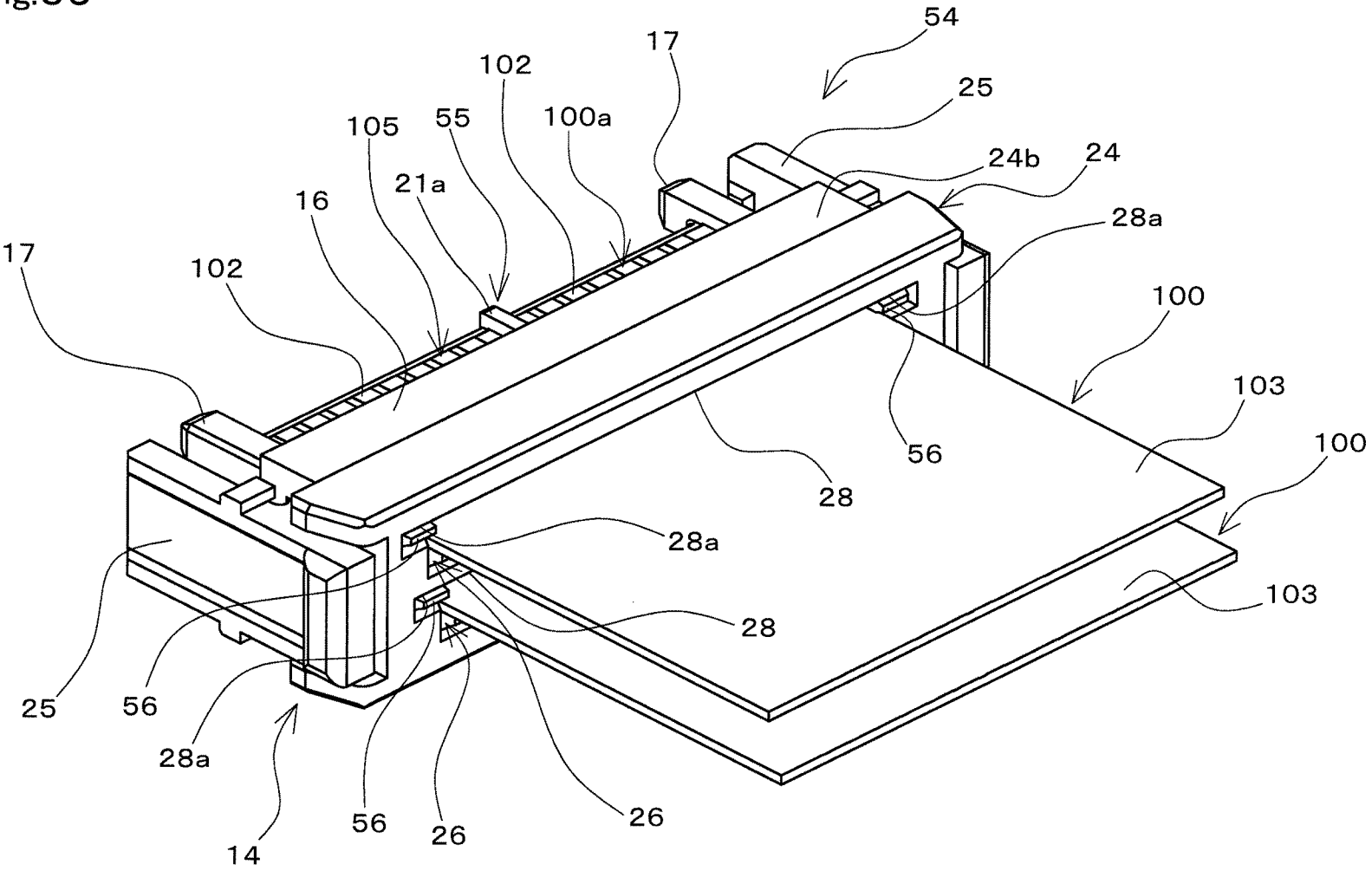
FIG. 35 is a perspective view showing a connector according to a second modification, together with a part of each conductive member.
Figure 36A:
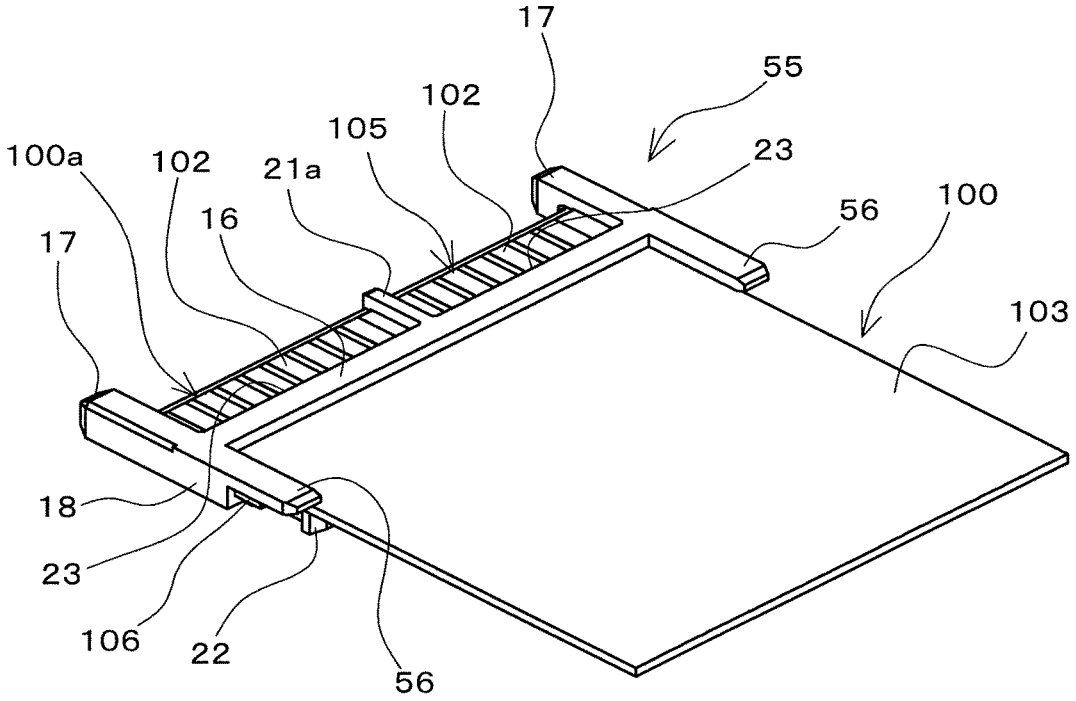
FIG. 36A is a perspective view showing a conductive member attaching portion of the connector according to the second modification, together with a part of a conductive member, when viewed from the lower face portion side.
Figure 36B:
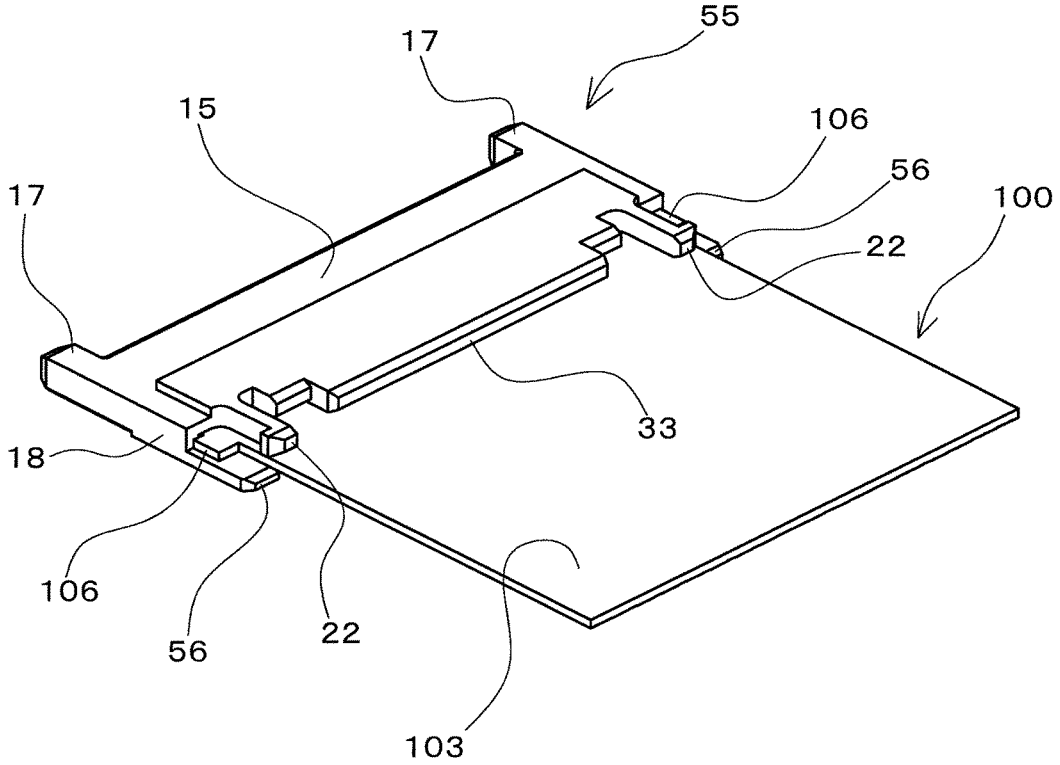
FIG. 36B is a perspective view showing the conductive member attaching portion of the connector according to the second modification, together with a part of a conductive member, when viewed from the upper face portion side.

(2) FIG. 35 is a perspective view showing a connector 54 according to a second modification together with a part of each conductive member 100. FIG. 36A is a perspective view showing a conductive member attaching portion 55 in the connector 54 according to the second modification together with a part of the conductive member 100, when viewed from the lower face portion 16 side. FIG. 36B is a perspective view showing the conductive member attaching portion 55 in the connector 54 according to the second modification together with a part of the conductive member 100, when viewed from the upper face portion 15 side.

The connector 54 according to the second modification is configured similarly to the connector 11 according to the above-described embodiment. However, the connector 54 is different from the above-described connector 11 in the configuration of a closing portion 56 in the conductive member attaching portion 55. The connector 54 according to the second modification will be described below in terms of a configuration that is different from the configuration of the connector 11 according to the above-described embodiment. Elements that are configured similarly to those in the above-described embodiment will be assigned the same signs in the drawings, or will be described by citing the signs of the elements described in the above-described embodiment, to omit redundant descriptions as appropriate.

The conductive member attaching portion 55 of the connector 54 shown in FIGS. 35 to 36B is configured similarly to the conductive member attaching portion 13 according to the above-described embodiment. However, the conductive member attaching portion 55 is different from the conductive member attaching portion 13 according to the above-described embodiment in the configuration of the closing portion 56. The closing portion 56 is configured to close only a partial region of the insertion hole 26, the partial region being the engaging portion passage region 28*a* in the conductive member passage region 28, with the engaging portions 106 of the conductive member 100 engaged with the engaged portions 30, when the conductive member attaching portion 55, to which the end portion 100*a* of the conductive member 100 inserted in the insertion hole 26 in the holder portion 14 has been attached, has been fitted into the holder portion 14. That is to say, the closing portion 20 according to the above-described embodiment is configured to close the entire conductive member passage region 28 that includes the engaging portion passage region 28*a*. In contrast, the closing portion 56 is configured to close only the engaging portion passage region 28*a* in the conductive member passage region 28.

Also, an electrical connection device may be implemented in a mode in which a first connector 54, which is configured as the connector 54 according to the second modification, and the second connector 12 according to the above-described embodiment are provided.

According to this modification, the closing portion 56 closes a part of the insertion hole 26 so as to close the engaging portion passage region 28*a* in the conductive member passage region 28. Accordingly, it is possible to more reliably prevent the engaging portions 106 of the conductive member 100 from coming off the engaged portions 30 of the holder portion 14 and passing through the insertion hole 26. Thus, the conductive member 100 can be more firmly held.

Figure 37:
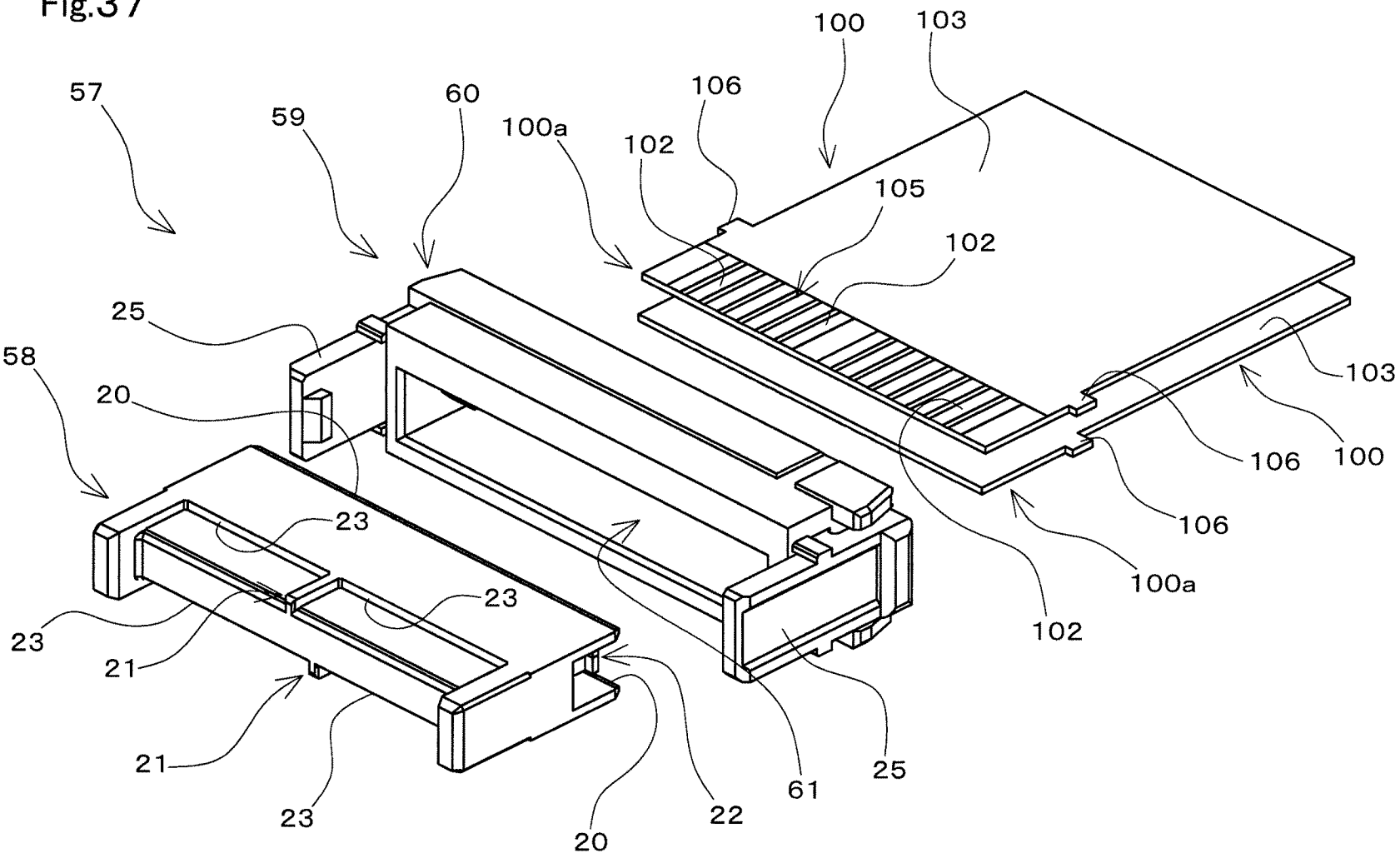
FIG. 37 is an exploded perspective view of a connector according to a third modification, together with a part of each conductive member.
Figure 38A:
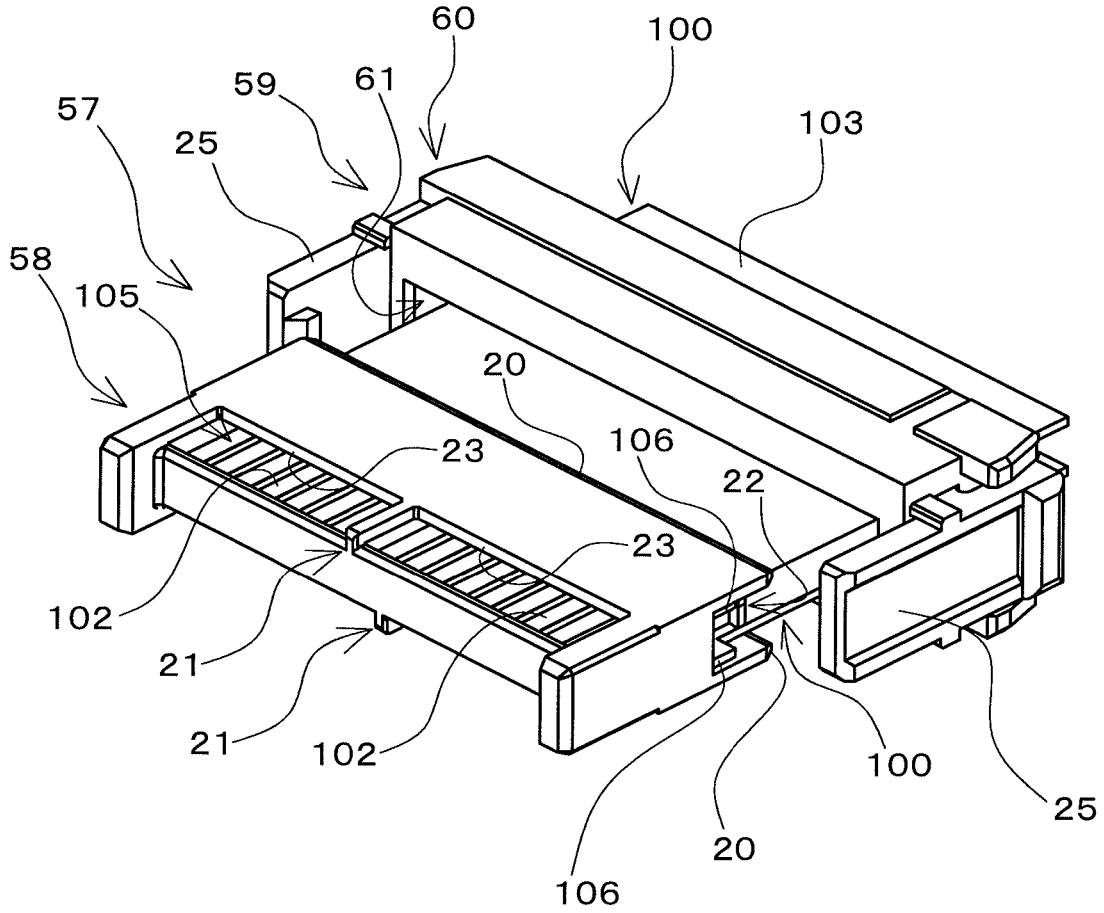
FIG. 38A is a perspective view showing the connector according to the third modification, together with a part of each conductive member, in a state before a conductive member attaching portion is fitted to a holder portion.
Figure 38B:
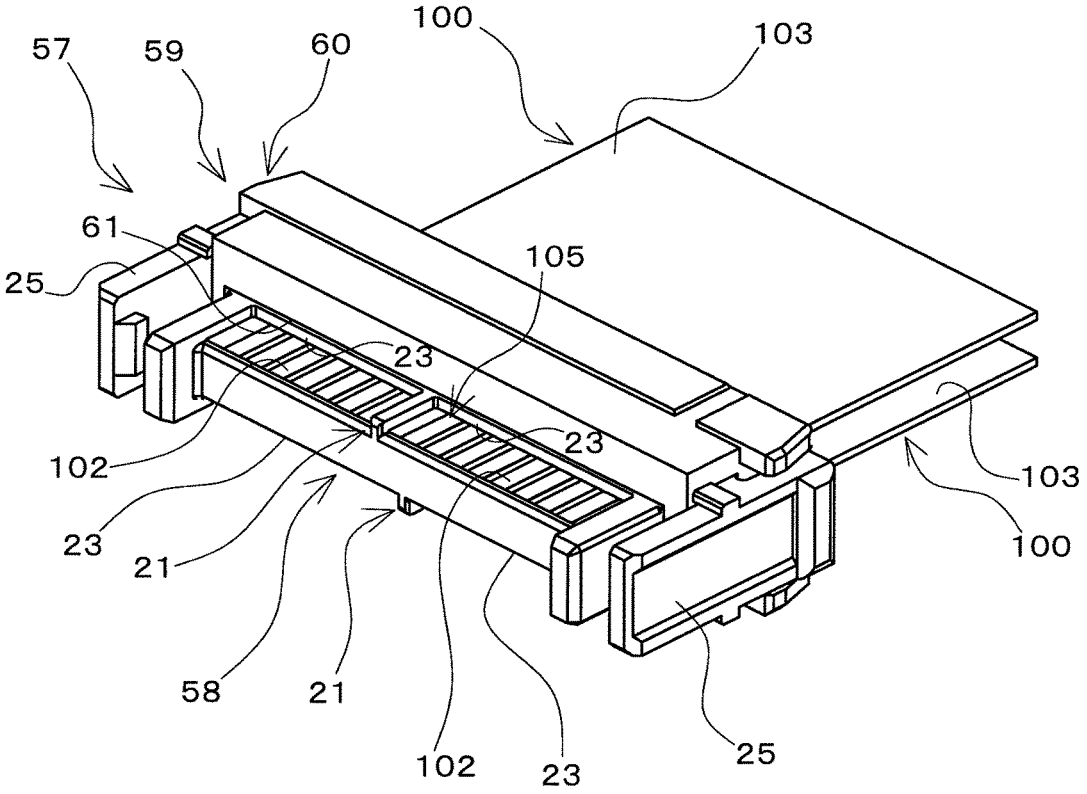
FIG. 38B is a perspective view showing the connector according to the third modification, together with a part of each conductive member, with the conductive member attaching portion fitted to the holder portion.

(3) FIG. 37 is an exploded perspective view of a connector 57 according to a third modification together with a part of each conductive member 100. FIG. 38A is a perspective view showing the connector 57 according to the third modification together with a part of each conductive member 100, in a state before a conductive member attaching portion 58 is fitted to a holder portion 59. FIG. 38B is a perspective view showing the connector 57 according to the third modification together with a part of each conductive member 100, with the conductive member attaching portion 58 fitted to the holder portion 59.

The connector 57 according to the third modification is configured similarly to the connector 11 according to the above-described embodiment. However, the connector 57 is different from the above-described connector 11 in terms of being configured such that one conductive member attaching portion 58, to which the end portions 100*a* of two conductive members 100 have been attached, is fitted to one holder portion 59. The connector 57 according to the third modification will be described below in terms of a configuration that is different from the configuration of the connector 11 according to the above-described embodiment. Elements that are configured similarly to those in the above-described embodiment will be assigned the same signs in the drawings, or will be described by citing the signs of the elements described in the above-described embodiment, to omit redundant descriptions as appropriate.

The connector 57 shown in FIGS. 37 to 38B is configured to include the conductive member attaching portion 58 and the holder portion 59. The conductive member attaching portion 58 is different from the conductive member attaching portion 13 according to the above-described embodiment in terms of being configured such that the end portions 100*a* of two conductive members 100 are attached to the conductive member attaching portion 58. The conductive member attaching portion 58 is provided with two closing portions 20. The conductive member attaching portion 58 is provided with engaging projecting portions 22 between the two closing portions 20 on respective sides of the conductive member attaching portion 58 in the width direction.

The conductive member attaching portion 58 is also provided with two opening portions 23 on each of the respective sides in the thickness direction. The two opening portions 23 provided on respective sides of the conductive member attaching portion 58 in the thickness direction are provided side by side in the width direction of the conductive member attaching portion 58, with the bending restriction portion 21 therebetween.

Two conductive members 100 are attached to the conductive member attaching portion 58 with faces of the conductive members 100 on which the conductor-exposing portion 105 is not provided opposing each other. Accordingly, upon two conductive members 100 being attached to the conductive member attaching portion 58, the conductor-exposing portions 105 of the conductive members 100 enter a state of being exposed to the outside of the conductive member attaching portion 58 on respective sides of the conductive member attaching portion 58 in the thickness direction.

The holder portion 59 is configured to include a body portion 60, the lock arm portions 25, and the like. The body portion 60 is provided with one fitting hole 61, unlike the body portion 24 of the holder portion 14 according to the above-described embodiment. The one fitting hole 61 is configured to be in communication with both of the two insertion holes 26 provided in the body portion 60. Note that, although not shown in FIGS. 37 to 38B, the two insertion holes 26 are provided so as to be open on the side opposite to the side where the fitting hole 61 is open in the body portion 60. Unlike the two insertion holes 26 provided in the body portion 24 according to the above-described embodiment, the two insertion holes 26 provided in the body portion 60 are provided side-by-side in the thickness direction of the holder portion 59 in the body portion 60, with the orientations of the insertion holes 26 in the thickness direction of the holder portion 59 opposite each other.

The fitting hole 61 is configured such that the conductive member attaching portion 58, to which the end portions 100*a* of the conductive members 100 inserted in the two respective insertion holes 26 have been attached, is fitted into the fitting hole 61. When the conductive member attaching portion 58, to which the two conductive members 100 have been attached, is fitted to the holder portion 59, the conductive member attaching portion 58 is inserted into the fitting hole 61 at an end where the two closing portions 20 are provided (see FIG. 38A). When in a state where the conductive member attaching portion 58 has been fitted to holder portion 61 as shown in FIG. 38B, the conductive members 100 are arranged in the conductive member arrangement region 29 in the respective insertion holes 26 in the holder portion 59, and the closing portions 20 close the conductive member passage regions 28 in the insertion holes 26 in the holder portion 59.

A mode may be implemented in which, as with the connector 57 according to the third modification, one conductive member attaching portion 58, to which the end portions 100*a* of the two conductive members 100 have been attached, is fitted to one holder portion 59. An electrical connection device may be implemented in a mode that includes a first connector 57, which is configured as the connector 57 according to the third modification, and a second connector to which the first connector 57 is connected. Note that, in the case of this electrical connection device, the second connector is configured to include a plurality of terminals configured to be electrically connected to the plurality of conductors 102 in the conductive members 100 attached to the conductive member attaching portion 58, and a housing that is configured to hold the plurality of terminals such that the conductive member attaching portion 58 is fitted to the housing and the holder portion 59 is engaged with the housing.

Figure 39A:
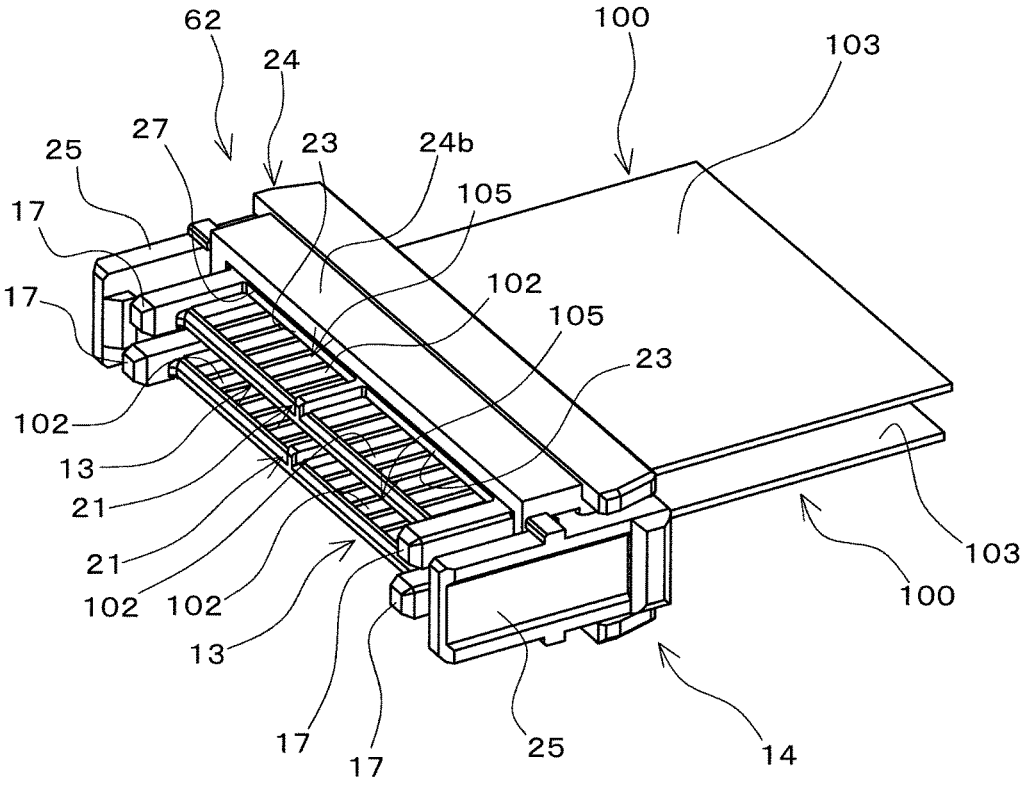
FIG. 39A is a perspective view showing a connector according to a fourth modification, together with a part of each conductive member.
Figure 39B:
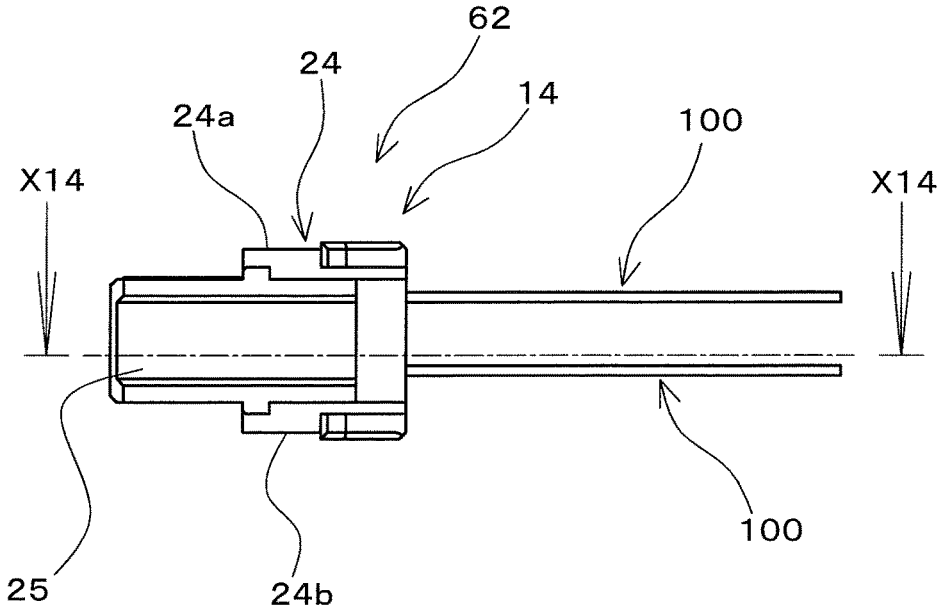
FIG. 39B is a side view showing the connector according to the fourth modification, together with a part of each conductive member.
Figure 40:
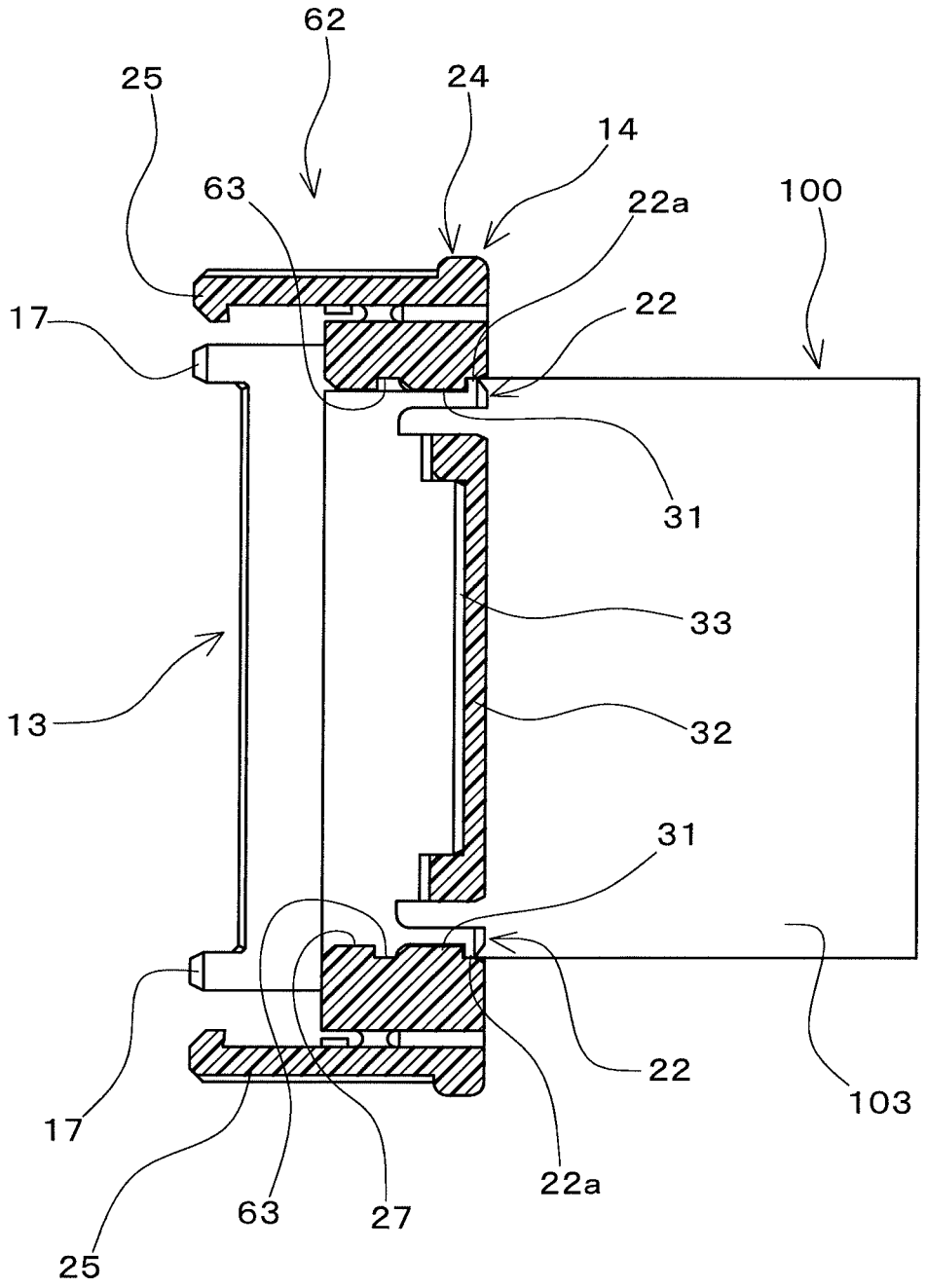
FIG. 40 is a cross-sectional view of the connector according to the fourth modification, taken along a line X14-X14 in FIG. 39B.

(4) FIG. 39A is a perspective view showing a connector 62 according to a fourth modification together with a part of each conductive member 100. FIG. 39B is a side view showing the connector 62 according to the fourth modification together with a part of each conductive member 100. Note that FIG. 39A is a perspective view when viewed from the lower face 24*b* side of the holder portion 14. FIG. 39B is a side view with the upper face 24*a* side of the holder portion 14 shown on the upper side. FIG. 40 is a cross-sectional view of the connector 62, taken along a line X14-X14 in FIG. 39B. Note that FIGS. 39A to 40 show a state where the fitting of the conductive member attaching portion 13 to the holder portion 14 is complete.

Figure 41:
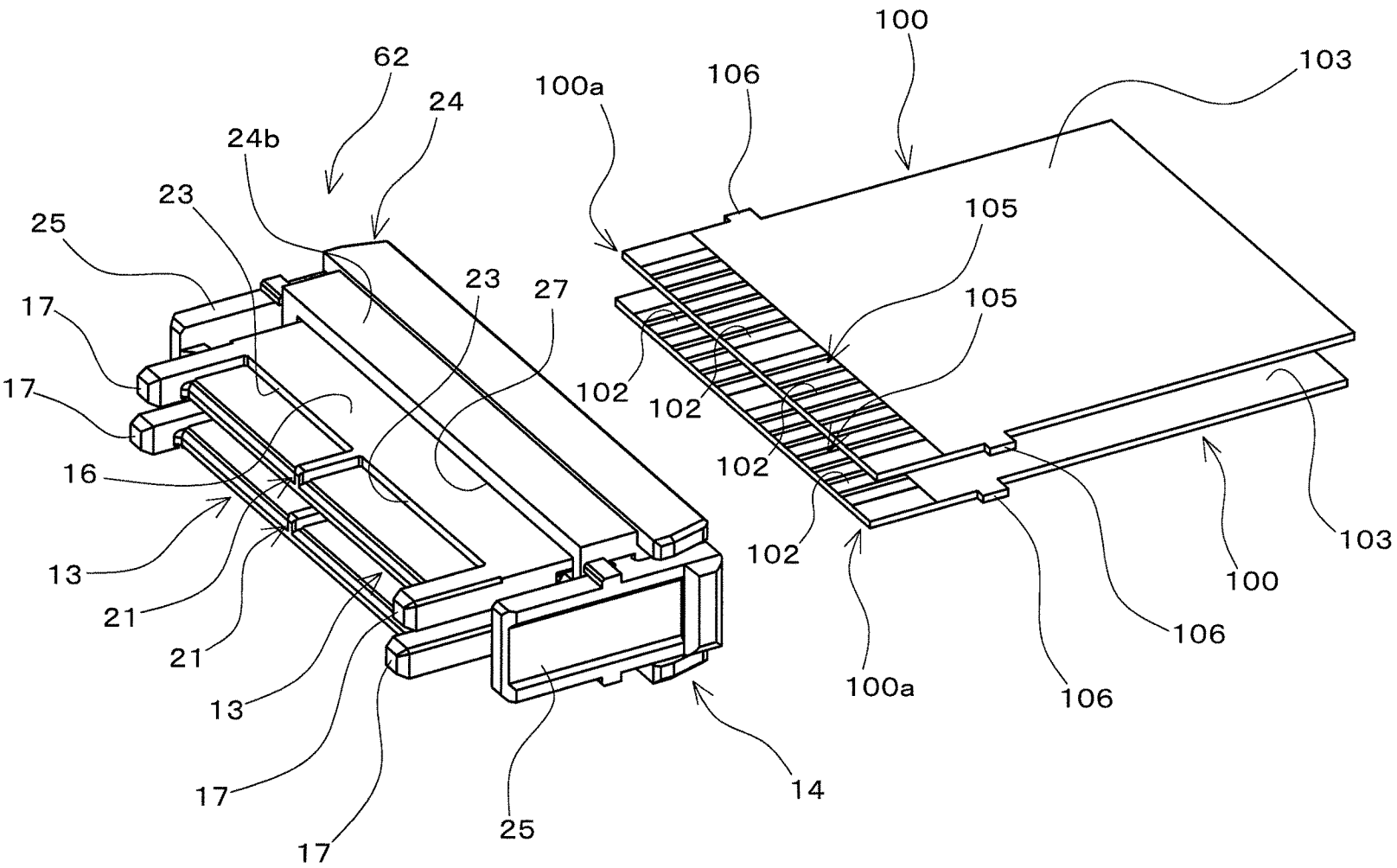
FIG. 41 is a perspective view showing the connector according to the fourth modification together with conductive members, in a state before the conductive members are connected to the connector.
Figure 42:
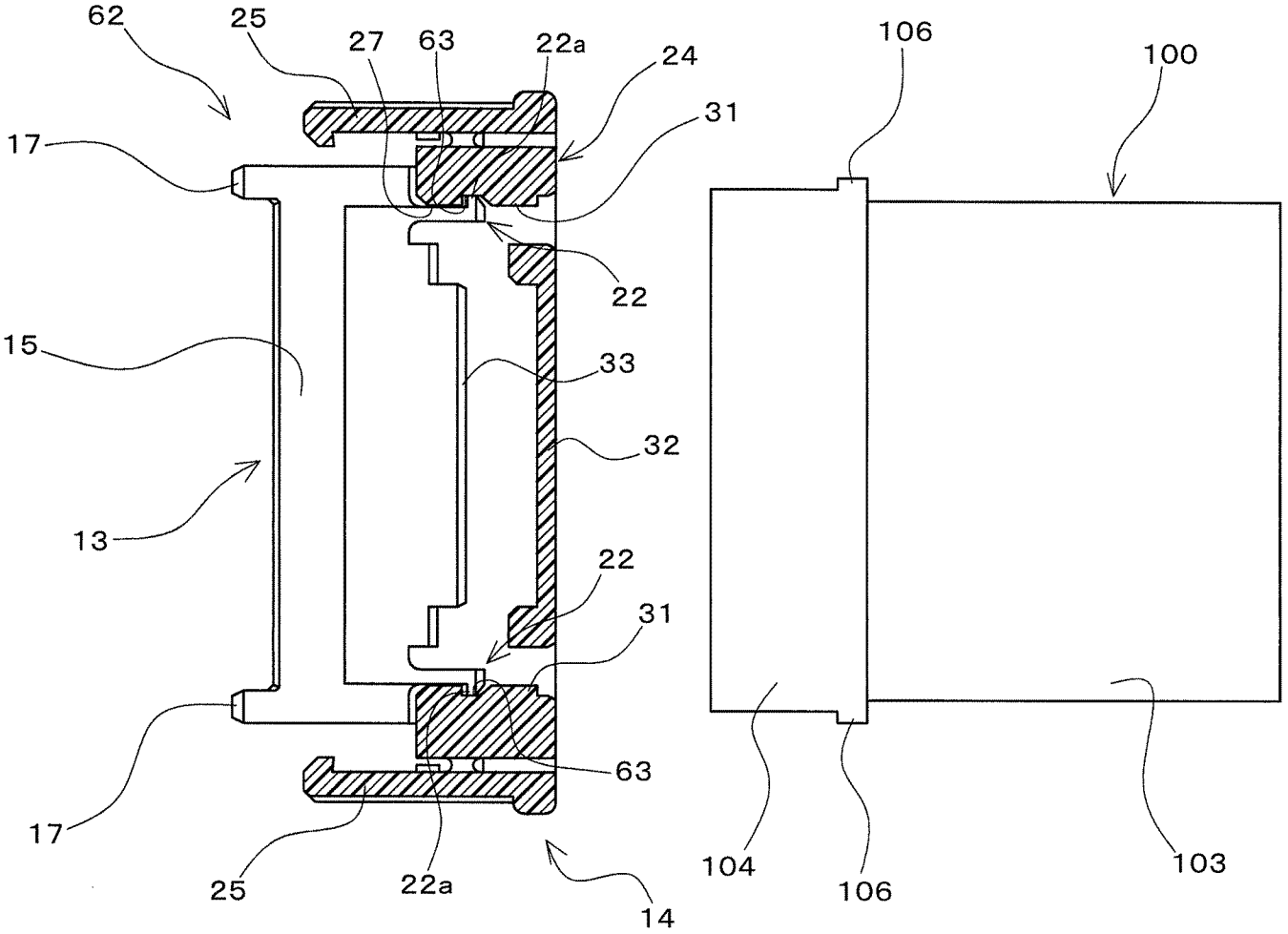
FIG. 42 is a cross-sectional view showing the connector according to the fourth modification together with a part of a conductive member, showing a cross-section taken at the arrow position indicated by the line X14-X14 in FIG. 39B in the state shown in FIG. 41.
Figure 43A:
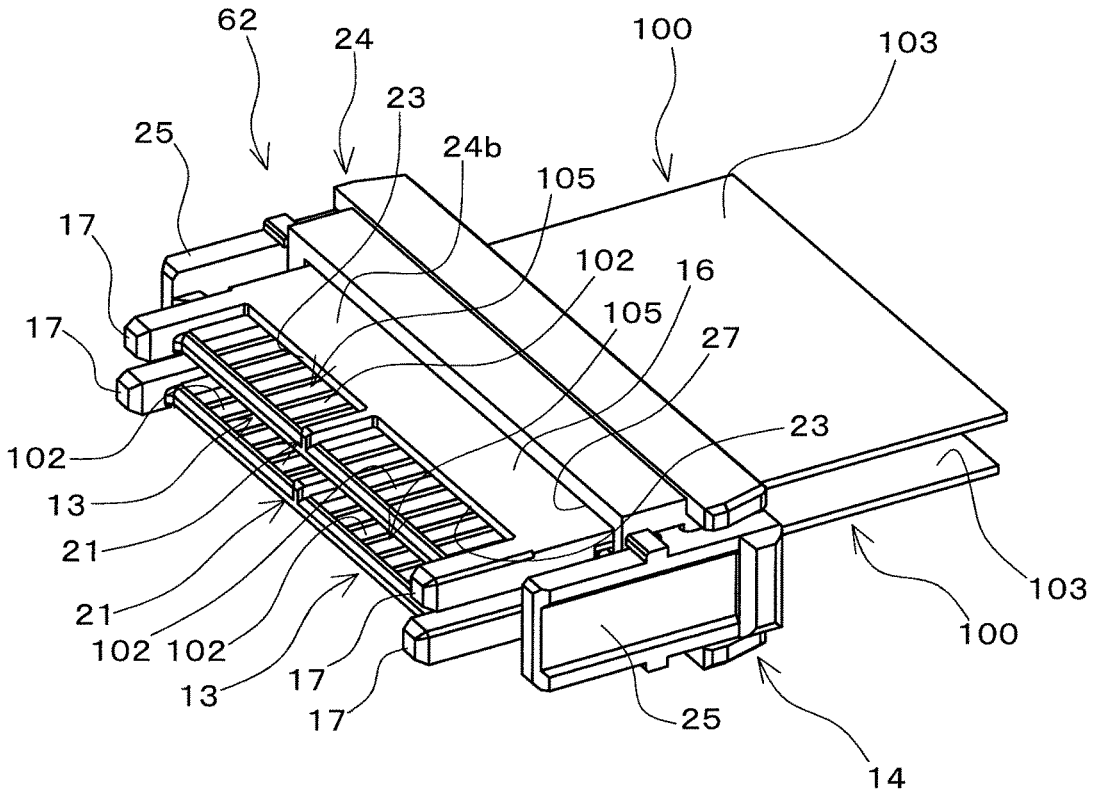
FIG. 43A is a perspective view showing the connector according to the fourth modification, together with a part of each conductive member, in the middle of the conductive members being connected to the connector.
Figure 43B:
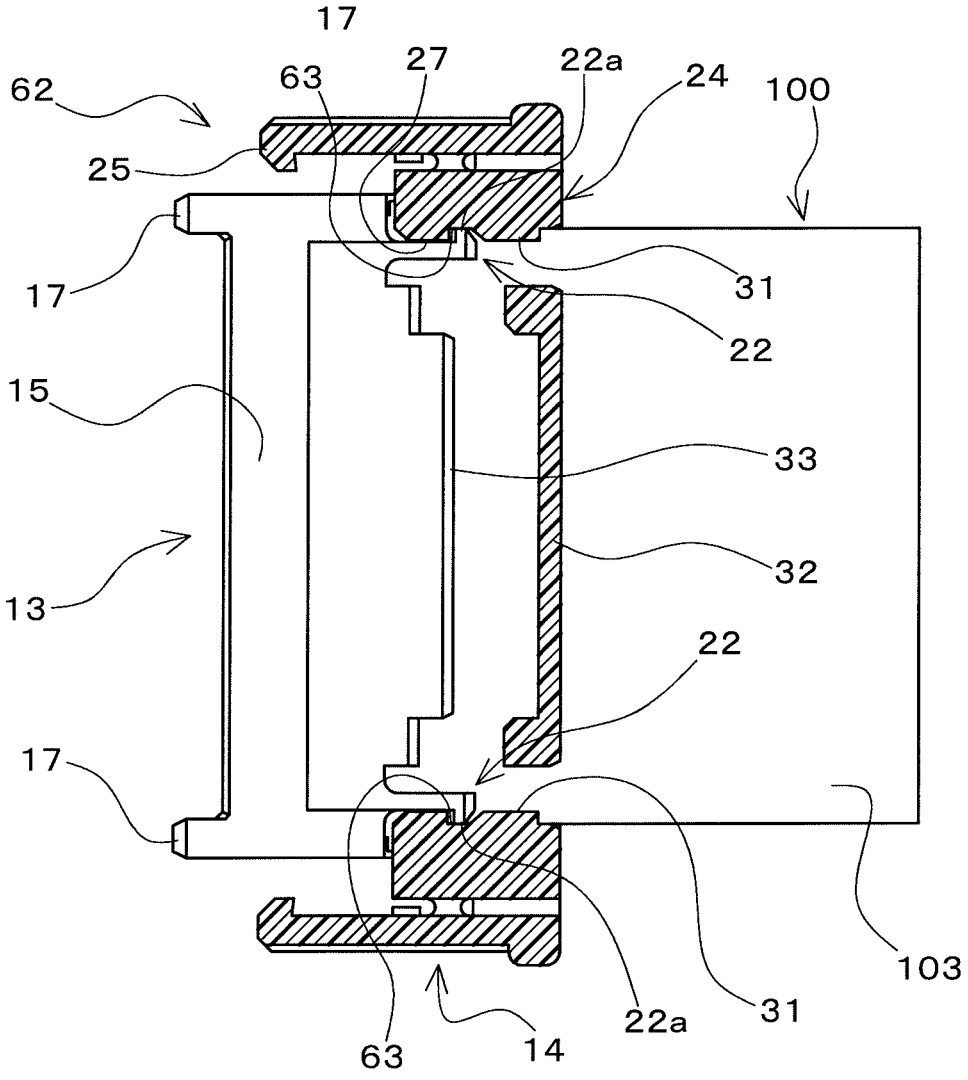
FIG. 43B is a cross-sectional view showing the connector according to the fourth modification together with a part of a conductive member in the state shown in FIG. 43A, showing a cross-section taken at the arrow position indicated by the line X14-X14 in FIG. 39B.

FIG. 41 is a perspective view showing the connector 62 together with a part of each conductive member 100, in a state before the conductive members 100 are connected to the connector 62. FIG. 42 is a cross-sectional view showing the connector 62 together with a part of the conductive member 100, showing a cross-section taken at the arrow position indicated by the line X14-X14 in FIG. 39B in the state shown in FIG. 41. FIG. 43A is a perspective view showing the connector 62 according to the fourth modification together with a part of each conductive member 100, in the middle of the conductive members 100 being connected to the connector 62. FIG. 43B is a cross-sectional view showing the connector 62 according to the fourth modification together with a part of the conductive member 100 in the state shown in FIG. 43A, showing a cross-section taken at the arrow position indicated by the line X14-X14 in FIG. 39B.

The connector 62 according to the fourth modification is configured similarly to the connector 11 according to the above-described embodiment. However, the connector 62 is different from the above-described connector 11 in that the conductive member attaching portion 13 is configured to be held to the holder portion 14 even in a state before the end portion 100*a* of each conductive member 100 is attached to the conductive member attaching portion 13. The connector 62 according to the fourth modification will be described below in terms of a configuration that is different from the configuration of the connector 11 according to the above-described embodiment. Elements that are configured similarly to those in the above-described embodiment will be assigned the same signs in the drawings, or will be described by citing the signs of the elements described in the above-described embodiment, to omit redundant descriptions as appropriate.

The connector 62 shown in FIGS. 39A to 43B is configured to include two conductive member attaching portions 13 and the holder portion 14. However, the holder portion 14 of the connector 62 is different from the holder portion 14 of the above-described connector 11 in terms of being configured to be able to hold the conductive member attaching portions 13 even in a state before the end portions 100*a* of the conductive members 100 are attached to the conductive member attaching portions 13.

More specifically, the holder portion 14 of the connector 62 is provided with a pair of holding recessed portions 63 for enabling each conductive member attaching portion 13 to be held even in a state before the conductive member 100 is attached to the connector 62 (see FIGS. 40, 42, and 43B). The pair of holding recessed portions 63 are provided within the holder portion 14. The pair of holding recessed portions 63 are provided within the holder portion 14 at positions on the distal side of each fitting hole 27, the positions being on the opening side of the fitting hole 27 relative to the engaging protruding portions 31.

The pair of holding recessed portions 63 are provided corresponding to each fitting hole 27 within the holder portion 14. Also, the pair of holding recessed portions 63 are provided as portions that are formed to be recessed on respective sides of the holder portion 14 in the width direction at positions corresponding to each fitting hole 27 within the holder portion 14. The holding recessed portions 63 are provided as portions to which the projections 22*a* of the respective engaging projecting portions 22 of the conductive member attaching portion 13 are fitted and locked.

When the conductive members 100 are connected to the connector 62, initially, the connection between the connector 62 and the conductive members 100 starts in a state where the conductive member attaching portions 13 are locked by the holder portion 14, as shown in FIGS. 41 and 42. At this time, the conductive member attaching portions 13 are held by the holder portion 14 with the projections 22*a* of the engaging projecting portions 22 fitted into the respective holding recessed portions 63 within the holder portion 14.

Note that the connector 62 is configured to enter a state where each conductive member attaching portion 13 is held by the holder portion 14 as shown in FIGS. 41 and 42, from a state where the conductive member attaching portion 13 and the holder portion 14 are separate from each other. When the holder portion 14 holds each conductive member attaching portion 13, the conductive member attaching portion 13 is inserted into the fitting holes 27 in the holder portion 14 in a state where the conductive member 100 is not inserted into the insertion holes 26 in the holder portion 14, and where the conductive member 100 is not attached to the conductive member attaching portion 13.

Each conductive member attaching portion 13 is inserted into the corresponding fitting hole 27 in the holder portion 14 from the end portion in which the closing portion 20, the engaging projecting portions 22, and the abutting portion 33 are provided. Upon the end portion of each conductive member attaching portion 13 being inserted into the fitting hole 27, the projections 22*a* of the pair of engaging projecting portions 22 abut against respective ends of the fitting hole 27, and the engaging projecting portions 22 temporarily bend toward the inside of the conductive member attaching portion 13 in the width direction. Then, upon the ends of the conductive member attaching portion 13 being further inserted into the fitting hole 27, the engaging projecting portions 22 are elastically restored, and the projections 22*a* enter a state of being fitted into the holding recessed portions 63 within the holder portion 14. Thus, the conductive member attaching portion 13 enters a state of being held by the holder portion 14, as shown in FIGS. 41 and 42.

An operation to connect each conductive member 100 to the connector 62 is started in the state shown in FIGS. 41 and 42. Upon the operation to connect each conductive member 100 to the connector 62 being started, the end portion 100*a* of the conductive member 100 is inserted into the corresponding insertion hole 26 in the holder portion 14. At this time, the end portion 100*a* of the conductive member 100 is inserted into the insertion hole 26 through the conductive member passage region 28. Then, the end portion 100*a* of the conductive member 100 inserted in the insertion hole 26 is inserted into the insertion slot 19 in the conductive member attaching portion 13 held by the holder portion 14. Thus, the end portion 100*a* of each conductive member 100 is attached to the conductive member attaching portion 13 held by the holder portion 14, as shown in FIG. 43.

Upon entering the state shown in FIG. 43, next, each conductive member attaching portion 13 to which the end portion 100*a* of the conductive member 100 has been attached is fitted into the fitting hole 27 in the holder portion 14. At this time, since a part of the conductive member attaching portion 13 has already been inserted into a fitting hole 27, the conductive member attaching portion 13 is further inserted toward the distal side of the fitting hole 27, and is fitted into the fitting hole 27. Also, at this time, each conductive member attaching portion 13 is further fitted to the distal side of the fitting hole 27 in a state where the conductive member 100 is displaced so as to be shifted from the conductive member passage region 28 toward the conductive member arrangement region 29 in the insertion hole 26. That is to say, when the conductive member attaching portion 13 to which the conductive member 100 has been attached is fitted to the holder portion 14, the conductive member 100 is fitted into the fitting hole 27 in the holder portion 14 such that the conductive member 100 passes through the conductive member arrangement region 29 in the insertion hole 26.

Upon entering a fitting-completed state where the fitting of the conductive member attaching portion 13 to the holder portion 14 is complete as shown in FIGS. 39A to 40, each conductive member 100 is arranged in the conductive member arrangement region 29 in the insertion hole 26. Also, when in the fitting-completed state, the pair of engaging portions 106 of each conductive member 100 enter a state of being engaged with the corresponding pair of engaged portions 30 of the holder portion 14. Also, when in the fitting-completed state, the closing portion 20 of each conductive member attaching portion 13 closes the conductive member passage region 28, which is a part of the insertion hole 26, in a state of having been fitted into the insertion hole 26 in the holder portion 14. Also, when in the fitting-completed state, the pair of engaging projecting portions 22 of each conductive member attaching portion 13 enter a state of being engaged, at their projections 22*a*, with the pair of engaging protruding portions 31 in the holder portion 14 within the holder portion 14. Also, when in the fitting-completed state, the abutting portion 33 of each conductive member attaching portion 13 abuts against the positioning wall portion 32 of the holder portion 14 within the holder portion 14.

Similar to the connector 62 according to the fourth modification, a mode may be implemented in which each conductive member 100 is inserted into the holder portion 14 and attached to the conductive member attaching portion 13, with the conductive member attaching portion 13 held by the holder portion 14, and thereafter, the conductive member attaching portion 13 is fitted to the holder portion 14. With this configuration, the conductive member attaching portion 13 can be held to the holder portion 14 even in a state before the end portion 100*a* of each conductive member 100 is attached to the conductive member attaching portion 13. For this reason, when in a state before the conductive member 100 is connected, it is possible to prevent the corresponding conductive member attaching portion 13 and the holder portion 14 from being separated, thereby facilitating handling.

Note that an electrical connection device may be implemented in a mode that includes a first connector 62, which is configured as the connector 62 according to the fourth modification, and the second connector 12 according to the above-described embodiment. Also, a connector may be implemented in a mode in which the conductive member attaching portions 13 and the holder portion 14 are integrally provided via a flexible, cord-like elongated connecting portion.

Figure 44A:
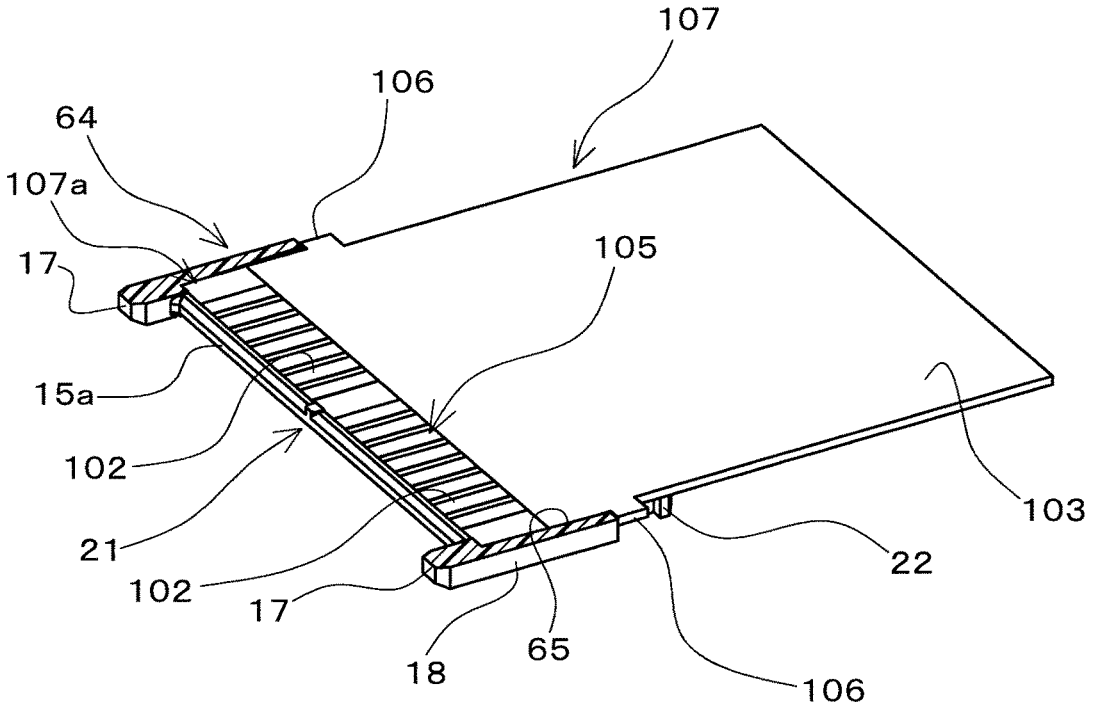
FIG. 44A is a perspective view showing a conductive member attaching portion of a connector according to a fifth modification, together with a part of a conductive member, including a cross-section of the conductive member attaching portion.
Figure 44B:
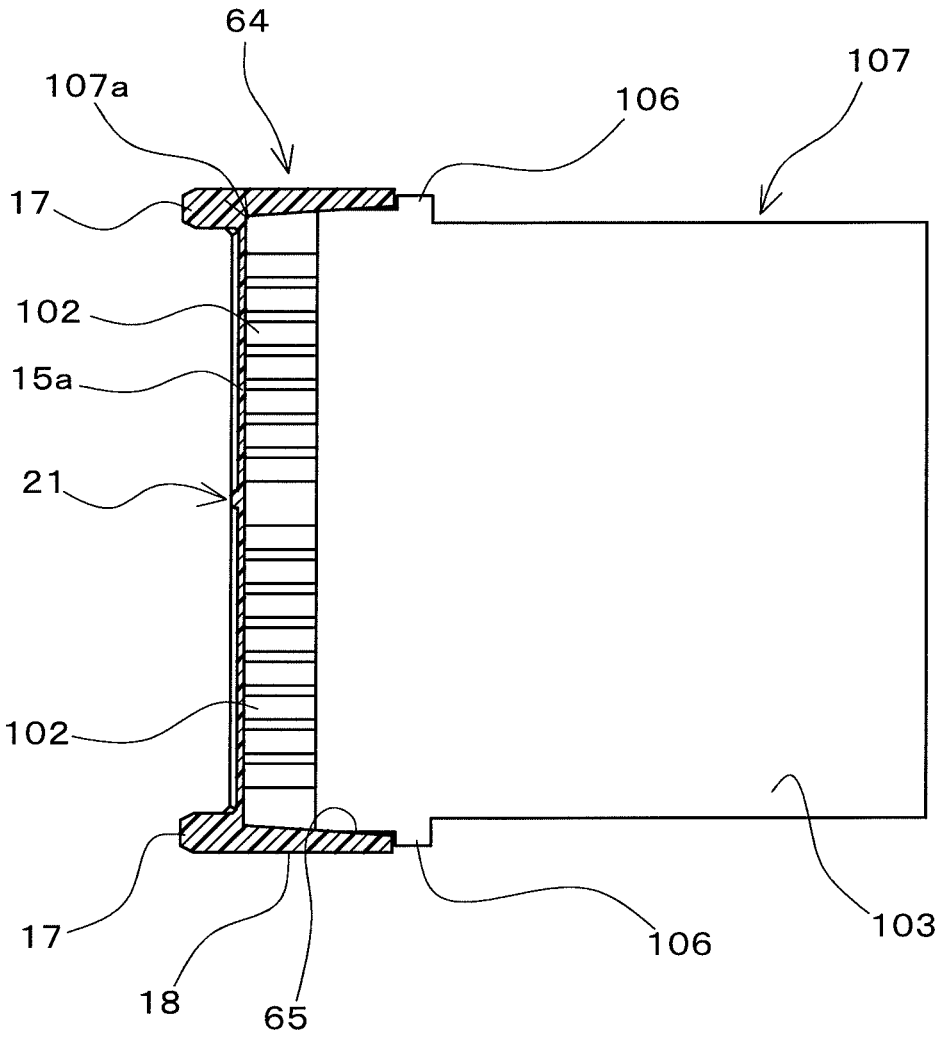
FIG. 44B is a plan view showing the conductive member attaching portion of the connector according to the fifth modification, together with a part of a conductive member, including a cross-section of the conductive member attaching portion.

(5) FIG. 44A is a perspective view showing a conductive member attaching portion 64 of a connector according to a fifth modification together with a part of a conductive member 107, including a cross-section of the conductive member attaching portion 64. FIG. 44B is a plan view showing the conductive member attaching portion 64 of the connector according to the fifth modification together with a part of the conductive member 107, including a cross-section of the conductive member attaching portion 64.

The conductive member attaching portion 64 according to the fifth modification is configured similarly to the conductive member attaching portion 13 of the connector 11 according to the above-described embodiment. However, the conductive member attaching portion 64 is different from the conductive member attaching portion 13 according to the above-described embodiment in that a holding mechanism is provided for holding an end portion 107*a* of the conductive member 107 attached to the conductive member attaching portion 64. The conductive member attaching portion 64 according to the fifth modification will be described below in terms of a configuration that is different from the configuration of the conductive member attaching portion 13 according to the above-described embodiment. Elements that are configured similarly to those in the above-described embodiment will be assigned the same signs in the drawings, or will be described by citing the signs of the elements described in the above-described embodiment, to omit redundant descriptions as appropriate.

The conductive member attaching portion 64 shown in FIGS. 44A and 44B is different from the above-described conductive member attaching portion 13 in the configuration of an insertion slot 65 that is demarcated by the casing portion 18 and into which the end portion 107*a* of the conductive member 107 is inserted. Unlike the insertion slot 19 in the above-described conductive member attaching portion 13, the insertion slot 65 is configured to narrow slightly and gradually toward the leading end side of the conductive member attaching portion 64. More specifically, the insertion slot 65 is configured to narrow as a result of the size of the conductive member attaching portion 64 in the width direction narrowing slightly and gradually toward the leading end side of the conductive member attaching portion 64.

The conductive member 107 to be attached to the conductive member attaching portion 64 is configured similarly to the conductive member 100. However, the conductive member 107 is different from the conductive member 100 in that the end portion 107*a* of the conductive member 107 is formed in a shape that corresponds to the shape of the insertion slot 65. Specifically, the end portion 107*a* of the conductive member 107 is configured such that the size of the conductive member 107 in the width direction narrows slightly and gradually toward the leading end side of the conductive member 107. Upon the end portion 107*a* of the conductive member 107 being inserted into the insertion slot 65, the end portion 107*a* of the conductive member 107 slides against the insertion slot 65 to be fitted into the insertion slot 65. At this time, the end portion 107*a* of the conductive member 107 slides against the insertion slot 65 to be fitted into the insertion slot 65 against the frictional force that occurs between the end portion 107*a* and the insertion slot 65.

As described above, the end portion 107*a* of the conductive member 107 that has been inserted into the insertion slot 65 and attached to the conductive member attaching portion 64 is held by the conductive member attaching portion 64 due to friction. Thus, the conductive member attaching portion 64 is provided with the holding mechanism, which serves as the insertion slot 65, for holding the end portion 107*a* of the conductive member 107 attached to the conductive member attaching portion 64.

With a connector that includes the conductive member attaching portion 64 according to the fifth modification, the end portion 107*a* of the conductive member 107 is held by the holding mechanism in the conductive member attaching portion 64. Accordingly, an operation to fit the conductive member attaching portion 64, to which the conductive member 107 has been attached, into the holder portion 14 is facilitated. For this reason, an operation to connect the conductive member 107 to the connector is facilitated, and the operability can be improved.

Note that an electrical connection device may be implemented in a mode that includes a first connector, which is configured as a connector having the conductive member attaching portion 64 according to the fifth modification and the holder portion 14, and the second connector 12 according to the above-described embodiment.

Figure 45A:
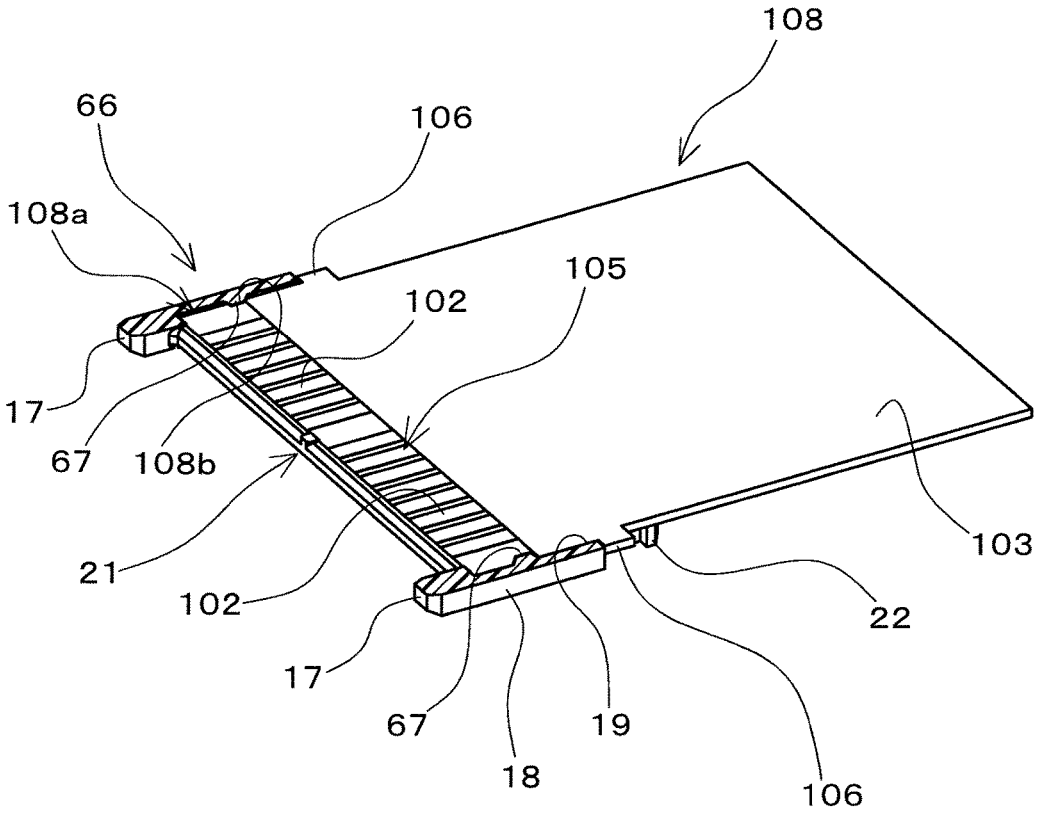
FIG. 45A is a perspective view showing a conductive member attaching portion of a connector according to a sixth modification, together with a part of a conductive member, including a cross-section of the conductive member attaching portion.
Figure 45B:
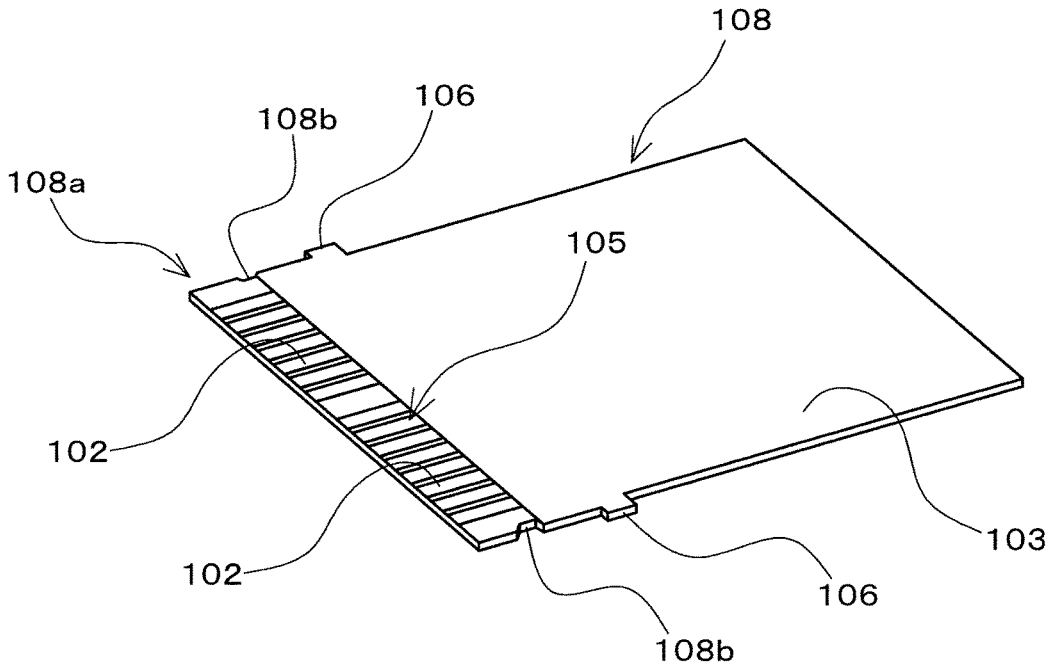
FIG. 45B is a perspective view showing a conductive member attaching portion of a connector according to a sixth modification, together with a part of a conductive member.

(6) FIG. 45A is a perspective view showing a conductive member attaching portion 66 of a connector according to a sixth modification together with a part of a conductive member 108, including a cross-section of the conductive member attaching portion 66. FIG. 45B is a perspective view showing a conductive member attaching portion 66 of a connector according to a sixth modification together with a part of a conductive member 108.

The conductive member attaching portion 66 according to the sixth modification is configured similarly to the conductive member attaching portion 13 of the connector 11 according to the above-described embodiment. However, the conductive member attaching portion 66 is different from the conductive member attaching portion 13 according to the above-described embodiment in that a holding mechanism is provided for holding an end portion 108*a* of the conductive member 108 attached to the conductive member attaching portion 66. The conductive member attaching portion 66 according to the sixth modification will be described below in terms of a configuration that is different from the configuration of the conductive member attaching portion 13 according to the above-described embodiment. Elements that are configured similarly to those in the above-described embodiment will be assigned the same signs in the drawings, or will be described by citing the signs of the elements described in the above-described embodiment, to omit redundant descriptions as appropriate.

The conductive member attaching portion 66 shown in FIG. 45A is different from the conductive member attaching portion 13 according to the above-described embodiment in that a pair of protruding portions 67 are provided within the casing portion 18 that is a casing-like portion for demarcating the insertion slot 19, into which the end portion 108*a* of the conductive member 108 is inserted. The pair of protruding portions 67 are provided on respective sides of the conductive member attaching portion 66 in the width direction within the casing portion 18. The protruding portions 67 are provided as portions formed in a shape that slightly protrudes toward the inside of the insertion slot 19 from inner wall portions of the casing portion 18.

The conductive member 108 to be attached to the conductive member attaching portion 66 is configured similarly to the conductive member 100. However, the conductive member 108 is different from the conductive member 100 in that the end portion 108*a* of the conductive member 108 is formed in a shape that corresponds to the shape of the pair of protruding portions 67 that project to the inside of the insertion slot 19. Specifically, as shown in FIGS. 45A and 45B, the end portion 108*a* of the conductive member 108 is provided with a pair of cutout portions 108*b* at respective ends of the conductive member 108 in the width direction. The cutout portions 108*b* are provided in the end portion 108*a* of the conductive member 108 as portions formed by cutting out the end portions 108*a* so as to be recessed in a shape corresponding to the external shape of the respective protruding portions 67. The pair of cutout portions 108*b* are provided nearer on the leading end side of the end portion 108*a* of the conductive member 108 than the pair of engaging portions 106 in the longitudinal direction of the conductive member 108.

Upon the end portion 108*a* of the conductive member 108 being inserted into the insertion slot 19 in the conductive member attaching portion 66, the end portion 108 of the conductive member 108 abuts against the pair of protruding portions 67, and temporarily bends slightly in the width direction of the conductive member 108. Then, upon the end 108*a* of the conductive member 108 being further inserted further into the insertion slot 19, the reinforcing plate 104 is elastically restored. And, the shape of the temporarily-bent end portion 108*a* of the conductive member 108 is restored to its original unbent state, and enters a state where the pair of protruding portions 67 have been fitted into and engaged with the pair of cutout portions 108*b*. As a result, as shown in FIG. 45A, the end portion 108*a* of the conductive member 108 attached to the conductive member attaching portion 66 enters a state of being held by the conductive member attaching portion 66.

As described above, the end portion 108*a* of the conductive member 108 that has been inserted into the insertion slot 19 and attached to the conductive member attaching portion 66 is held by the conductive member attaching portion 66 due to the engagement between the protruding portions 67 and the cutout portions 108*b*. Thus, in the conductive member attaching portion 66, the holding mechanism for holding the end portion 108 of the conductive member 108 attached to the conductive member attaching portion 66 is provided as the pair of protruding portions 67.

With a connector that includes the conductive member attaching portion 66 according to the sixth modification, the end portion 108*a* of the conductive member 108 is held by the holding mechanism in the conductive member attaching portion 66. Accordingly, an operation to fit the conductive member attaching portion 66, to which the conductive member 108 has been attached, into the holder portion 14 is facilitated. For this reason, an operation to connect the conductive member 108 to the connector is facilitated, and the operability can be improved.

Note that an electrical connection device may be implemented in a mode that includes a first connector, which is configured as a connector having the conductive member attaching portion 66 according to the sixth modification and the holder portion 14, and the second connector 12 according to the above-described embodiment.

Figure 46:
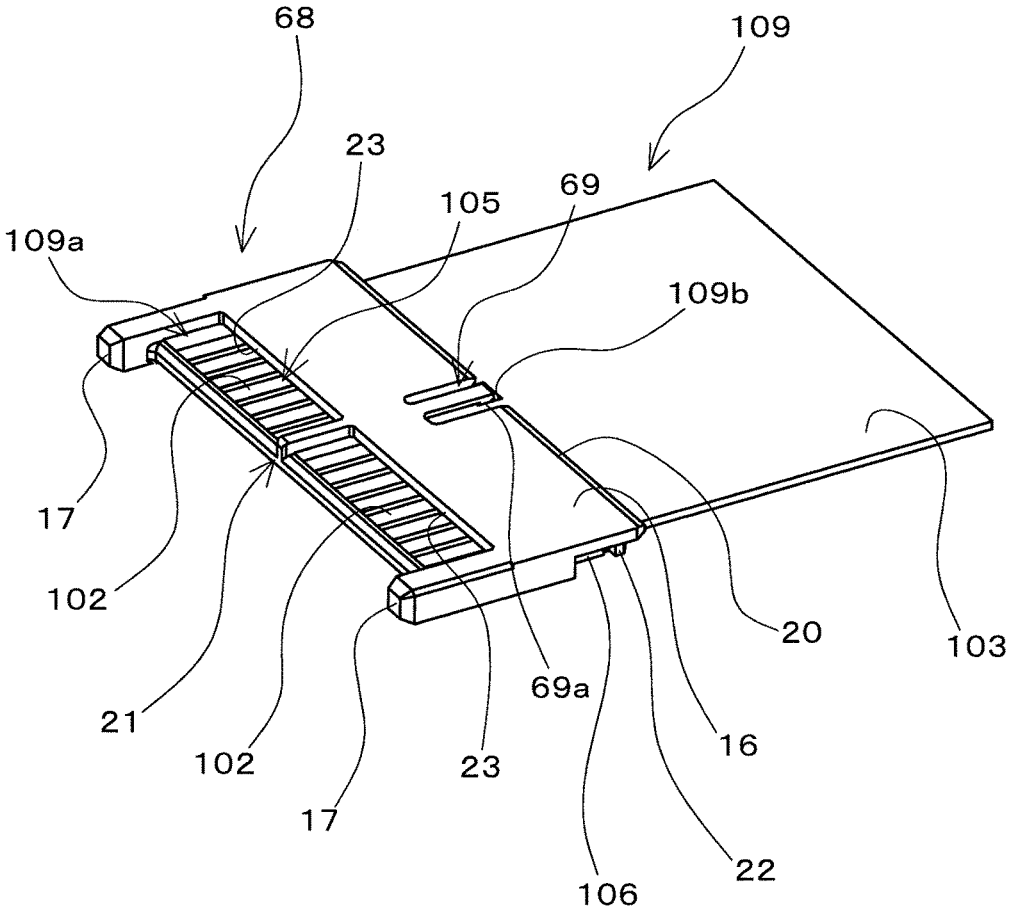
FIG. 46 is a perspective view showing a conductive member attaching portion of a connector according to a seventh modification, together with a part of a conductive member.
Figure 47:
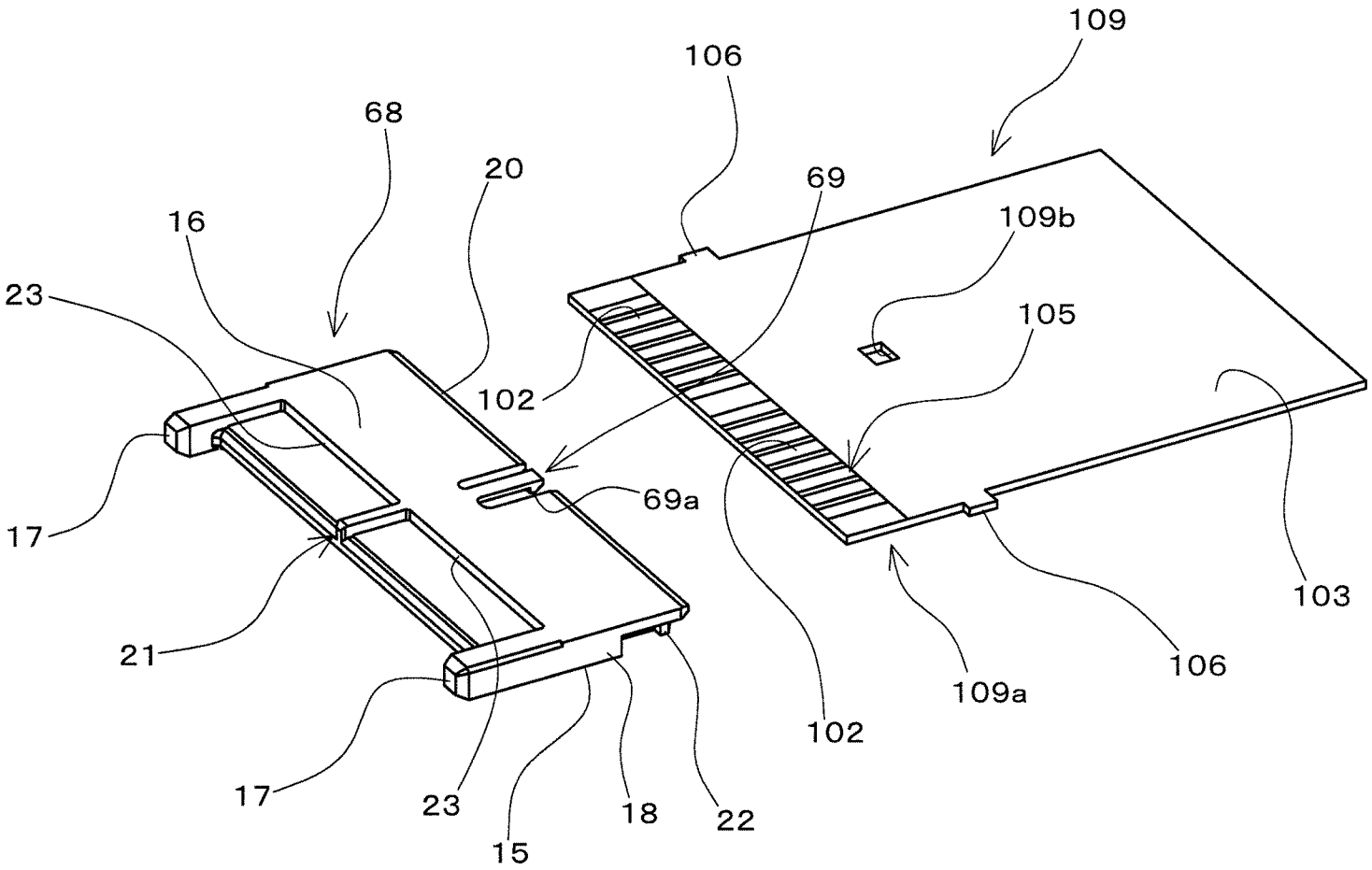
FIG. 47 is a perspective view showing the conductive member attaching portion of the connector according to the seventh modification, together with a part of a conductive member, showing a state before the conductive member is attached to the conductive member attaching portion.

(7) FIG. 46 is a perspective view showing a conductive member attaching portion 68 in a connector according to a seventh modification together with a part of a conductive member 109. FIG. 46 shows a state where the conductive member 109 has been attached to the conductive member attaching portion 68. FIG. 47 is a perspective view showing the conductive member attaching portion 68 in the connector according to the seventh modification together with a part of the conductive member 109, showing a state before the conductive member 109 is attached to the conductive member attaching portion 68.

The conductive member attaching portion 68 according to the seventh modification is configured similarly to the conductive member attaching portion 13 of the connector 11 according to the above-described embodiment. However, the conductive member attaching portion 68 is different from the conductive member attaching portion 13 according to the above-described embodiment in that a holding mechanism is provided for holding an end portion 109*a* of the conductive member 109 attached to the conductive member attaching portion 68. The conductive member attaching portion 68 according to the seventh modification will be described below in terms of a configuration that is different from the configuration of the conductive member attaching portion 13 according to the above-described embodiment. Elements that are configured similarly to those in the above-described embodiment will be assigned the same signs in the drawings, or will be described by citing the signs of the elements described in the above-described embodiment, to omit redundant descriptions as appropriate.

The conductive member attaching portion 68 shown in FIGS. 46 and 47 is different from the conductive member attaching portion 13 according to the above-described embodiment in that a holding projecting portion 69 is provided at an end of the conductive member attaching portion 68 in the connecting direction on the side into which the conductive member 109 is inserted. The holding projecting portion 69 is provided at an end in the connecting direction of the conductive member attaching portion 68 on the side into which the conductive member 109 is inserted, i.e., at an end on the side where the closing portion 20 is provided and the insertion slot 19 is open. Also, the holding projecting portion 69 is provided in a center part of the conductive member attaching portion 68 in the width direction. The holding projecting portion 69 is provided as a portion that projects in a cantilevered manner from the lower face portion 16 in a direction parallel to the connecting direction of the conductive member attaching portion 68. The holding projecting portion 69, which projects in a cantilevered manner, is provided, at an end, with a projection 69*a*, which is provided in a shape protruding toward the upper face portion 15 side.

The conductive member 109 to be attached to the conductive member attaching portion 68 is configured similarly to the conductive member 100. However, the conductive member 109 is different from the conductive member 100 in that the conductive member 109 is provided, in its end portion 109*a*, with a through hole 109*b* at a position corresponding to the position of the projection 69*a* of the holding projecting portion 69. Specifically, the end portion 109*a* of the conductive member 109 is provided, in its center part in the width direction of the conductive member 109, with the through hole 109*b* that passes through the conductive member 109 in the thickness direction of the conductive member 109. An edge part of the through hole 109*b* is provided as a portion with which the projection 69*a* of the holding projecting portion 69 is engaged.

Upon the end portion 109*a* of the conductive member 109 being inserted into the insertion slot 19 of the conductive member attaching portion 68, the end portions 109*a* of the conductive members 109 abut against the projection 69*a* of the holding projecting portion 69, and the holding projecting portion 69 temporarily bends. Then, upon the end portion 109*a* of the conductive member 109 being further inserted into the insertion slot 19, the holding projecting portion 69 is elastically restored, and enters a state where the projection 69*a* of the holding projecting portion 69 has been engaged with the through hole 109*b*. As a result, as shown in FIG. 46, the end portion 109*a* of the conductive member 109 attached to the conductive member attaching portion 68 enters a state of being held by the conductive member attaching portion 68.

As described above, the end portion 109*a* of the conductive member 109 that has been inserted into the insertion slot 19 and attached to the conductive member attaching portion 68 is held by the conductive member attaching portion 68 due to the engagement between the projection 69*a* of the holding projecting portion 69 and the through hole 109*b*. Thus, in the conductive member attaching portion 68, a holding mechanism for holding the end portion 109*a* of the conductive member 109 attached to the conductive member attaching portion 68 is provided as the holding projecting portion 69.

With a connector that includes the conductive member attaching portion 68 according to the seventh modification, the end portion 109*a* of the conductive member 109 is held by the holding mechanism in the conductive member attaching portion 68. Accordingly, an operation to fit the conductive member attaching portion 68, to which the conductive member 109 has been attached, into the holder portion 14 is facilitated. For this reason, an operation to connect the conductive member 109 to the connector is facilitated, and the operability can be improved.

Note that an electrical connection device may be implemented in a mode that includes a first connector, which is configured as a connector having the conductive member attaching portion 68 according to the seventh modification and the holder portion 14, and the second connector 12 according to the above-described embodiment.

Figure 48A:
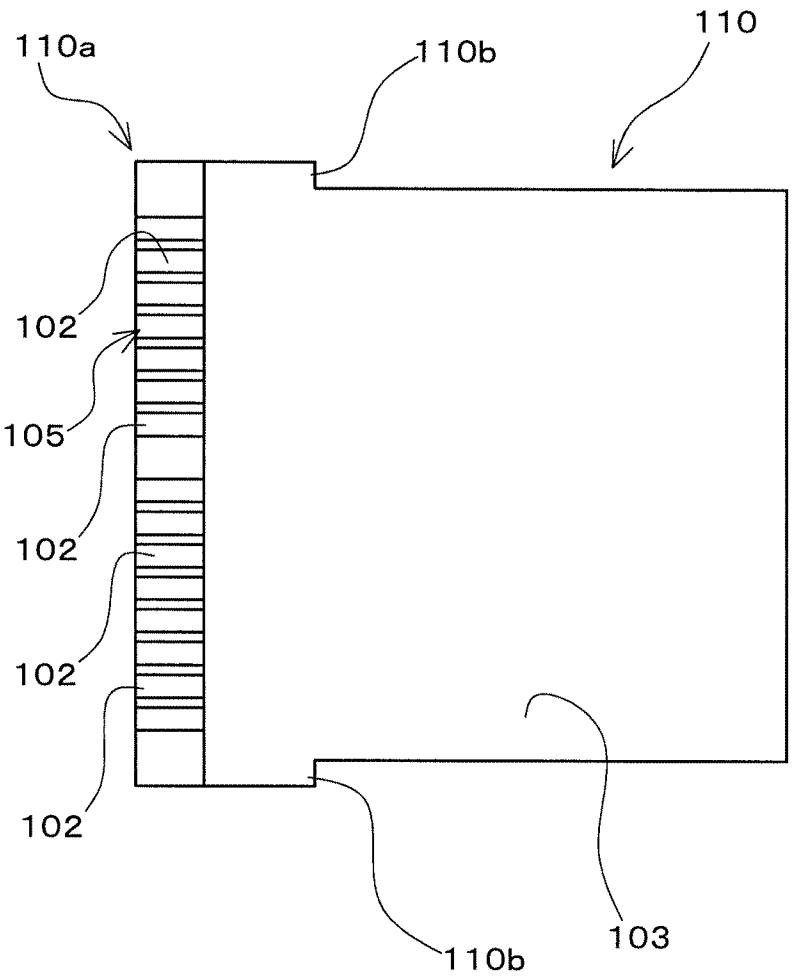
FIG. 48A is a diagram showing a part of a conductive member according to a modification, and shows, with a cross-section of the connector, a state where the conductive member has been connected to the connector.
Figure 48B:
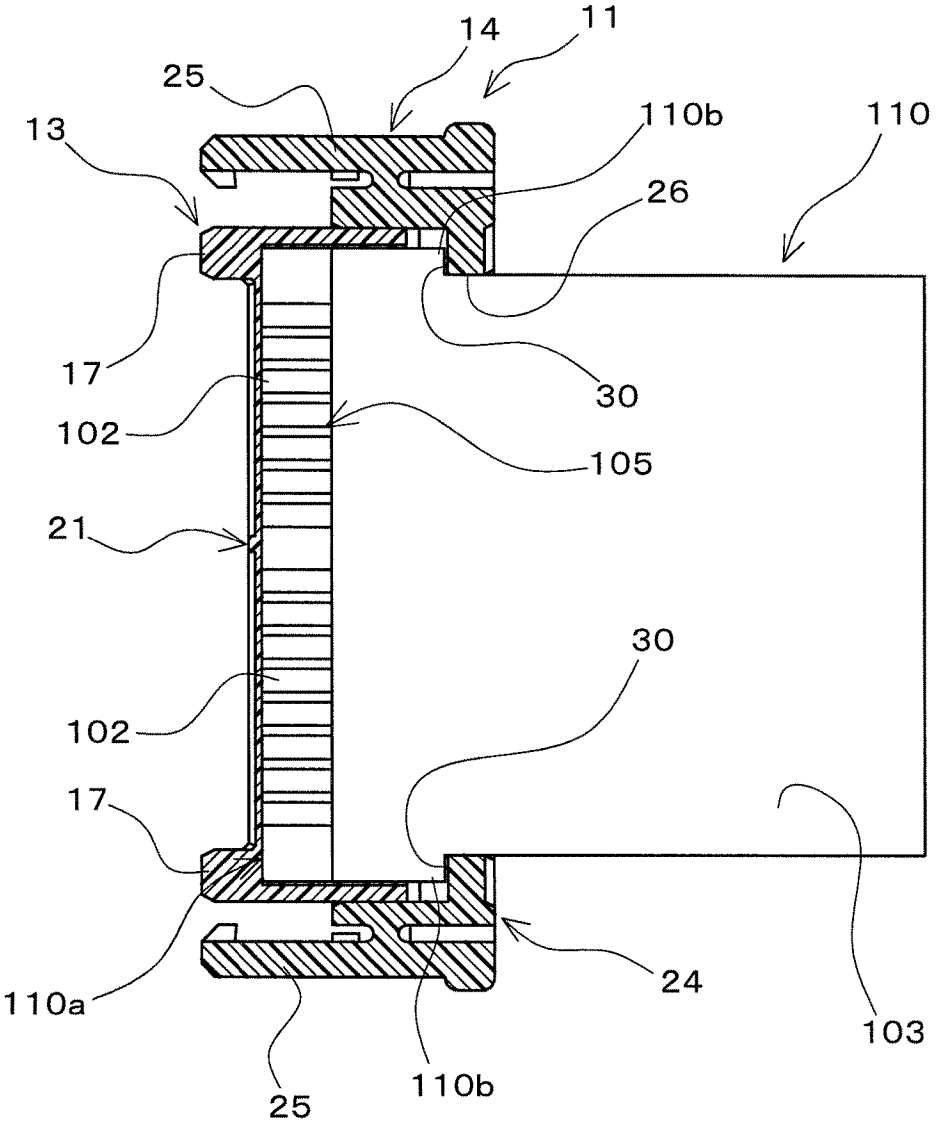
FIG. 48B is a plan view of a part of a conductive member according to a modification.

(8) FIG. 48A is a diagram showing a part of a conductive member 110 according to a modification together with the connector 11, and shows, with a cross-section of the connector 11, a state where the conductive member 110 has been connected to the connector 11. FIG. 48B is a plan view of a part of the conductive member 110 according to the modification.

The conductive member 110 according to this modification is configured similarly to the conductive member 100 described in the above-described embodiment. However, the conductive member 110 is different from the above-described conductive member 100 in the shape of engaging portions 110*b* to be engaged with the engaged portions 30 of the holder portion 14. The conductive member 110 according to this modification will be described below in terms of a configuration that is different from the configuration of the above-described conductive member 100. Elements that are configured similarly to those in the above-described embodiment will be assigned the same signs in the drawings, or will be described by citing the signs of the elements described in the above-described embodiment, to omit redundant descriptions as appropriate.

The conductive member 110 is provided with the engaging portions 110*b* in a part of respective ends in the width direction of the conductive member 110. A pair of engaging portions 110*b* are provided in an end portion 110*a* of the conductive member 110. The engaging portions 110*b* are provided in the end portion 110*a* of the conductive member 110 as portions that expand step-wise to the outside in the width direction at the respective ends in the width direction. By providing the pair of engaging portions 110*b* that expand step-wise to the outside the outer side in the width direction, the conductive member 110 is set such that the size of the end portion 110*a* in the width direction is greater than the size of the other part of the conductive member 110. The engaging portions 110*b* are provided as portions to engage with the engaged portions 30 of the connector 11 when the conductive member 110 has been connected to the connector 11 (see FIG. 48B).

A mode may be implemented in which the conductive member 110 is connected to the connector 11, the conductive member 110 being provided, in the end portion 110*a* of the conductive member 110, with the pair of engaging portions 110*b* that expand step-wise to the outside in the width direction, as in the above-described modification.

Figure 49A:
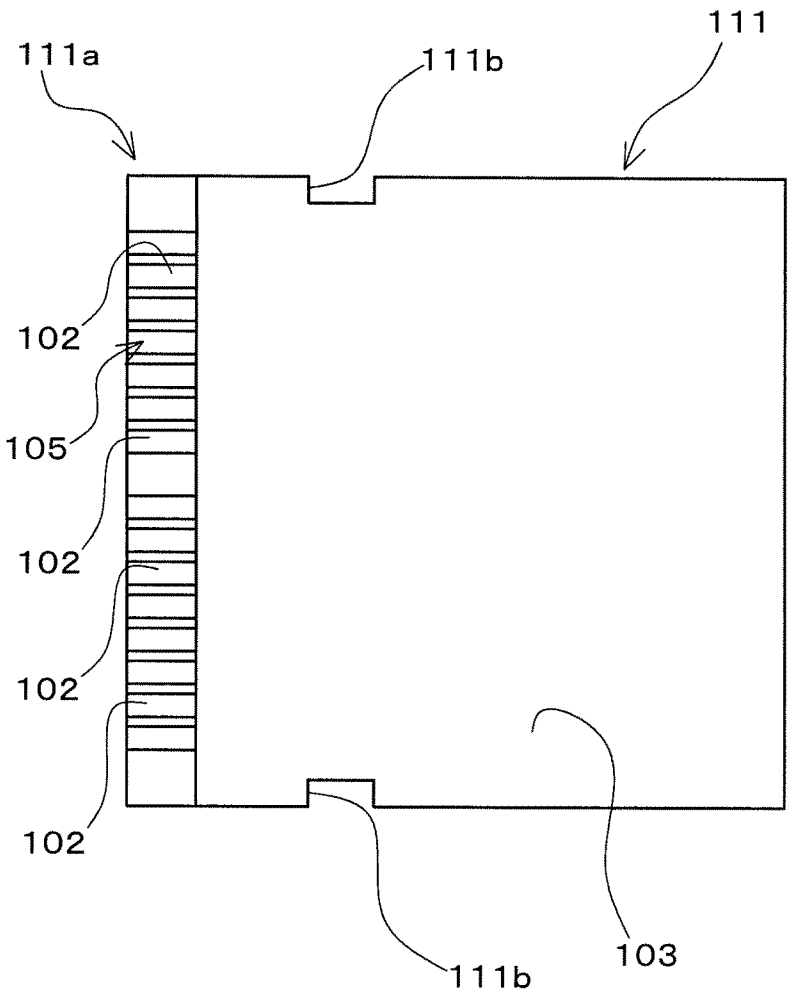
FIG. 49A is a diagram showing a part of a conductive member according to another modification, and shows, with a cross-section of the connector, a state where the conductive member has been connected to the connector.
Figure 49B:
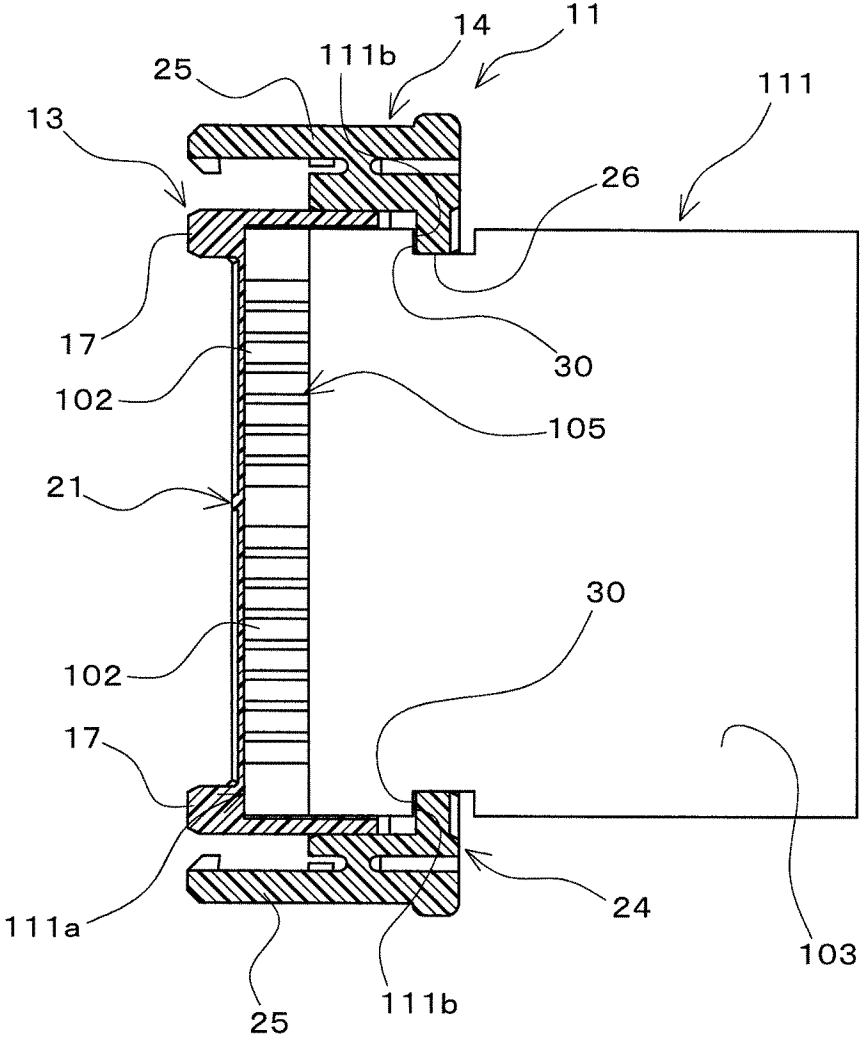
FIG. 49B is a plan view of a part of a conductive member according to another modification.

(9) FIG. 49A is a diagram showing a part of a conductive member 111 according to another modification together with the connector 11, and shows, with a cross-section of the connector 11, a state where the conductive member 111 has been connected to the connector 11. FIG. 49B is a plan view of a part of the conductive member 111 according to another modification.

The conductive member 111 according to another modification is configured similarly to the conductive member 100 described in the above-described embodiment. However, the conductive member 111 is different from the above-described conductive member 100 in the shape of engaging portions 111*b* to be engaged with the engaged portions 30 of the holder portion 14. The conductive member 111 according to another modification will be described below in terms of a configuration that is different from the configuration of the above-described conductive member 100. Elements that are configured similarly to those in the above-described embodiment will be assigned the same signs in the drawings, or will be described by citing the signs of the elements described in the above-described embodiment, to omit redundant descriptions as appropriate.

The conductive member 111 is provided with the engaging portions 111*b* in a portion of respective ends in the width direction of the conductive member 111. A pair of engaging portions 111*b* are provided in the end portion 111*a* of the conductive member 111. The engaging portions 111*b* are provided in the end portion 111*a* of the conductive member 111 as portions formed to be recessed by cutting out the end portion 111*a* toward the inside in the width direction at the respective ends in the width direction. The engaging portions 111*b* are provided as portions to engage with the engaged portions 30 of the connector 11 when the conductive member 111 has been connected to the connector 11 (see FIG. 49B).

A mode may be implemented in which the conductive member 111 is connected to the connector 11, the conductive member 111 being provided, in the end portion 111*a* of the conductive member 111, with the pair of engaging portions 111*b* that are formed to be recessed by cutting out the end portion 111*a* toward the inside in the width direction, as in another modification described above.

(10) Modifications are not limited to the above-described modifications, and more various modifications may be implemented. For example, the above-described embodiment has described an exemplary mode in which a part of the insertion hole is closed by the closing portion of the conductive member attaching portion in a state of being fitted in the insertion hole in the holder portion. However, this need not be the case. The closing portion of the conductive member attaching portion may be configured to close, within the holder portion, a part of the insertion hole in a state of covering the part of the insertion hole in an area where the insertion hole is in communication with the fitting hole, the area being an entrance to the insertion hole in a passage from the fitting hole to the insertion hole.

The above-described embodiment has described the leading end exposing portion in an exemplary mode in which the leading end exposing portion is configured as a cutout portion provided in the housing. However, this need not be the case. The leading end exposing portion may be provided in the housing, the leading end exposing portion being configured as a window-like portion so as to expose a part of the leading end portion of the conductive member attaching portion to the outside with the conductive member attaching portion fitted to the housing, and with the plurality of terminals electrically connected to the plurality of conductors in the conductive member.

INDUSTRIAL APPLICABILITY

The present invention is widely applicable to connectors to which a conductive member configured as a flexible cable or a flexible board having a plurality of conductors is connected, and electrical connection devices having such a connector.

What is claimed is:

1. An electrical connector to which a conductive member configured as a flexible cable or a flexible board having a plurality of conductors is to be connected, comprising:

a conductive member attaching portion configured such that an end portion of the conductive member is to be attached to the conductive member attaching portion; and a holder portion configured to hold the conductive member attaching portion, the holder portion being provided with an insertion hole into which the conductive member is to be inserted, and a fitting hole configured such that the conductive member attaching portion, to which the end portion of the conductive member inserted in the insertion hole has been attached, is fitted into the fitting hole, the fitting hole being in communication with the insertion hole, wherein the holder portion is provided with engaged portions configured such that engaging portions are engaged with the engaged portions of the holder portion, wherein each of the engaging portions is provided in a part of each end of the end portion of the conductive member and be extended outwardly in a width direction, wherein the conductive member attaching portion is provided with a closing portion wherein the closing portion closes a part of the insertion hole with the engaging portion engaged with the engaged portion when the conductive member attaching portion, to which the end portion of the conductive member inserted in the insertion hole has been attached, is fitted into the holder portion, and wherein the closing portion closes a part of the insertion hole in a state of being fitted into the insertion hole.

2. The electrical connector according to claim 1, wherein the conductive member attaching portion is provided with a casing-like portion that demarcates an insertion slot into which the end portion of the conductive member is inserted, and the end portion of the conductive member is attached to the conductive member attaching portion by being inserted into the insertion slot.

3. The electrical connector according to claim 1, wherein the insertion hole in the holder portion includes an engaging portion passage region that is a region at each end of the insertion hole in the width direction of the insertion hole, the engaging portion passage region through which the engaging portion passes when the conductive member is inserted into the insertion hole and passes through the insertion hole, and when the conductive member attaching portion, to which the end portion of the conductive member inserted in the insertion hole has been attached, has been fitted into the holder portion, the closing portion closes at least the engaging portion passage region in the insertion hole with the engaging portion engaged with the engaged portion.

4. The electrical connector according to claim 3, wherein the insertion hole of the holder portion includes a conductive member passage region through which the conductive member passes when being inserted into the insertion hole, and a conductive member arrangement region in which the conductive member is arranged in a state of being disposed so as to be shifted from the conductive member passage region after the conductive member has been inserted in the insertion hole, the conductive member passage region includes the engaging portion passage region, and when the conductive member attaching portion, to which the end portion of the conductive member inserted in the insertion hole has been attached, has been fitted into the holder portion, the closing portion closes the conductive member passage region in the insertion hole with the engaging portion engaged with the engaged portion.

5. The electrical connector according to claim 1, wherein the conductive member attaching portion is provided with a bending restriction portion configured to hold the end portion of the conductive member attached to the conductive member attaching portion in a front-back face direction of the conductive member in a center part in the width direction of the conductive member attaching portion, the bending restriction portion restricting bending deformation of the conductive member.

6. An electrical connection device including the electrical connector according to claim 1, comprising:

a first connector configured as the connector; and a second connector to which the first connector is connected, wherein the second connector includes:

a plurality of terminals configured to be electrically connected to the plurality of conductors in the conductive member attached to the conductive member attaching portion; and a housing configured to hold the plurality of terminals, the housing to which the conductive member attaching portion is fitted and with which the holder portion is engaged.

7. The electrical connection device according to claim 6, wherein the housing is provided with a leading end exposing portion configured as a window-like part or a cutout part so as to expose a part of a leading end portion of the conductive member attaching portion to the outside, with the conductive member attaching portion fitted to the housing, and with the plurality of terminals electrically connected to the plurality of conductors in the conductive member.

8. The electrical connection device according to claim 6, wherein the conductive member attaching portion is provided with a projecting portion provided so as to project toward a leading end side of the conductive member attaching portion at each end of the conductive member attaching portion in the width direction, the projecting portion being guided along and fitted into a guide groove provided in the housing, when the conductive member attaching portion is fitted to the housing; and an upper face portion and a lower face portion configured to sandwich the end portion of the conductive member attached to the conductive member attaching portion in a front-back face direction of the conductive member, and a projecting length of the projecting portion relative to either the upper face portion or the lower face portion is set to be longer than a projecting length of the projecting portion relative to the other one.

* * * * *